US011406228B2

(12) United States Patent
Cook

(10) Patent No.: US 11,406,228 B2
(45) Date of Patent: Aug. 9, 2022

(54) SHOWER INSTALLATIONS AND METHODS FOR EFFICIENTLY CONSTRUCTING SAME

(71) Applicant: Tile Redi, LLC, Coral Springs, FL (US)

(72) Inventor: Joseph R. Cook, Parkland, FL (US)

(73) Assignee: TILE REDI, LLC, Charlotte, NC (US)

( * ) Notice: Subject to any disclaimer, the term of this patent is extended or adjusted under 35 U.S.C. 154(b) by 0 days.

(21) Appl. No.: 16/748,412

(22) Filed: Jan. 21, 2020

(65) Prior Publication Data

US 2021/0219789 A1 Jul. 22, 2021

(51) Int. Cl.

| | |
|---|---|
| ***A47K 3/28*** | (2006.01) |
| ***A47K 3/40*** | (2006.01) |
| ***E03C 1/04*** | (2006.01) |

(52) U.S. Cl.

CPC ..... *A47K 3/284* (2013.01); *A47K 3/40* (2013.01); *E03C 1/0408* (2013.01); *A47K 2201/02* (2013.01)

(58) Field of Classification Search

CPC ..... A47K 3/28; A47K 3/283; A47K 3/284; A47K 3/40; E04H 1/1216; E04H 2001/1288

See application file for complete search history.

(56) References Cited

U.S. PATENT DOCUMENTS

| | | | | |
|---|---|---|---|---|
| 2006/0213006 | A1* | 9/2006 | Rush, Jr. | A47K 3/40 4/613 |
| 2011/0197355 | A1* | 8/2011 | Lemire | E03F 5/0408 4/613 |
| 2013/0276226 | A1* | 10/2013 | Cook | B29C 45/14065 4/613 |
| 2020/0214510 | A1* | 7/2020 | Brill | A47K 3/40 |

* cited by examiner

*Primary Examiner* — Janie M Loeppke
(74) *Attorney, Agent, or Firm* — Moore & Van Allen PLLC

(57) ABSTRACT

A kit for manufacturing a shower, comprising a shower pan, one or more pre-sized and shaped floor covering panels, one or more pre-sized and shaped wall covering panels, and, in some of the embodiments, one or more pre-sized and shaped curb covering panels. The invention is also directed to a method for manufacturing a shower by the steps of: (i) installing a shower pan, (ii) installing one or more pre-sized and shaped floor covering panels, (iii) installing one or more pre-sized and shaped wall covering panels, and, in some of the embodiments, (iv) installing one or more pre-sized and shaped curb covering panels. The invention is also directed to a manufactured shower, comprising: a shower pan, one or more pre-sized and shaped floor covering panels, one or more pre-sized and shaped wall covering panels, and, in some embodiments, one or more pre-sized and shaped curb covering panels.

10 Claims, 49 Drawing Sheets

SHOWER INSTALLATIONS AND METHODS FOR EFFICIENTLY CONSTRUCTING SAME

REFERENCE TO RELATED APPLICATIONS

This application is a continuation-in-part of U.S. patent application Ser. No. 16/712,421, filed on Dec. 12, 2019, the entire contents of which are incorporated by reference herein as though fully set forth herein, and priority to that application is claimed herein.

BACKGROUND OF THE INVENTION

Field of the Invention

The instant invention relates to shower installations, and, more particularly, relates to the provision of unique sets of prefabricated component parts of a completed shower to an installation site, the process for producing the finished shower installation, and the resulting shower.

Description of the Prior Art

Few meaningful improvements in shower installations, including processes for providing and installing the components of a shower, have been forthcoming in recent years. However, the requirements of developers and the construction industry at large, including do-it-your-selfers, continue to become more and more demanding. Developers' expectations regarding the cost of shower installations, as well as the time needed to install the component parts making up the shower installation, continue to rise. Therefore, innovation in the area is essential.

Conventional mortar-based shower bases, as well as prefabricated shower pans, have become ubiquitous. Traditional decorative covering materials, such as porcelain or ceramic tile, natural stone, etc., are time consuming to install, and require great precision and skill to install if the finished product is to be of the necessarily high-quality expected by the developer customer or consumer.

Historically, tiled shower floors were installed by tile setters who cut and set each individual tile required to meet the pitch of the shower floor. Over time, the search for a faster and less expensive shower floor solution eventually led to cultured marble, fiberglass and acrylic shower pans, which are less appealing aesthetically but take less time and are less expensive to install than cutting tiles and/or individually cutting and installing tiles to match the pitch of the shower floor. Tile wall panels were also used with the fiberglass and acrylic shower pans, because tile floor panels for showers were simply incompatible with the required pan pitch.

The installation of traditional covering materials, which typically are made up of rectangular tiles pieced together in spaced relationship around the walls and (in most instances) floor of a shower installation, requires innumerable painstaking and time-consuming manual cuts to be made to shape the tile pieces into the configuration necessary to create the desired finished look.

The number of cuts and the time required to place each individual tile into place dramatically but necessarily increases the amount of time taken for any particular shower installation using currently available materials and installation techniques. A reduction in the number of cuts and time required to install the covering material would provide a material competitive and economic advantage to all involved. Reducing the time required to create a shower leads to a corresponding reduction in labor costs for such an endeavor.

In addition, the use of numerous, small, individual tile pieces to make up the floor and/or wall covering surfaces results in unnecessary excess material waste and presents an unwieldy installation environment, and leaves numerous grout lines which over time become worn and dirty which in turn requires more cleaning and maintenance.

Existing market conditions favor shower kits which are fast and easy to install. The lack of skilled labor in most major US markets (according to the Association of General Contractors) makes the prospect of creating showers by traditional skilled labor-intensive techniques undesirable, and often impossible. Existing shower kit solutions are dependent on the skill of the installers, who far too often produce inconsistent, mediocre, or downright shoddy installations.

Moreover, there are no shower kit solutions which use one-piece and/or two-piece shower floor panels because the multi-pitch surfaces of traditional shower pans simply are not compatible with one or two shower floor panel solutions.

As a result of the aforementioned shortcomings, the shower kit industry has chosen to abandon to a great extent the use of tile floors, and instead has chosen to focus on less expensive, lower quality "one size fits all" solutions, including cookie cutter, plain vanilla design options which rely on inexpensive acrylic, fiberglass and/or cultured marble shower bases with corresponding acrylic, fiberglass and cultured marble walls. Over time, the market expanded to include tile wall panels together with the extraordinarily expensive stone, marble or quartz shower bases. However, the acrylic, fiberglass, cultured marble and quartz shower bases all use the same basic shower pan design, which requires the shower pans to have a uniform tile line where the shower pan base meets the wall panels, and, most often, the shower pan had a small "shelf" that is several inches high and wide formed around the perimeter of the pan thereby providing a level platform to install the shower walls without needing to incorporate pitch in the wall panels. This solution allowed tile wall panels to also be included in certain shower kits, but also made it impossible for tile shower floor panels because these bases were not intended to be tiled and in fact couldn't be tiled, and if one tried to tile the bases, tiles of 4" or less would have been needed to deal with the pitch constraints of the floors of these shower bases. Furthermore, while those "shelfs" were used with the acrylic, fiberglass, cultured marble and stone bases, they have not been used with tiled floors, because the need to tile these "shelfs'" resulted in a design nightmare, both in terms of the number and narrowness of shelf panels along with the extra grout lines impairing the cohesiveness of the shower design.

Therefore, tiled shower floors have become the exclusive province of skilled, expensive, tile setters, who are required to cut and set each individual shower floor tile. Cutting and setting tile is an expensive, tedious and time-consuming process, with the final look of the shower completely dependent either on the installer's skill set or commitment or both, when it comes to delivering a quality tile installation.

Most shower installations require double digit hours of labor performed over days or weeks to complete. Moreover, in institutional installations, such as hospitality and multifamily projects, both new builds and renovations, multifamily condos and apartments and hospitality rooms may be off the market for long periods of time while renovations linger, depriving the owner of the use and/or revenue from these facilities.

The primary reasons tile floor panels have not been appropriated in the shower kit marketplace relates to the pitch of the shower floor. Quite simply, historically, the pitch requirements of standard drain shower pan floors have been incompatible with tile shower floor panel kits, because they require tiles no larger than 4" or 5" square together with all the extra grout lines interrupting the tile design, along with the additional maintenance required for the grout lines.

It is, therefore, a principal object of this invention to drastically reduce the amount of time needed to install a finished shower, and in doing so to reduce the cost of the shower.

It is also an object of this invention to provide shower installation kits which contain all of the necessary, pre-cut, components to create a finished shower installation in less time than is currently necessary in available systems for every shower size and shape, with any shower drain location.

It is a further object of this invention to provide a solution to the unsatisfactorily time-consumptive and expensive task of cutting and installing covering material in showers.

It is also an object of this invention to combine planar pitch shower pans [defined in "Detailed Description" section] with linear drains (also defined in the Detailed Description"), which then can accommodate any shower floor with either a one or two shower floor panel solution, regardless of the drain location.

In so doing, customers can be provided with an endless choice of grate and shower floor panel configurations using standard drains, trench drains, removable standard grates, removable trench grates, non-removable tunnel trenches and countless one and two shower floor panel solutions with different drain cutouts for the removable grate-portions of the drains, if any.

SUMMARY OF THE INVENTION

With these and other objects in mind, there is disclosed herein a system and method for dramatically reducing the amount of time necessary to install a finished shower, as well as novel component parts thereof, and the resulting novel showers.

In embodiments, the invention is directed to a series of kits for manufacturing a shower, and comprises a shower pan, one or more pre-sized and shaped floor covering panels, one or more pre-sized and shaped wall covering panels, and, in some of the embodiments, one or more pre-sized and shaped curb covering panels.

In embodiments, the invention is also directed to a method for manufacturing a shower, and comprises the steps of: (i) installing a shower pan, (ii) installing one or more pre-sized and shaped floor covering panels, (iii) installing one or more pre-sized and shaped wall covering panels, and, in some of the embodiments, (iv) installing one or more pre-sized and shaped curb covering panels.

Also in embodiments, the invention is directed to a manufactured shower, comprising: a shower pan, one or more pre-sized and shaped floor covering panels, one or more pre-sized and shaped wall covering panels, and, in some of the embodiments, one or more pre-sized and shaped curb covering panels.

In certain embodiments, the invention employs a single shower floor tile panel.

In other embodiments, the invention employs two shower floor tile panels.

In still other embodiments, the invention employs more than two shower floor tile panels.

Figure 13:
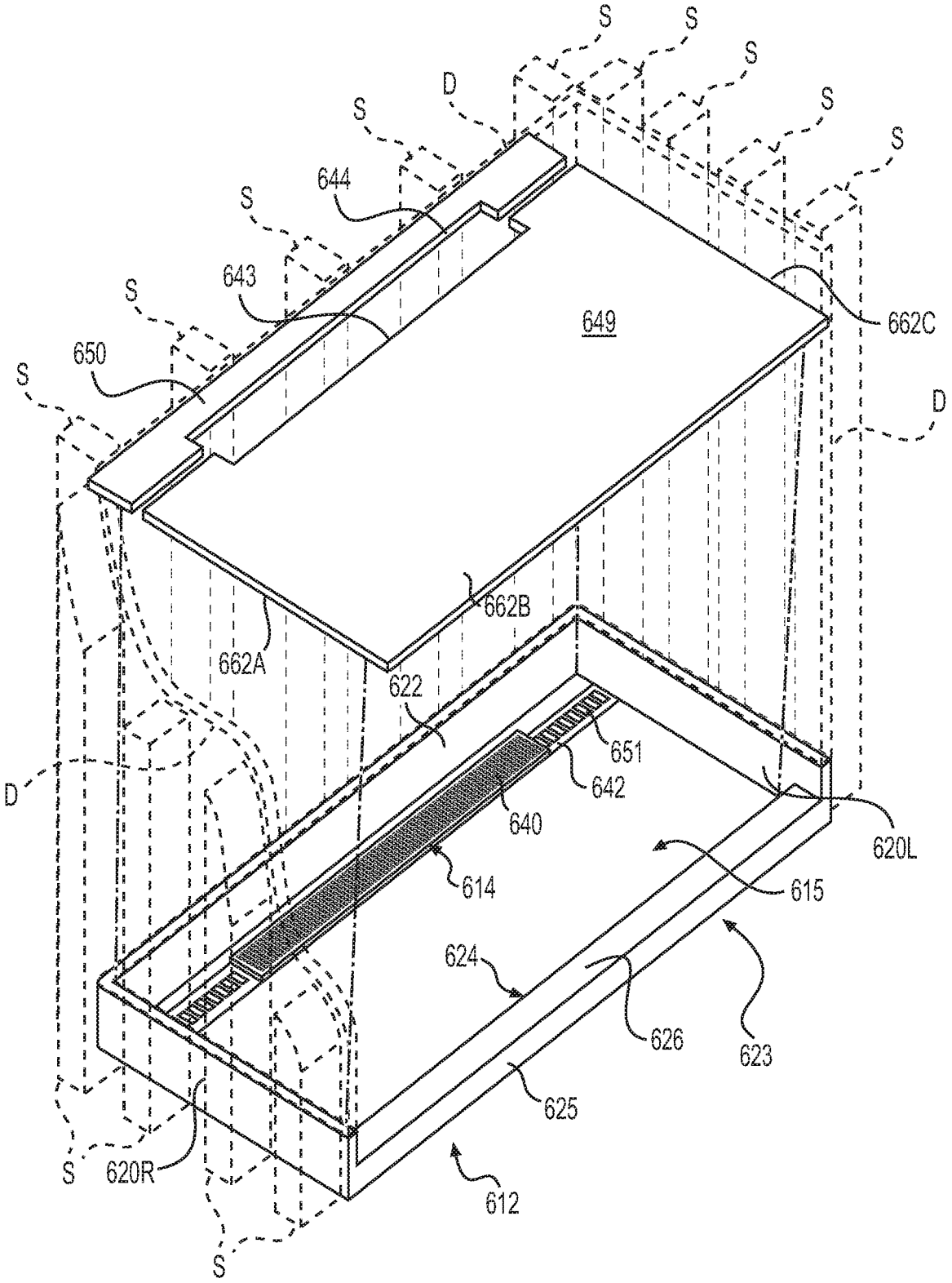
FIG. 13 is a right, front perspective exploded view of a step in a process for creating a back or rear drain shower in accordance with the invention. [back drain embodiment, 42" grate]

13A is the same view as FIG. 13 but with a slight modification to the location of the linear drain.

Figure 14:
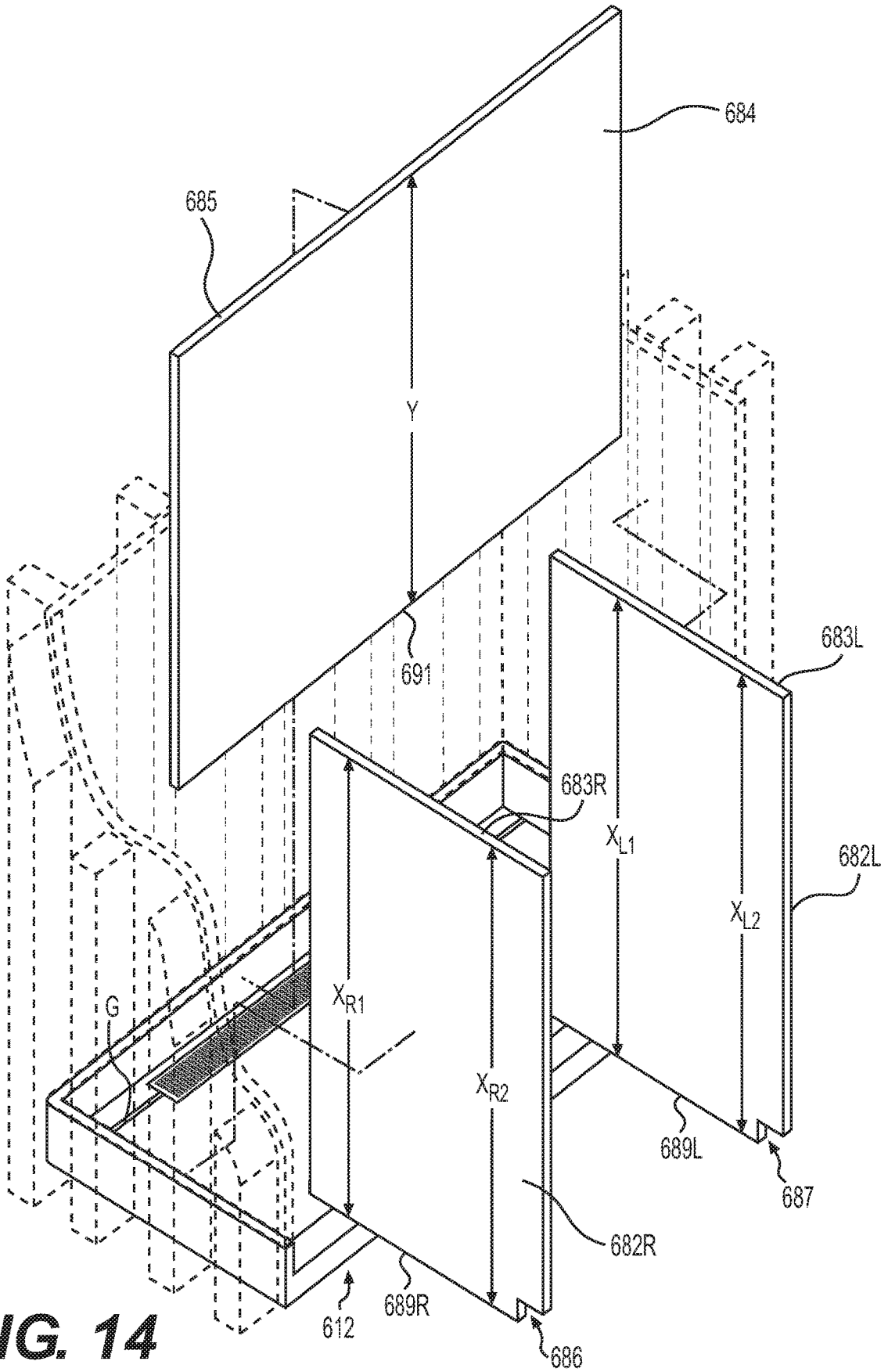

FIG. 14 is a right, front perspective exploded view of another step in said process.

Figure 15:
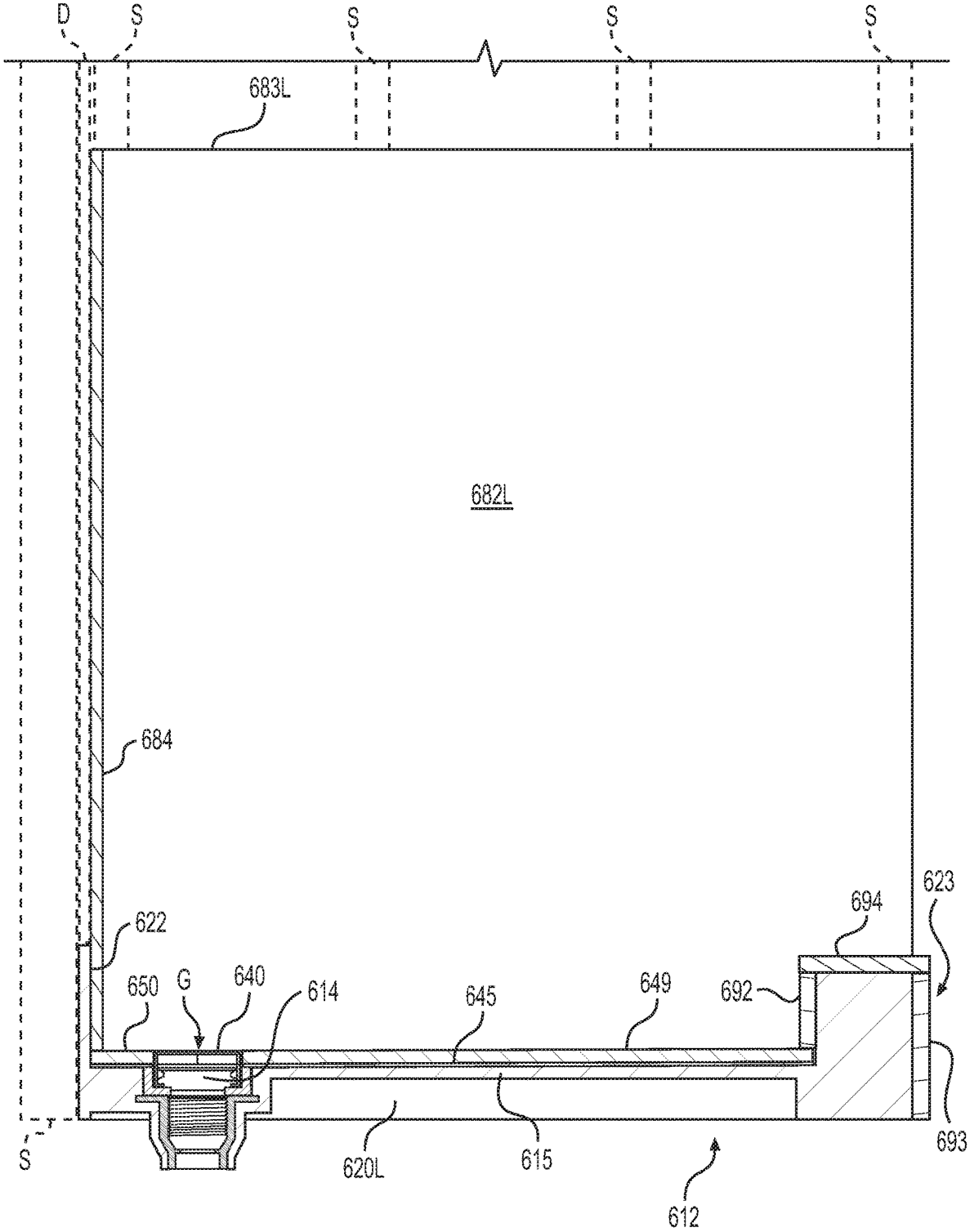

FIG. 15 is an elevational view of a portion of the shower in accordance with said process.

Figure 16:
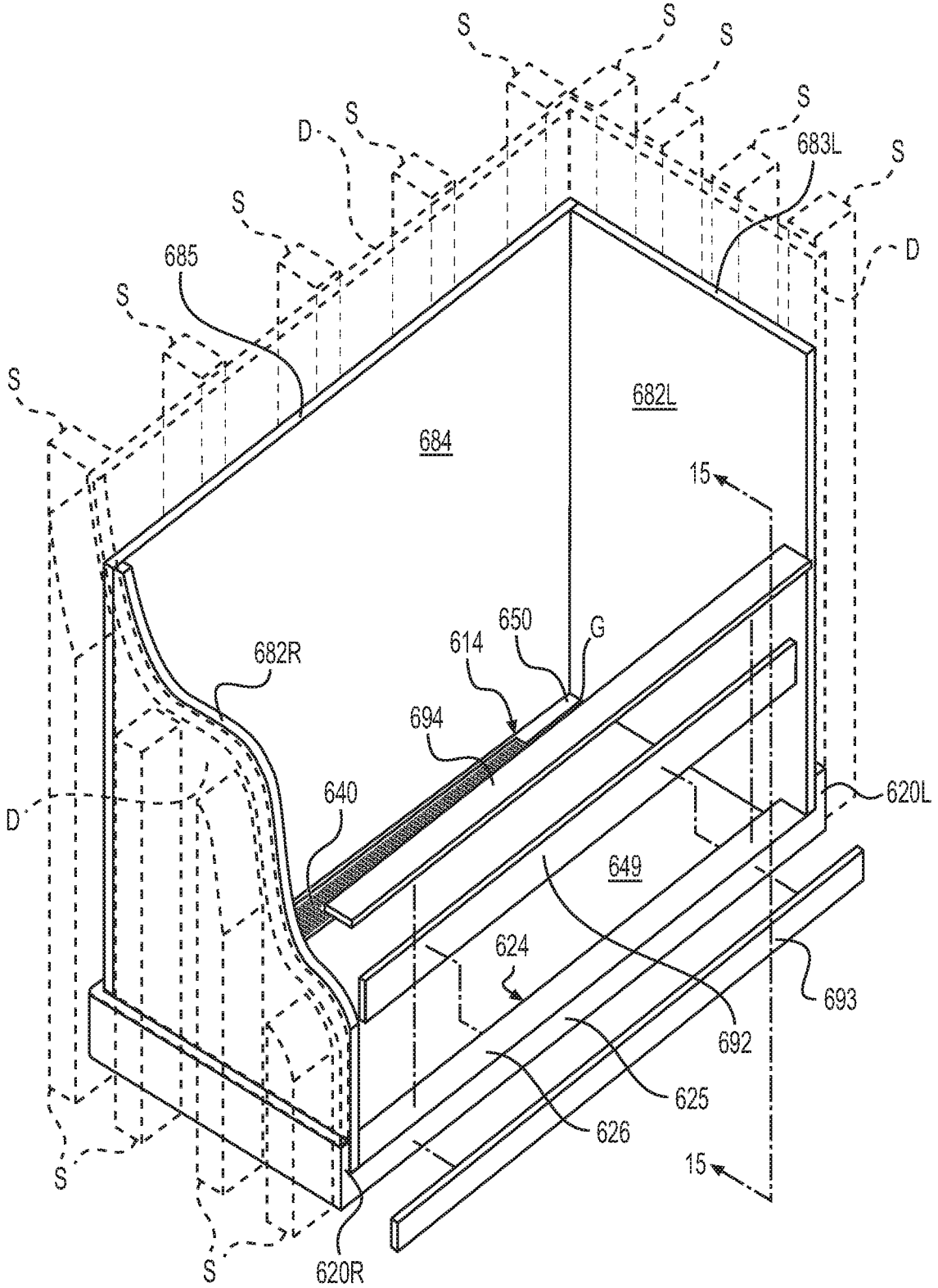

FIG. 16 is a right, front perspective partially exploded view of yet another step in said process.

FIGS. 17 through 20 show the embodiment of FIGS. 13-16 with a modified linear drain configuration.

Figure 17:
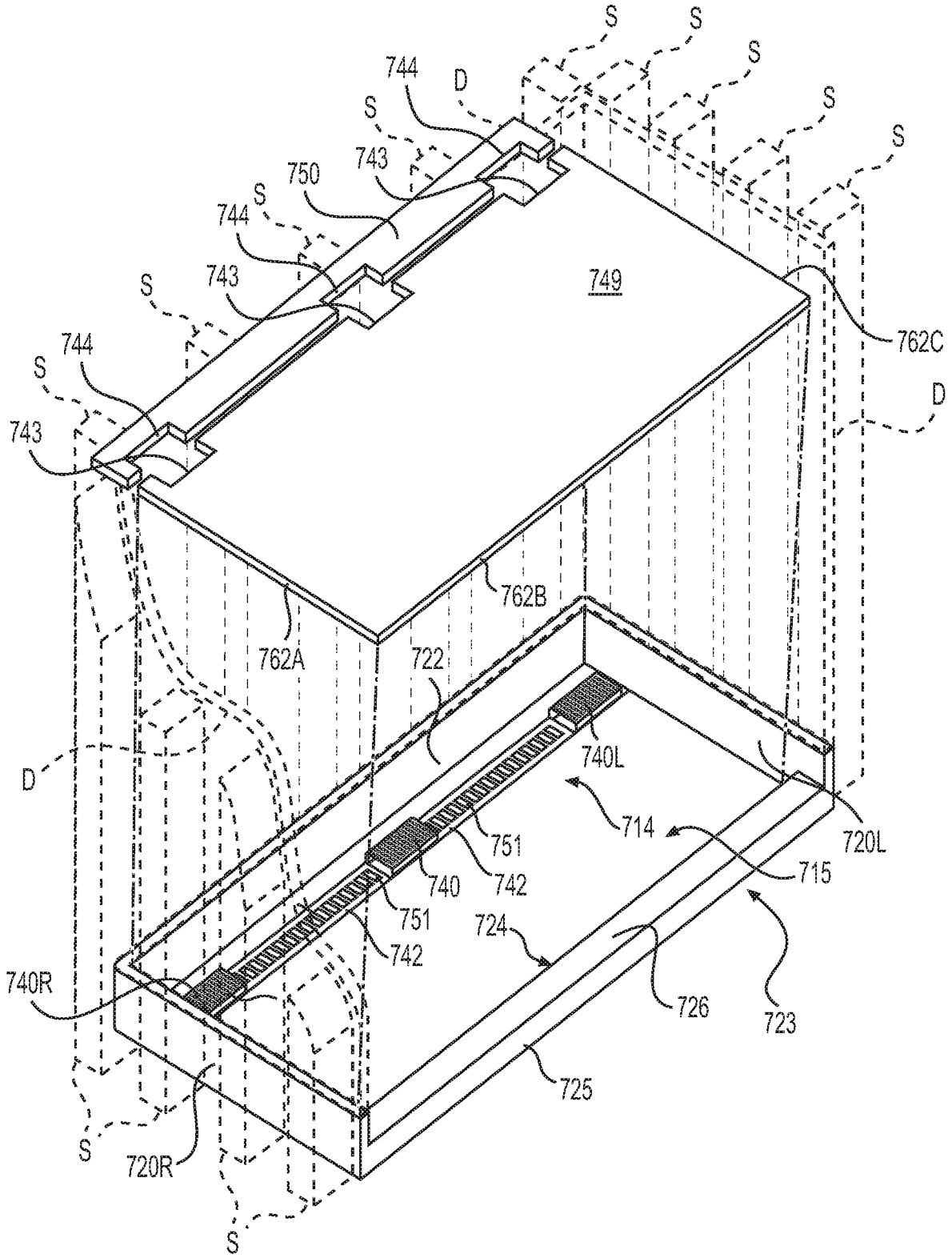

17A is the same view as FIG. 17 but with a slight modification to the location of the linear drain.

FIGS. 21 through 24 show the embodiment of FIGS. 1-4 with a modified linear drain configuration.

Figure 21:
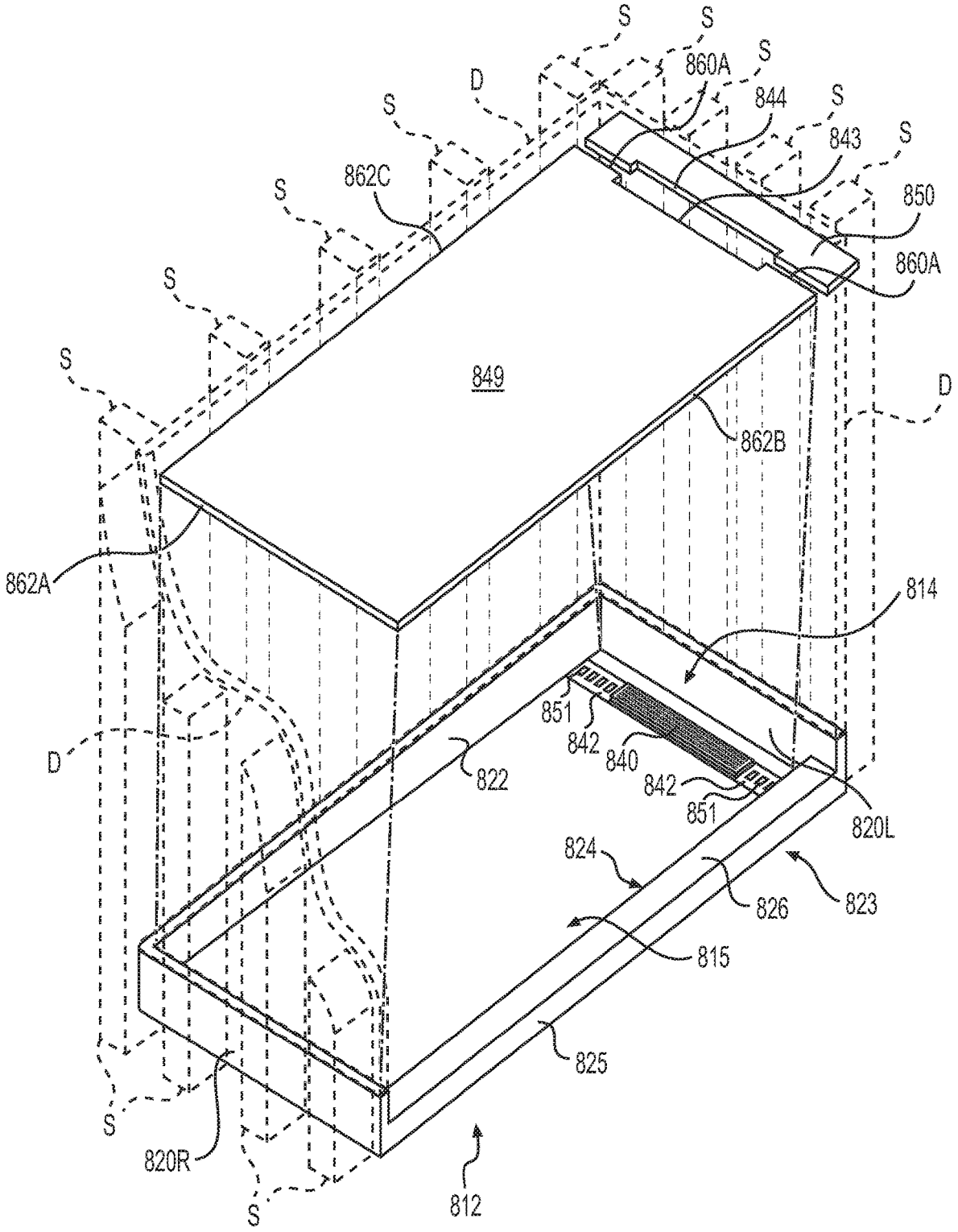

21A is the same view as FIG. 21 but with a slight modification to the location of the linear drain.

Figure 25:
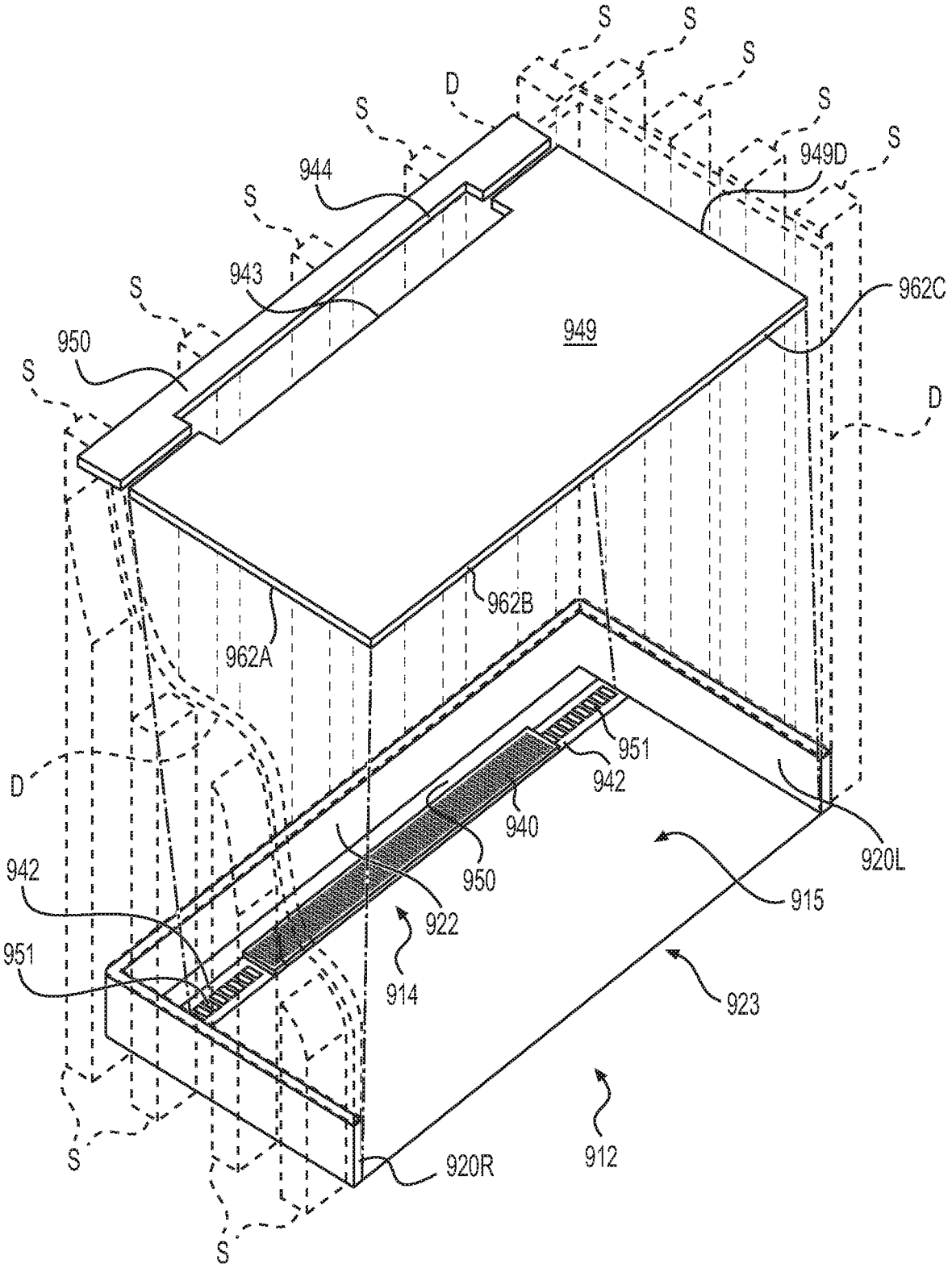
Figure 25A:
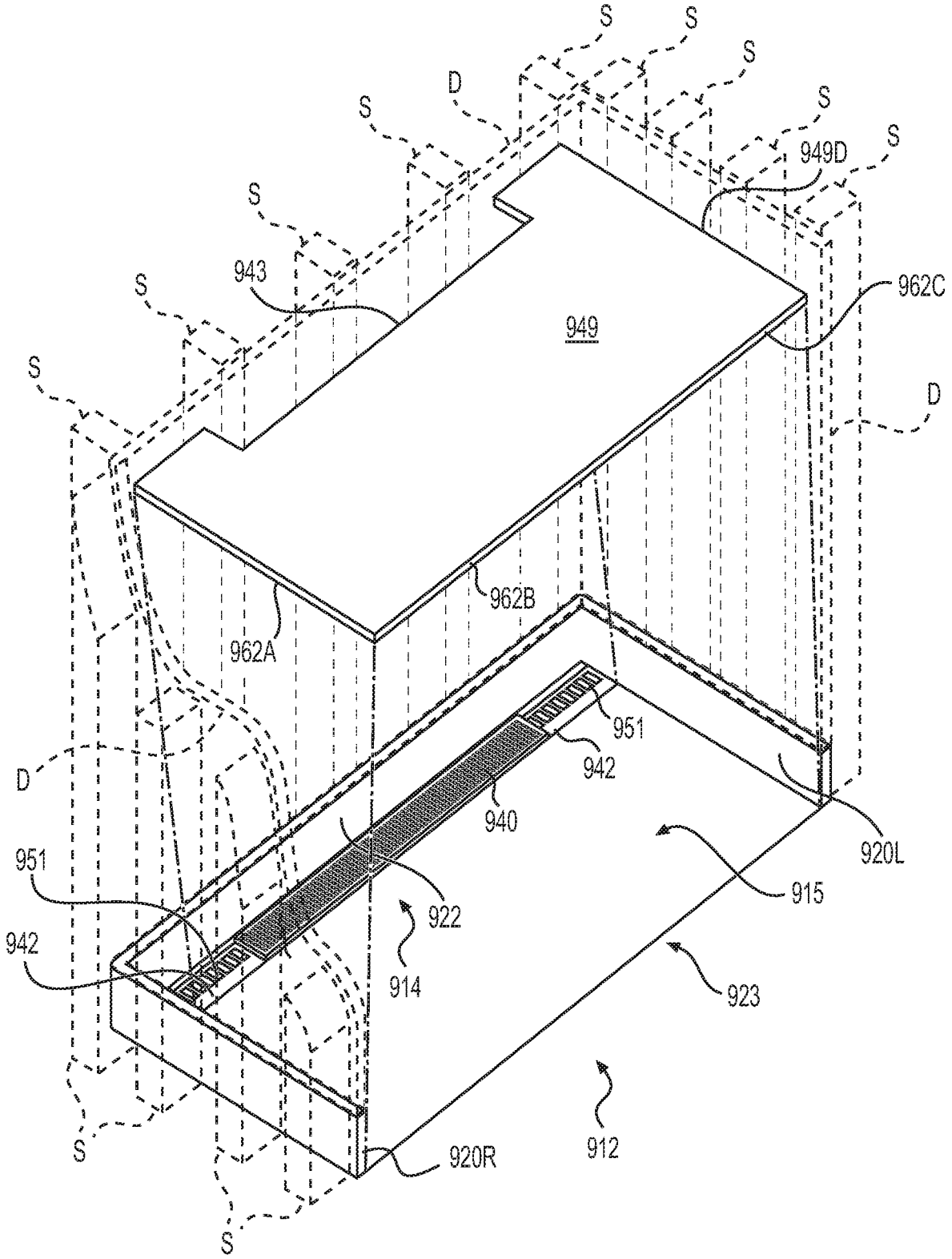

FIG. 25 is a right, front perspective exploded view of a step in a process for creating a barrier-free back or rear drain shower in accordance with the invention.

25A is the same view as FIG. 25 but with a slight modification to the location of the linear drain.

Figure 26:
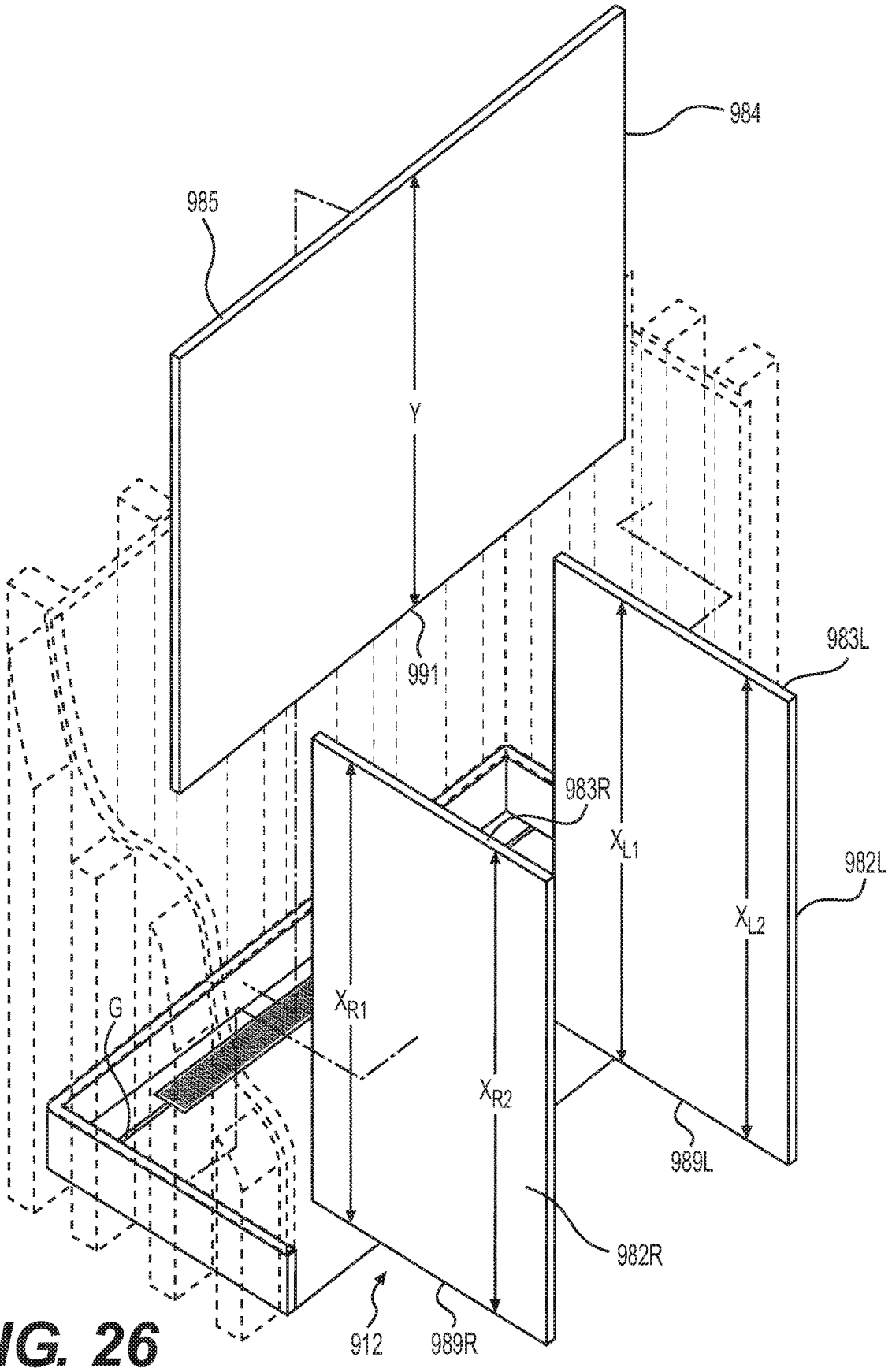

FIG. 26 is a right, front perspective exploded view of another step in said process.

Figure 27:
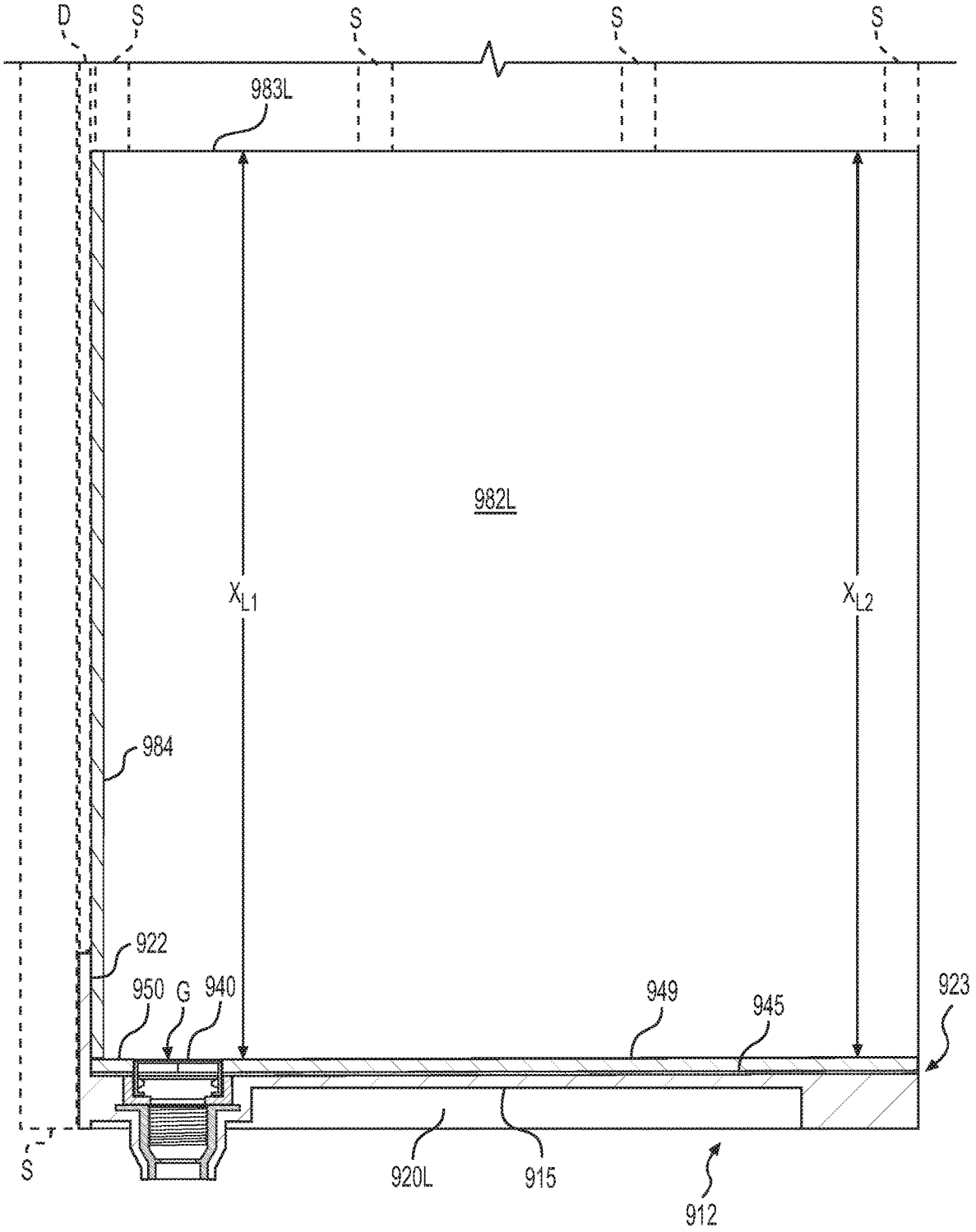

FIG. 27 is an elevational view of a portion of the shower in accordance with said process.

Figure 28:
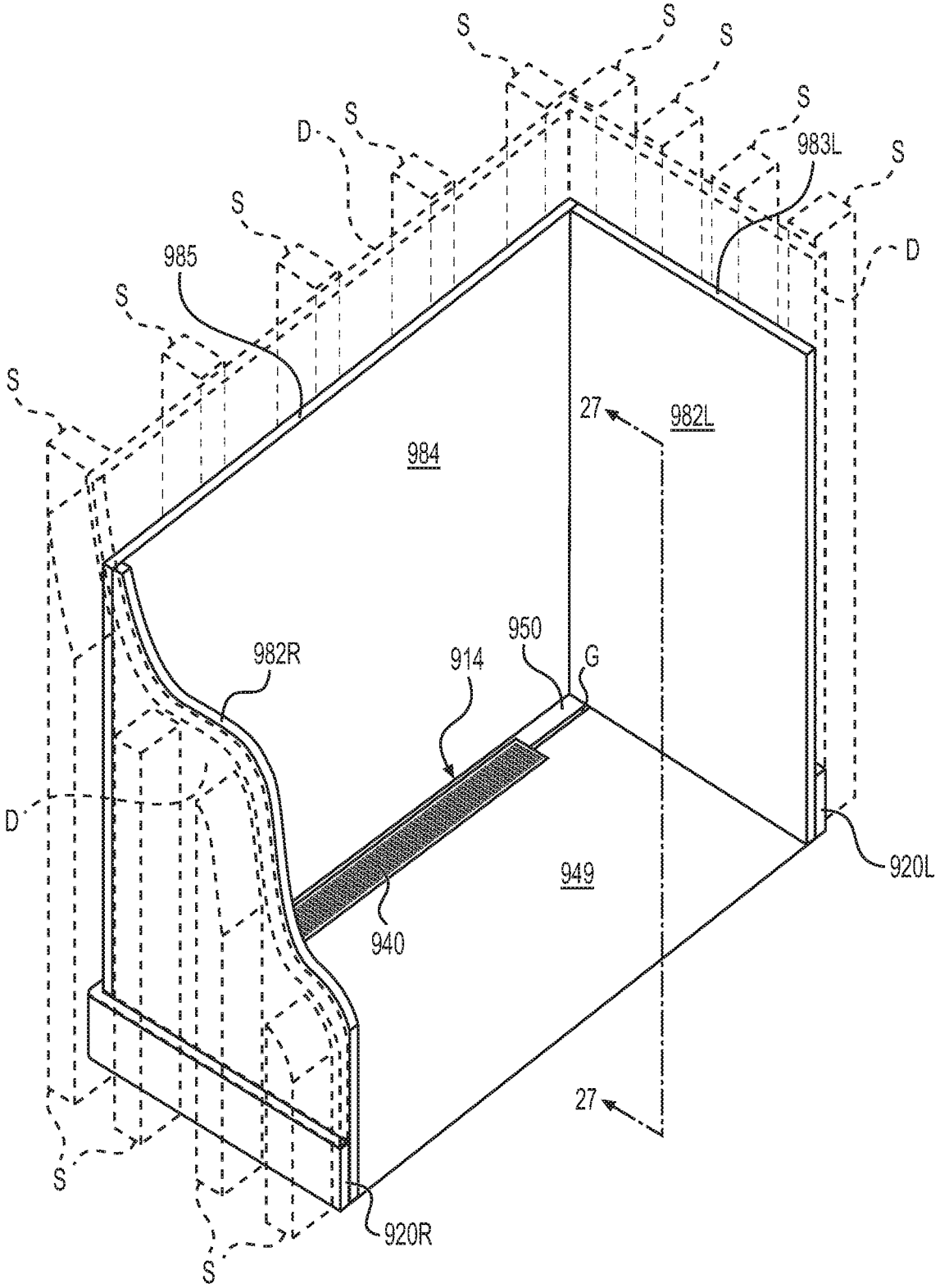

FIG. 28 is a right, front perspective exploded view of yet another step in said process.

Figure 24:
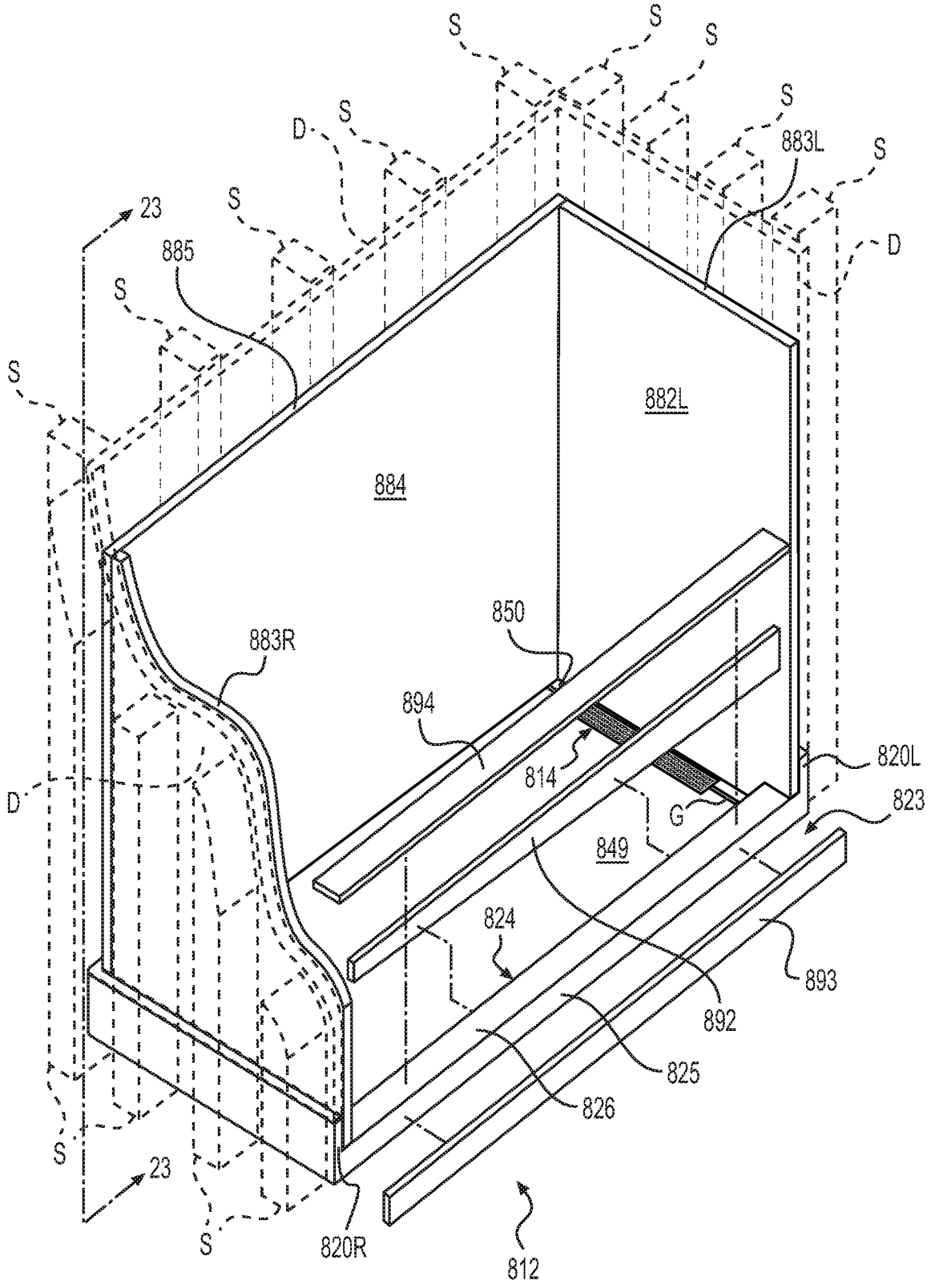
Figure 29:
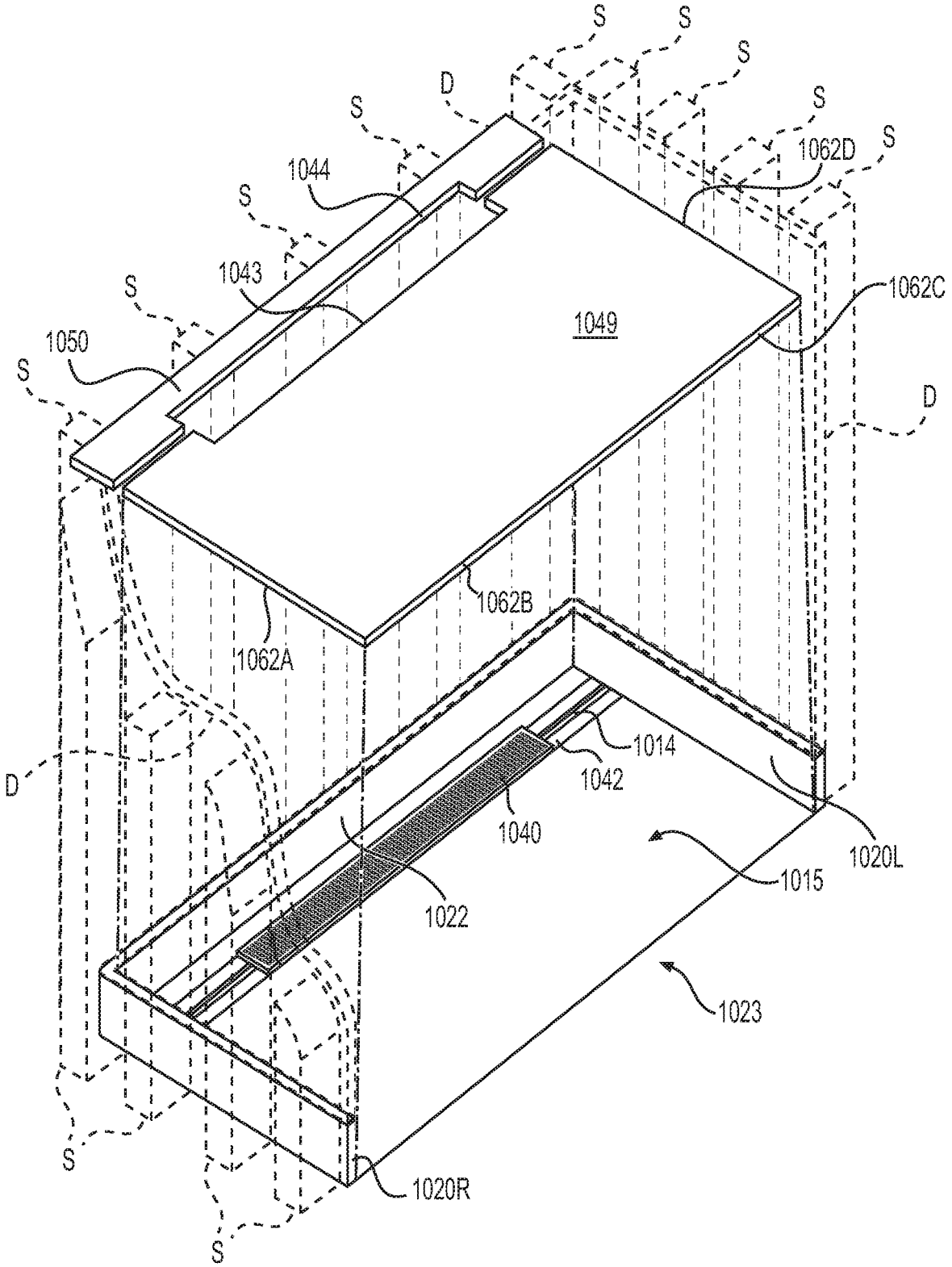

FIG. 29 is a right, front perspective exploded view of the step in a process for creating a barrier-free back or rear drain shower as shown in FIG. 24 but with a modified linear drain arrangement.

29A is the same view as FIG. 29 but with a slight modification to the location of the linear drain.

Figure 30:
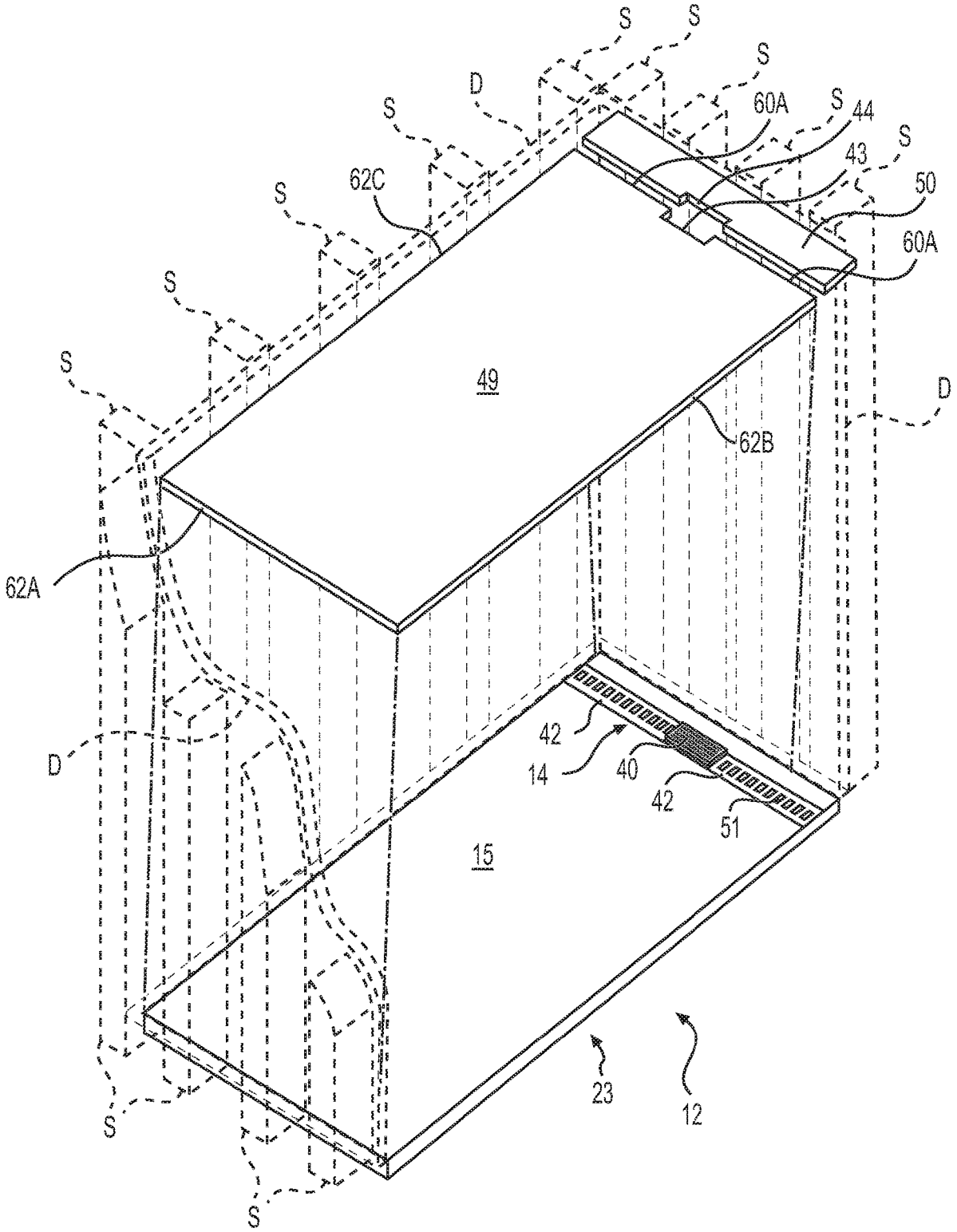

FIG. 30 is a right, front perspective exploded view of a step in a process for creating a left or right drain shower in accordance with the invention.

Figure 31:
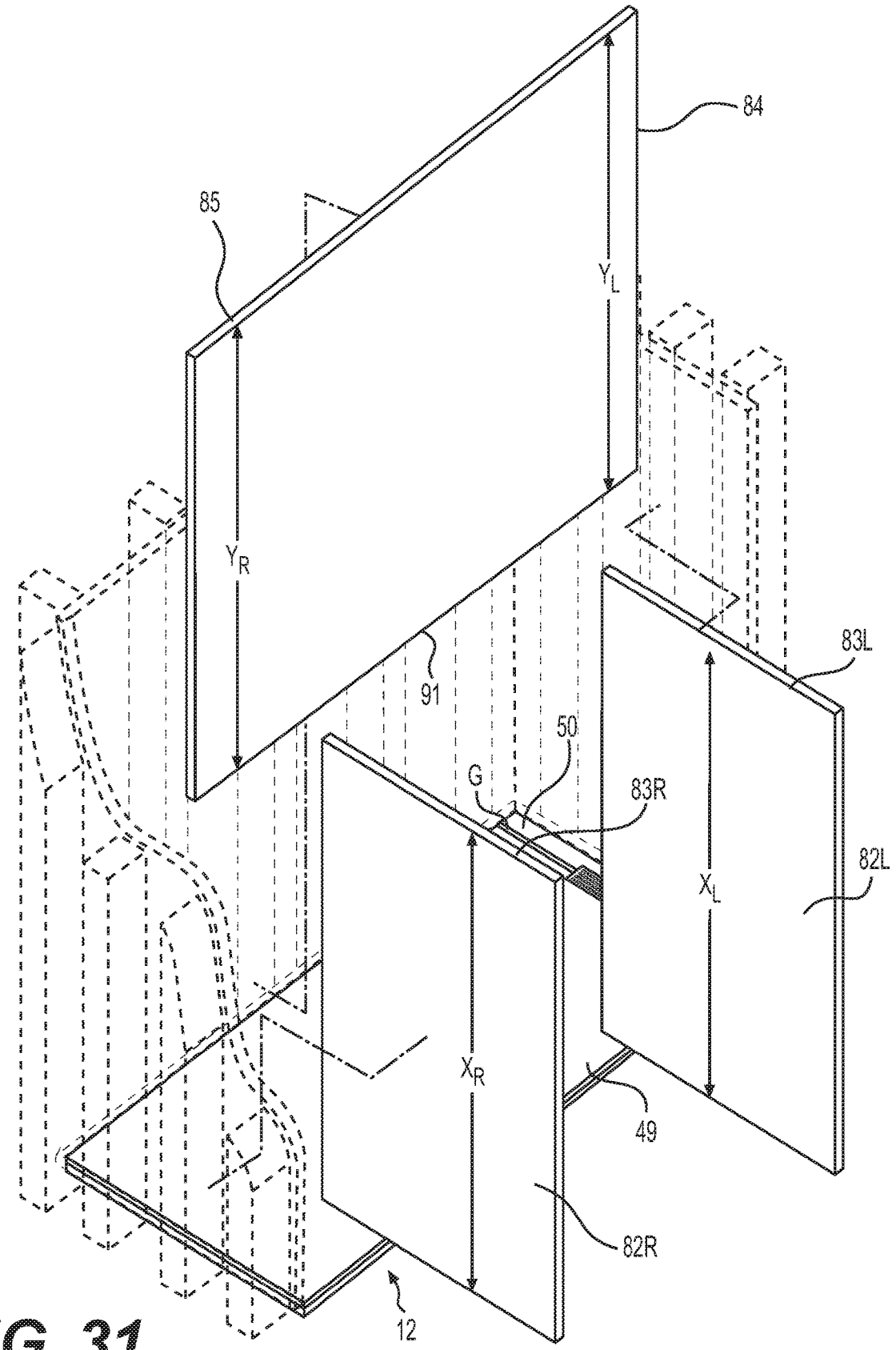

FIG. 31 is a right, front perspective exploded view of another step in said process.

Figure 32:
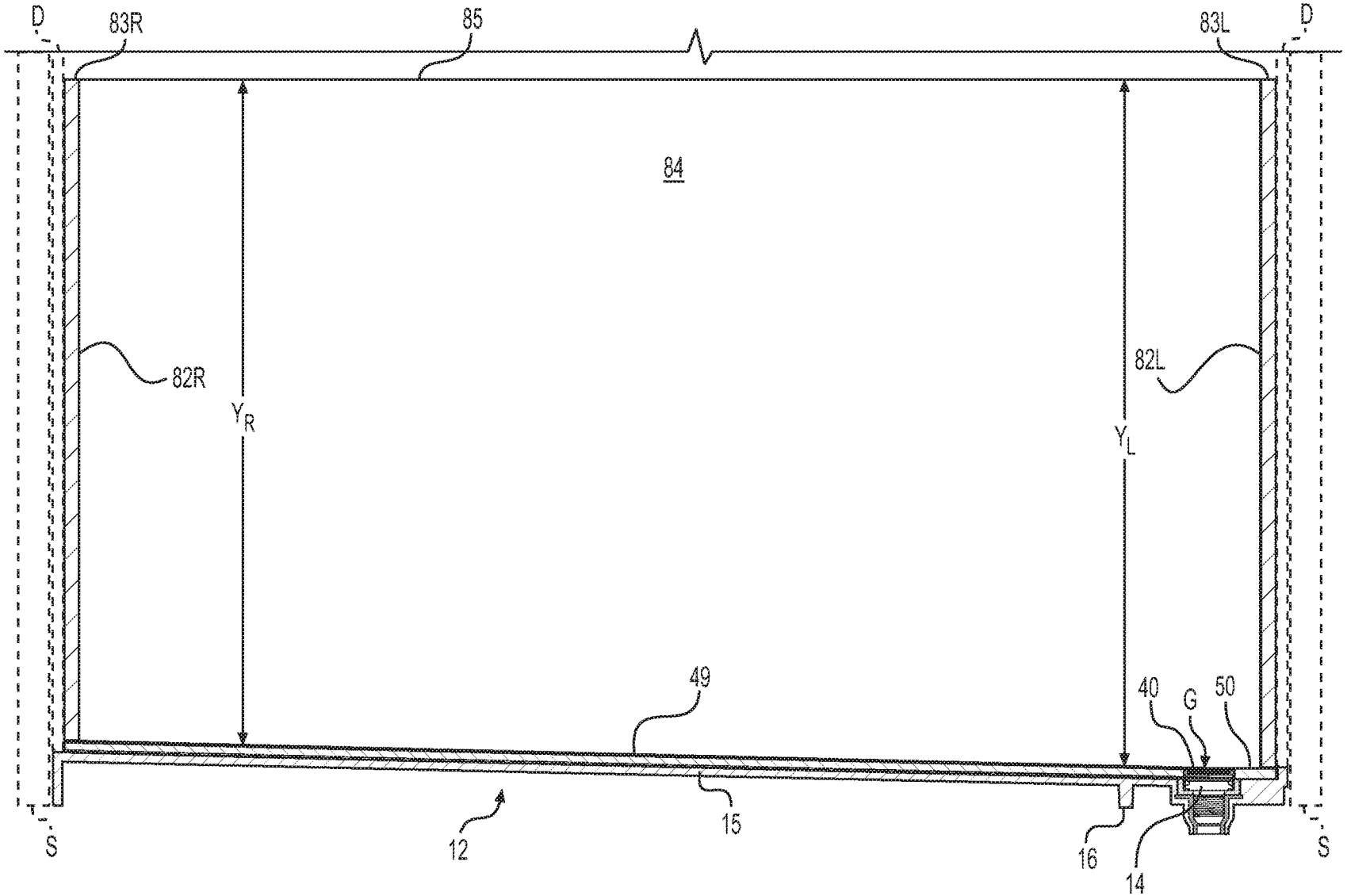

FIG. 32 is an elevational view of a portion of the shower in accordance with said process.

Figure 33:
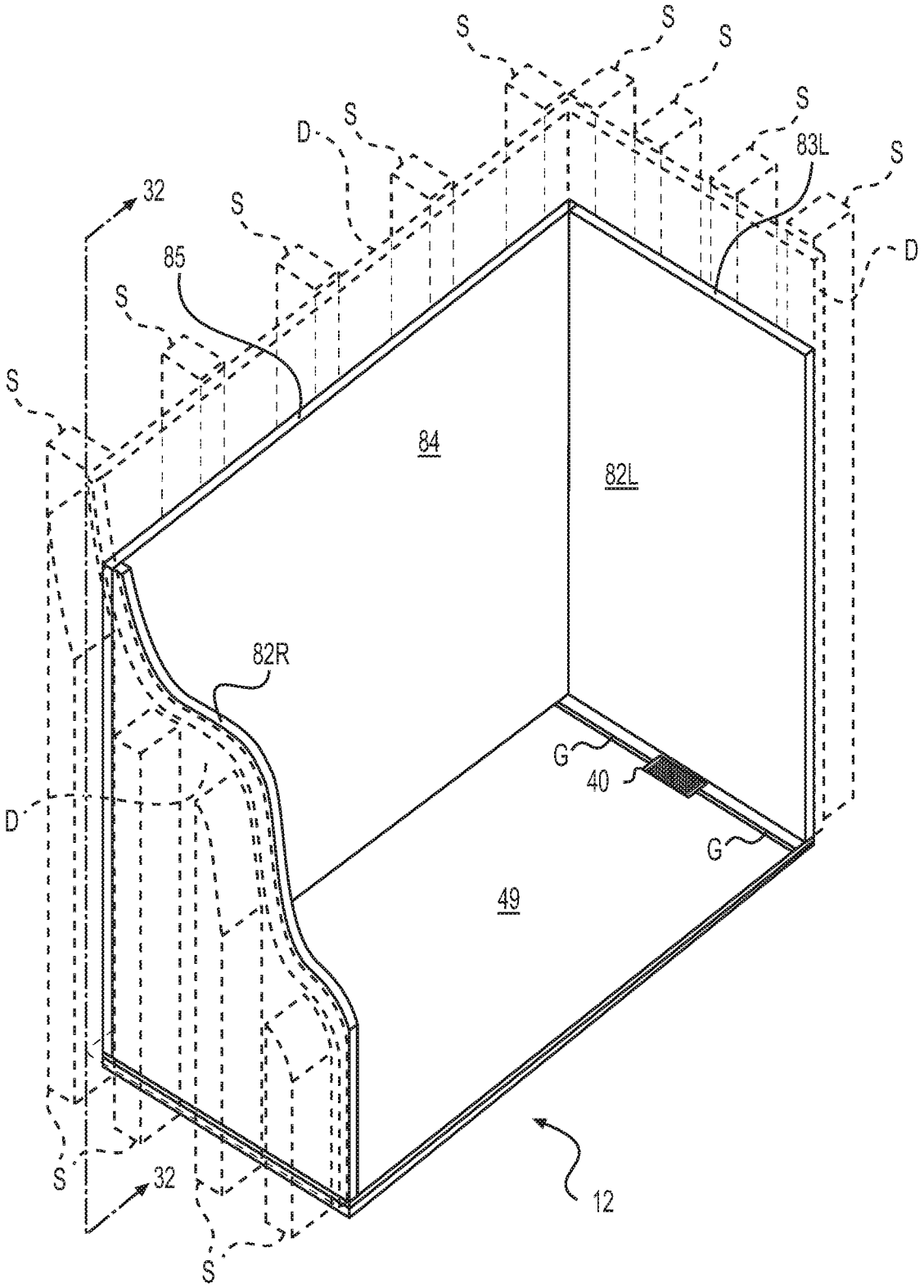

FIG. 33 is a right, front perspective partially exploded view of yet another step in said process.

Figure 34:
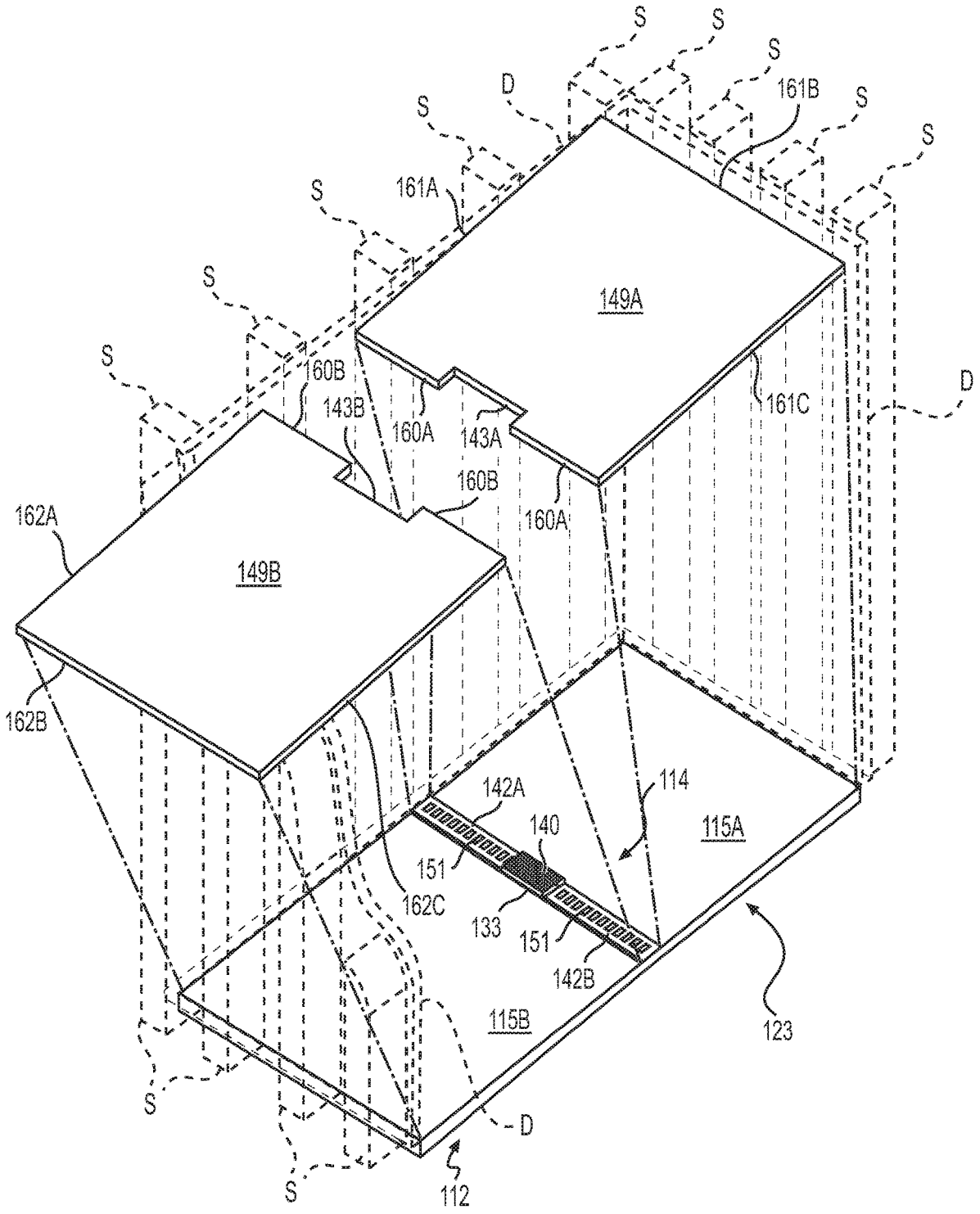

FIG. 34 is a right, front perspective exploded view of a step in a process for creating a center drain shower.

Figure 35:
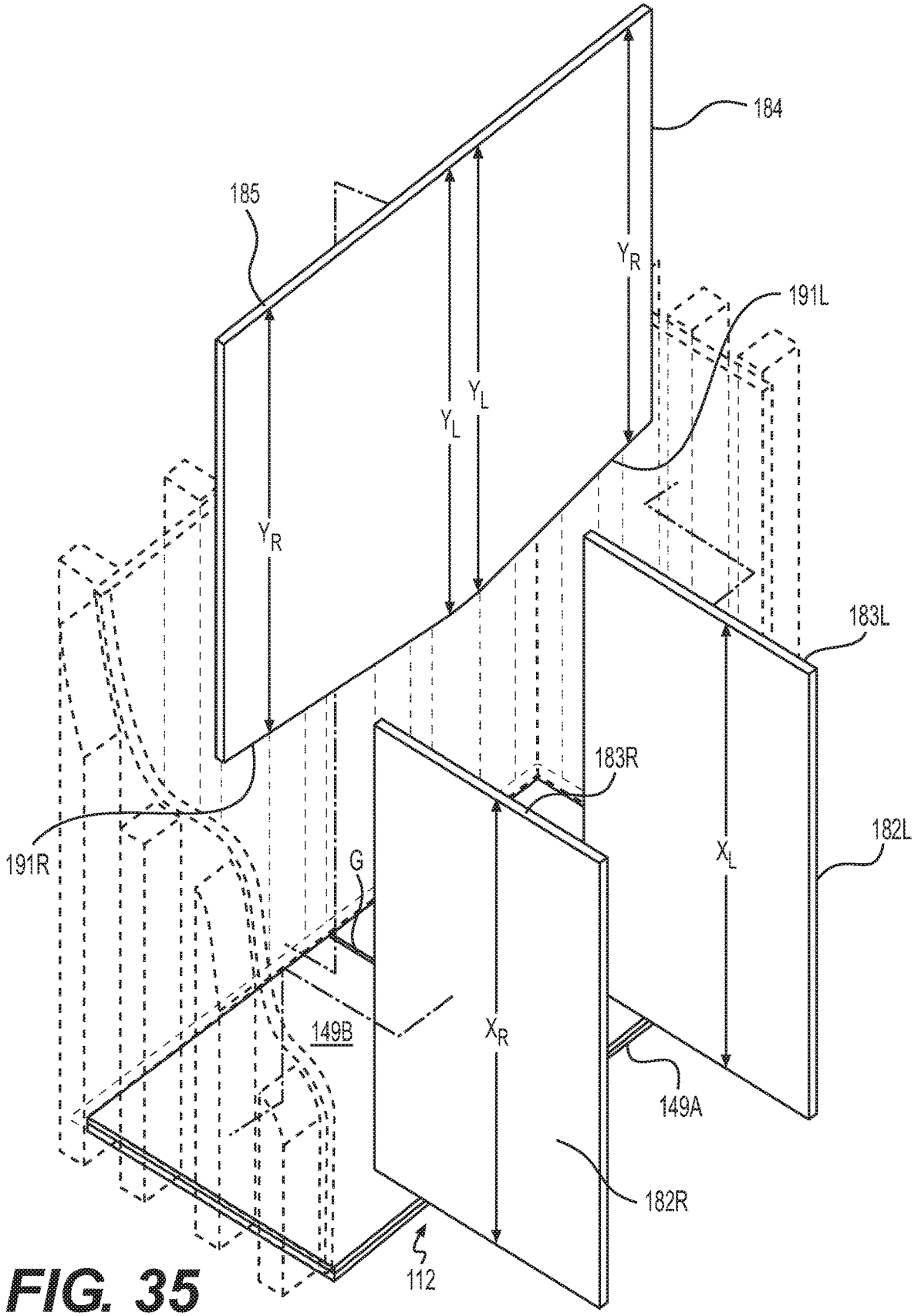

FIG. 35 is a right, front perspective exploded view of another step in said process.

Figure 36:
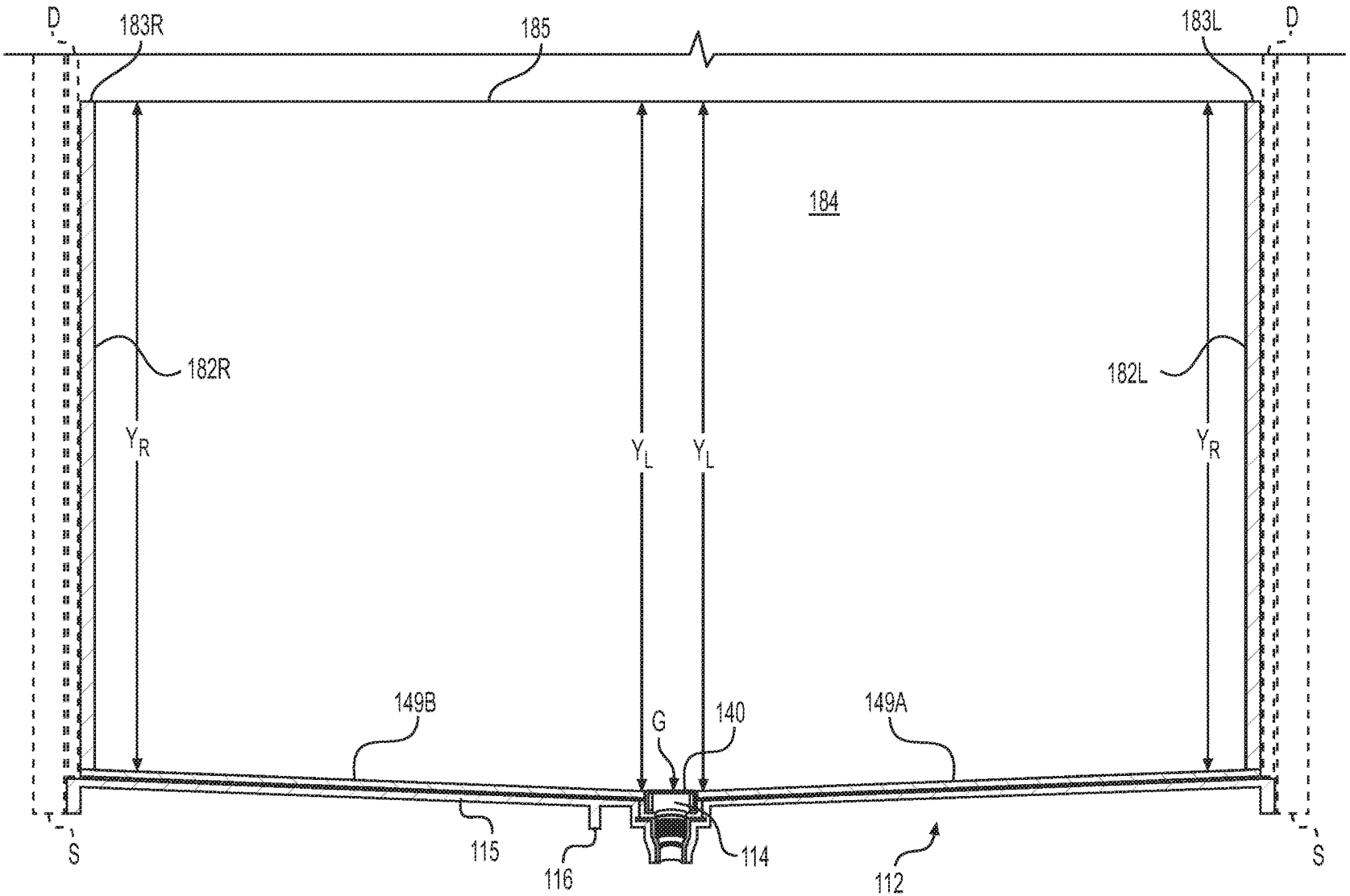

FIG. 36 is an elevational view of a portion of the shower in accordance with said process.

Figure 37:
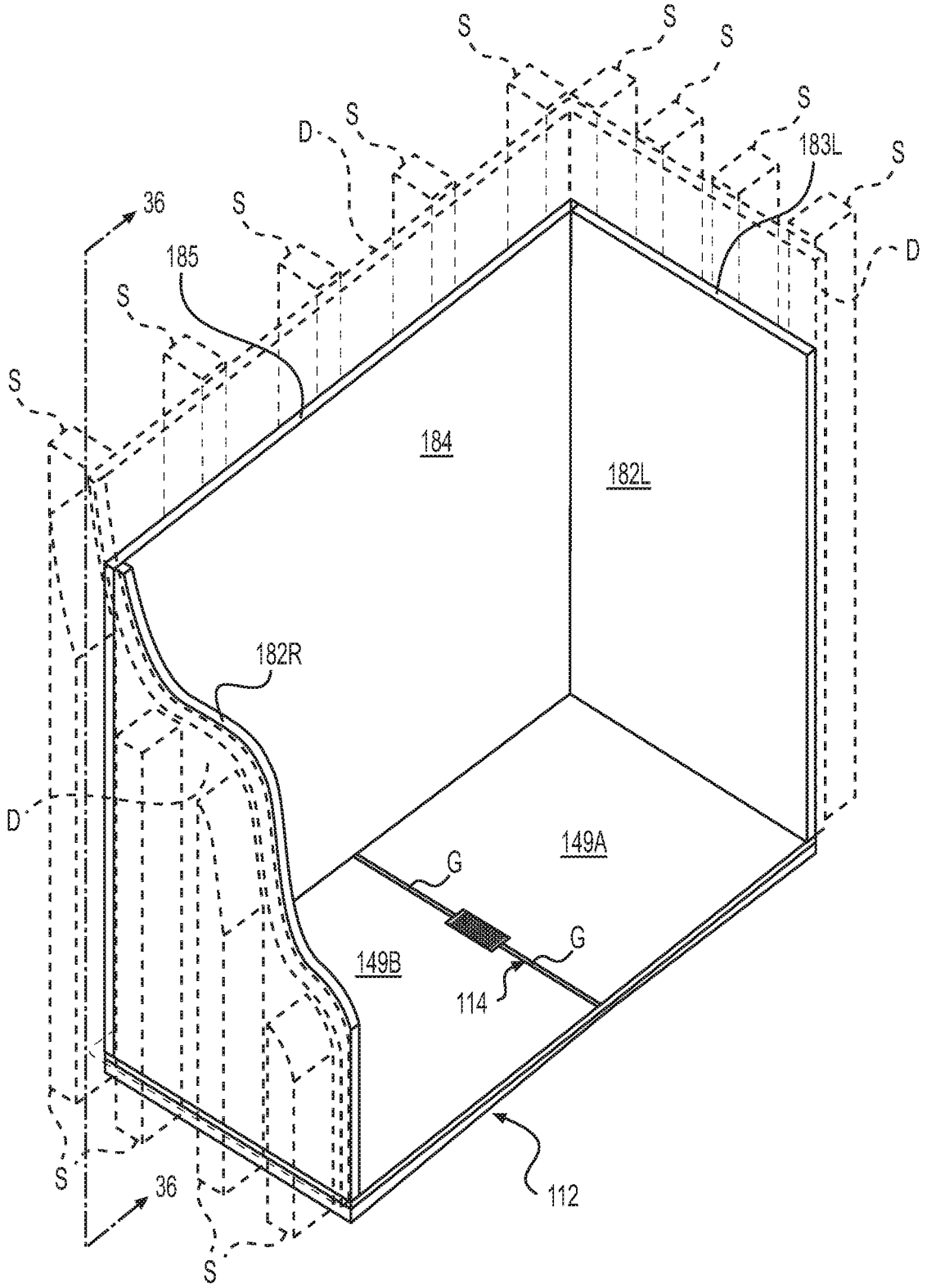

FIG. 37 is a right, front perspective partially exploded view of yet another step in said process.

Figure 38:
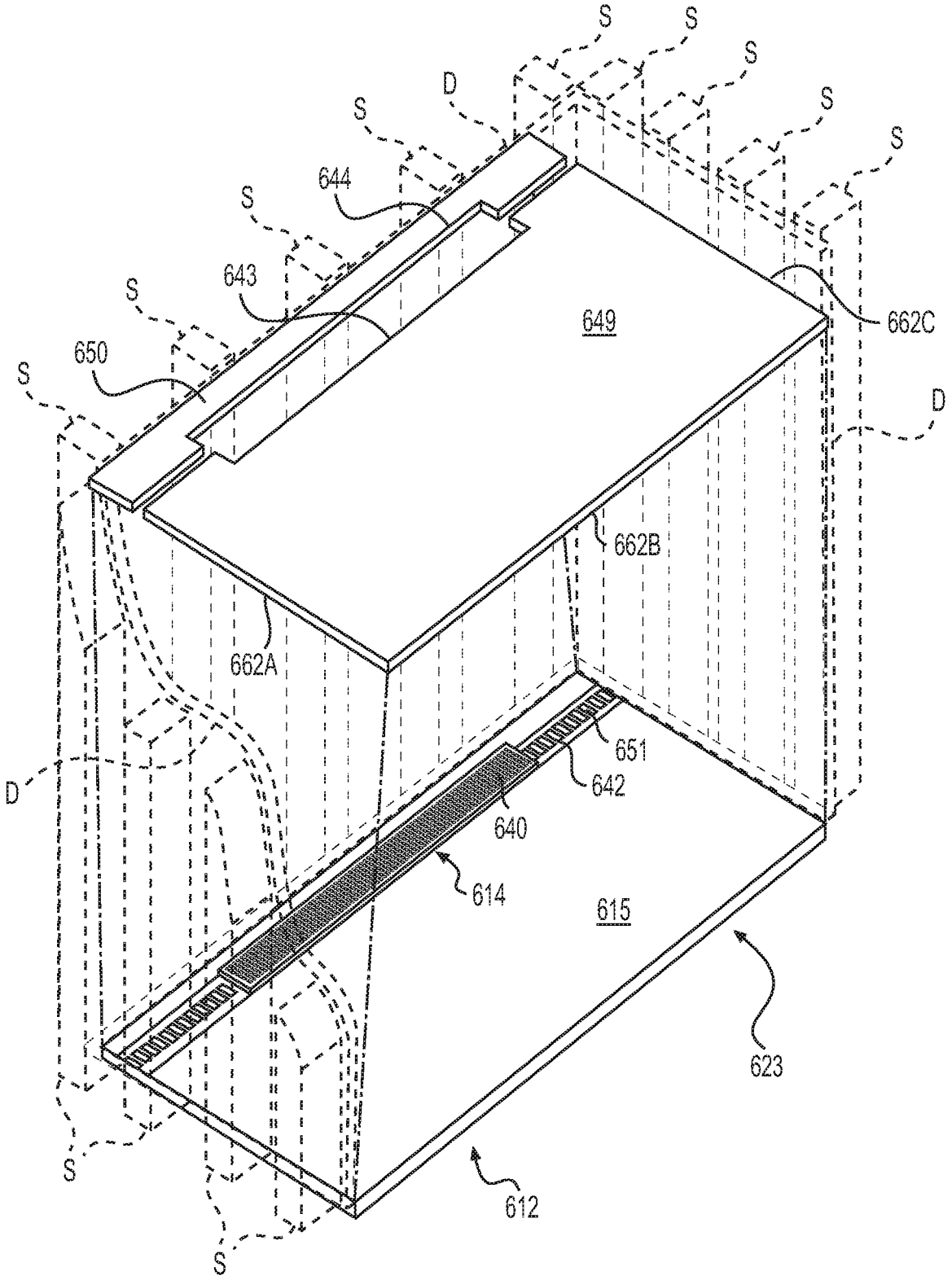

FIG. 38 is a right, front perspective exploded view of a step in a process for creating a back or rear drain shower in accordance with the invention. [back drain embodiment, 42" grate]

Figure 39:
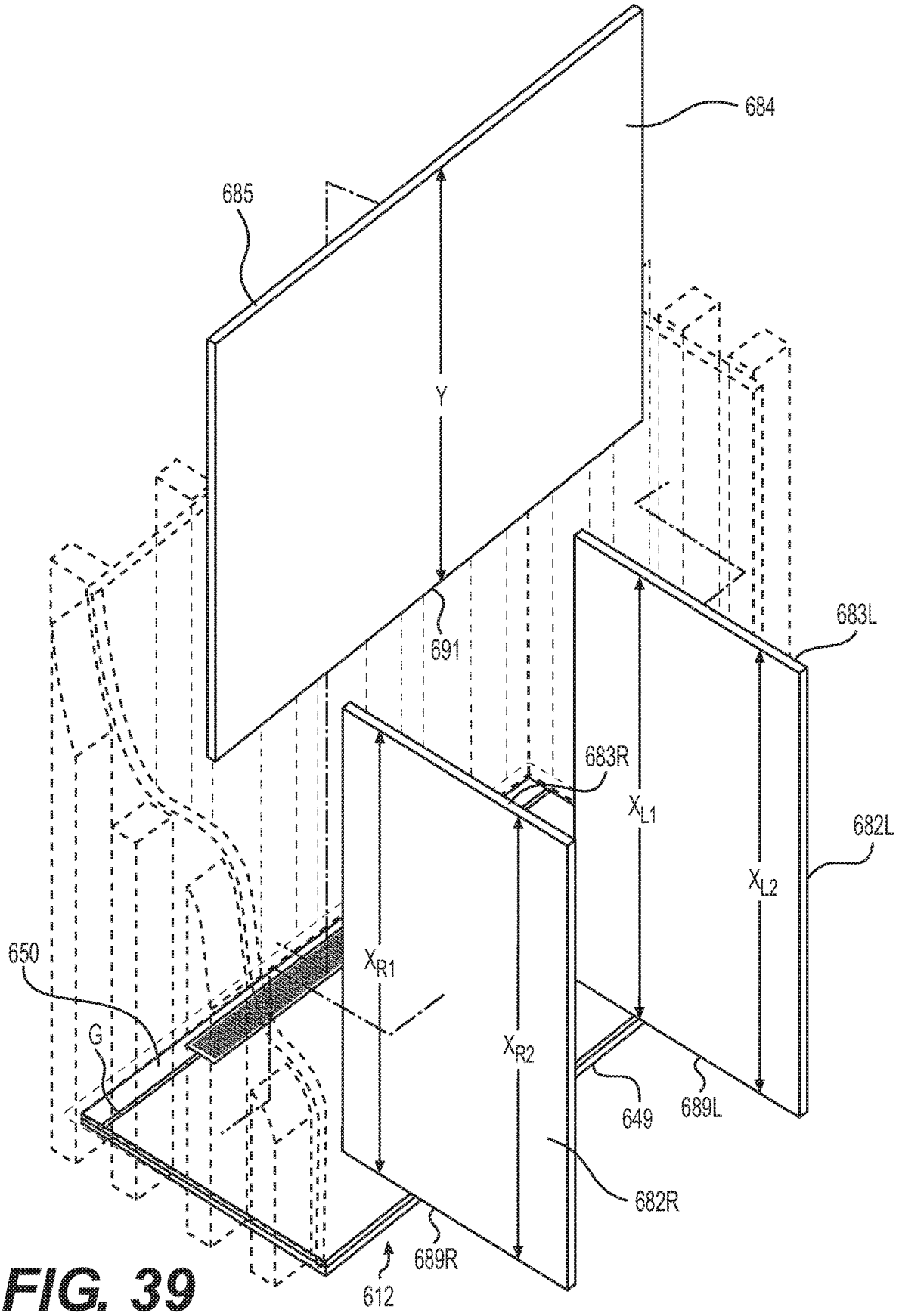

FIG. 39 is a right, front perspective exploded view of another step in said process.

Figure 40:
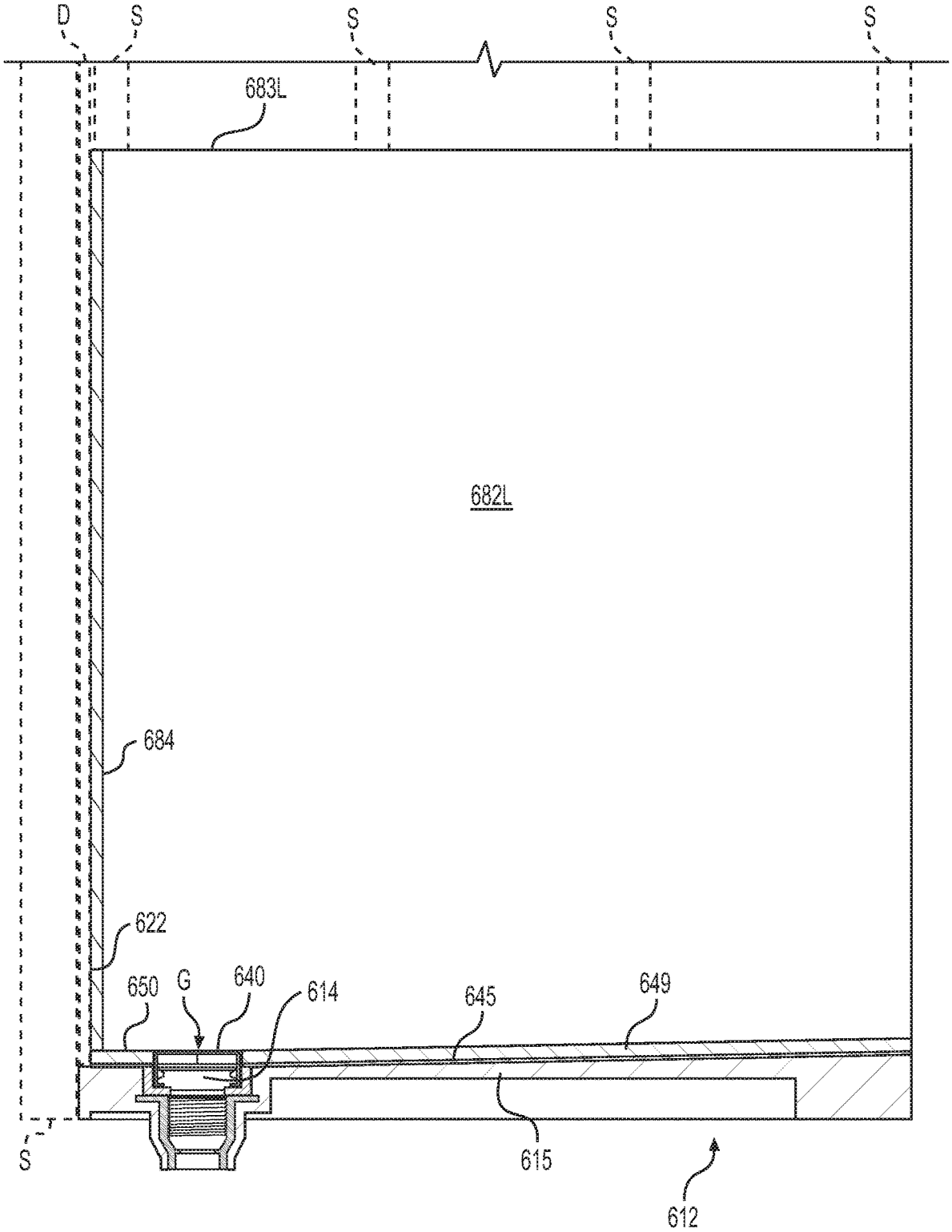

FIG. 40 is an elevational view of a portion of the shower in accordance with said process.

Figure 41:
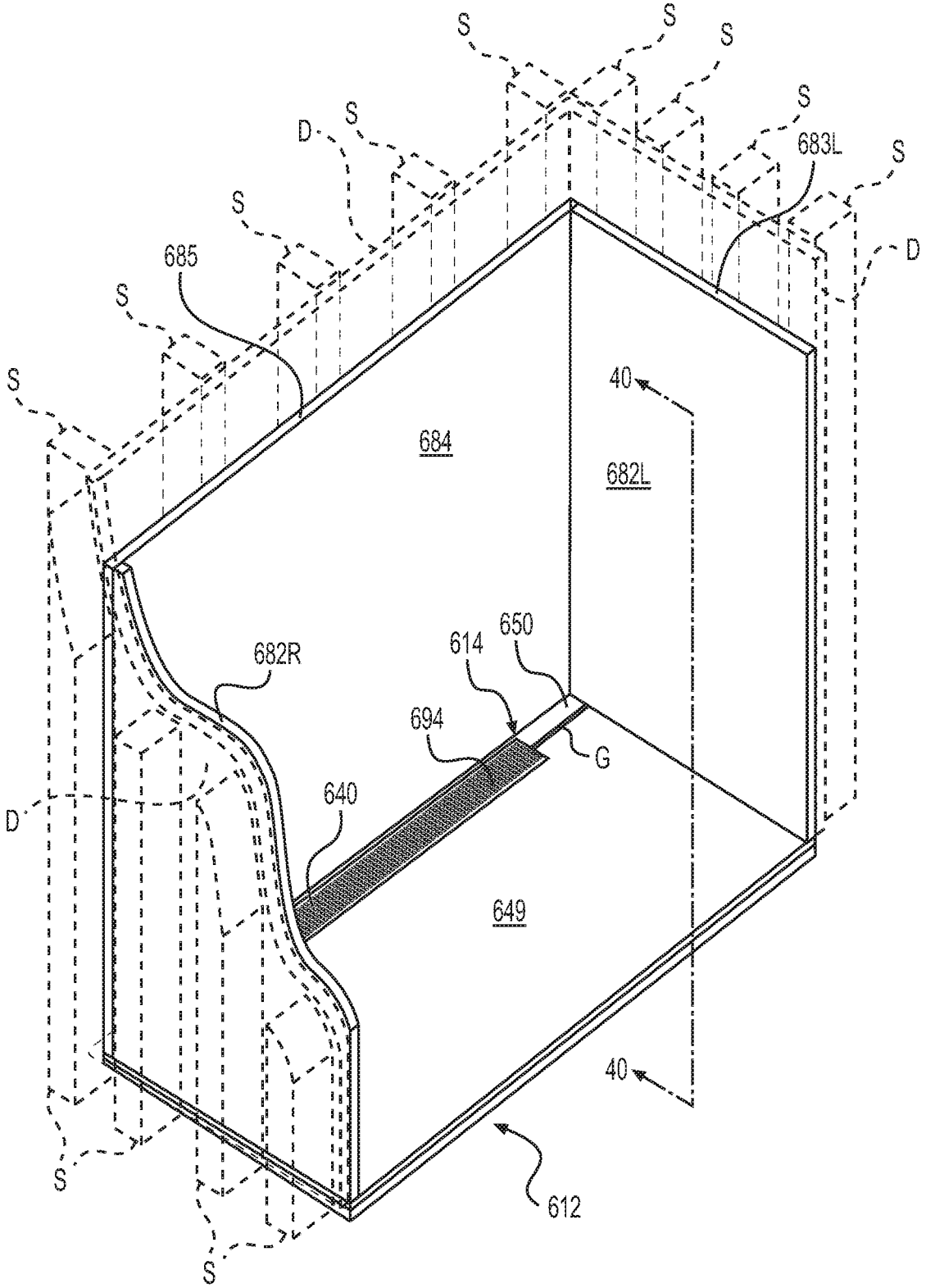

FIG. 41 is a right, front perspective partially exploded view of yet another step in said process.

DETAILED DESCRIPTION OF EXEMPLARY EMBODIMENT(S)

The inventive embodiments of my invention reside primarily in combinations of structural components and manufacturing, installation and use steps related to the creation of a variety of shower floors incorporated into shower pan and drain arrangements.

Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms, such as "first" and "second," "top" and "bottom," and the like, may be used solely to distinguish one entity or element from another entity or element without necessarily requiring or implying any physical or logical relationship or order between such entities or elements.

The terms "comprises," "comprising," "comprise" or any other variation thereof are intended to cover a non-exclusive inclusion, such that a process, method, article, or apparatus that comprises a list of elements need not necessarily include only those elements, but may include other elements not expressly listed or inherent to such process, method, article, or apparatus.

The term "plurality of" as used in connection with any object or action means two or more of such objects or actions.

A claim element proceeded by the article "a" or "an" does not, without more constraints, preclude the existence of additional identical elements in the process, method, article, or apparatus that includes the element.

Terms such as "wall or flooring material," "floor and wall covering," "flooring material" and "covering material" mean one or more of porcelain, ceramic, natural stone or other tile, stone, granite, marble, cultured marble, quartz, solid surface, laminate, composite or any other surface (e.g. stone), or non-slip finished shower surfaces such as vinyl or plastic, stucco, concrete and mortar surfaces, whether or not applied or combined with adhesives or other substances, and any other material or materials used to provide a finished surface.

The term "tiled" means any surface having floor or wall covering materials, such as one or more of porcelain, ceramic, natural stone or other tile, stone, granite, marble, cultured marble, solid surface or any other surface (e.g. stone), or non-slip finished shower surfaces such as vinyl or plastic, stucco, concrete and mortar surfaces, whether or not applied or combined with adhesives or other substances, and any other material or materials used to provide a finished surface.

The term "non tileable" means one or more surfaces or structural components which are not capable of receiving wall or floor material or were not designed, marketed or sold with the intention of being tileable or tiled, and in fact are not tiled.

The term "tileable" or "ready-to-tile" means one or more surfaces or structural components which are capable of receiving wall or flooring material, whether through the use of adhesives or any other means of attachment, such as clips, straps or other mechanical fastening structure(s).

The term "prefabricated shower pan" means any manufactured or fabricated one piece shower pan (A) to which floor or wall coverings may be adhered, (B) which at the time of manufacture has either (i) a trench integrally associated therein or (ii) a molded or prefabricated trench integrally formed with one or more standard drain bodies, both of which are integrally associated into the shower pan at the time of manufacture or fabrication of such shower pan, or (iii) a drain integrated into the floor of the shower pan but such drain is not part of a trench drain nor is it located within a trench, or (iv) a trench drain molded or integrated into the shower floor in the factory as a one piece shower pan floor, and (C) which may also have integrated therein at the time of manufacture or fabrication a floor (which may be pitched), one or more splash walls, one or more curbs, and/or one or more barriered or barrier-free entrances.

The term "partially prefabricated shower pan" means any manufactured or fabricated shower pan assembly or kit to which floor or wall coverings are to be adhered which is not a one piece shower pan, but has two or more pieces which are assembled at any time after manufacture and prefabrication, usually in the field at or around the time of assembly and installation of the shower pan, which when assembled and installed in the field comprises a one piece or multi-piece shower floor and which (A) does not have either (i) a molded or prefabricated trench together with a standard drain integrally formed into such shower pan at the time of manufacture or (ii) a trench drain integrally formed into such shower pan at the time of manufacture, or (iii) a standard drain integrally formed into such shower pan, but which may have (B) one or more manufactured or fabricated integrated components, or component elements which make up, features such as a floor, a splash wall, a curb and/or a barriered or barrier-free entrance, and (C) as individual components one or more of a trench drain body, a standard drain body, a trench body, an integrally formed trench body and a standard drain, a trench body integrally formed with all or a portion of a shower pan floor, and a trench body and a standard drain integrally formed with all or a portion of a shower pan floor, and a standard drain integrated into (e.g. integrally formed with) all or a portion of a shower pan floor where there is no trench.

The term "mud base" means a floor structure created in the field by building a sloped surface from mortar or other well-known material for creating mud-based shower installations.

The term "hot mopped shower pan" means a mud base shower floor onto which is applied a molten, hardenable, liner material, such as asphalt and/or hot tar mixtures, and, in certain applications, one or more felt or other sealing layers, which collectively seal the floor from water leakage.

The term "linear drains" means elongated depressions, trenches associated with a standard drain, trench drains and trenches, whether right and/or left drain/trenches, back drains/trenches, front drains/trenches, and center drains/trenches, including trenches located anywhere in or on a drainable surface such as a shower floor.

Terms such as "tiled and/or tileable surface or fixture" and "surface or fixture" mean any fully or partially tiled and/or tileable bathtub, bathroom floor, shower floor, sink, fountain, fixture, floor, or other surface.

The term "non tileable and/or untiled surface" means a surface such as a floor, wall, shower floor, bath floor, sink, shower pan, or any other surface which has a drain integrated or associated with it, and such surface is either not tileable, or is not designed to be tiled or tileable, and/or such surface is in fact not tiled.

The term "shower pan" means a waterproof shower base or pan which can be used as an underlayment for a bathtub or shower, which can be, for example but not by way of limitation, any one of: (i) an assembly which is prefabricated through one or more manufacturing steps or processes; (ii) is assembled using one or more prefabricated component parts in the field; (iii) an assembly which is otherwise assembled in the field; (iv) which is built up or otherwise formed from a malleable, settable material (such as the well-known mortar); or (v) a prefabricated shower pan; (vi) a partially prefabricated shower pan; (vii) a mud based shower pan; and (viii) a hot mopped shower pan.

The term "standard drain" means any kind of drain made of any kind of material, including but not limited to metal or plastics, and with any kind of connection to a drain system such as a waste water system, including but not limited to a solvent weld drain, a welded connection drain, a hub (outside caulk) drain, a spigot drain, a hubless spigot drain, a hubless drain, an inside caulk (gasket) drain, a hubbed (push on) drain, a compression drain, and a clamping ring drain, but does not include a linear drain drain.

The term "drain area" means an area in which a drain is either to be formed or installed, or is actually formed or installed, in a shower pan.

The term "drain floor" means an area in which a drain recess is created and in which a drain fixture is installed or to be installed, formed or to be formed, or otherwise created, regardless of when it is installed, formed or otherwise created.

The term "trench drain" means existing integrally formed trench drains (also known as "linear drains") such as those which meet the requirements of the various plumbing codes pertaining to a trench drain.

The term "trench body" or "trench" means molded trench bodies or preformed or prefabricated trench bodies and other voids into which liquids may otherwise drain, such as depressions in a shower, bath, sink, basin or bathroom floor, whether preformed or formed during the assembly of the shower pan, bath tub, sink, basin or floor which may or may not be leak proof at the time the trench body is preformed, prefabricated, or molded, or subsequently made water proof sometime after manufacture such as in the field at or about the time of installation of the shower pan, and which is made from any appropriate material including but not limited to metal, such as cast iron, copper, steel, aluminum, plastics such as PVC or ABS, polyurethane, polyethylene, polymer resins, or the like.

The terms "trench cover" and "trench grate" mean any device or apparatus that can be used to cover a linear drain and be removable to allow access to the trench.

The term "substrate grate" means any device or apparatus that can be used to cover a linear drain that is intended to remain in place once flooring material is installed over all or a portion of the substrate grate.

The term "pre-manufactured" means any component of a shower pan that is manufactured prior to incorporation of that component into another product.

The term "molded" means any component that is formed with a finished product at the time that the finished product is molded.

The terms "pitch" or "slope" mean the change in elevation per unit of length of floor. A typical shower floor pitch is ¼" per foot, although any pitch is deemed to be within the scope of the inventions disclosed herein.

The term "non-removable" means installed with the intention that it not be removed during the useful life of the article.

The term "planar pitch shower pan" means a shower pan in which a substantial portion, in some cases the entirety thereof but in other cases merely a large portion, of the surface area thereof resides in substantially a single plane.

The term "floor covering panels" means decorative or other finishing members adapted to be placed upon and/or attached to a shower pan floor.

The term "wall covering panels" means decorative or other finishing members adapted to be placed upon and/or attached to the walls of a shower enclosure.

The inventions disclosed herein may be employed in, by example but not by way of limitation, washrooms, bathrooms, workshops, industrial facilities, and any other application where liquid is to be drained.

Certain of the drawing figures depict a space in which a shower structure is intended to be constructed, which utilizes well known-environmental features such as a subfloor, wall studs S and drywall/sheetrock D to which can be attached a shower pan and floor and wall covering materials.

FIGS. 1-4 depict certain steps in a process for creating a finished left or right-drain shower, and components thereof. This embodiment includes a shower pan 12 with an integrally molded linear drain 14. The pan 12 is comprised of a pitched floor 15 (which is preferably planar leading up to the linear drain 14) defining a bottom surface thereof, whether with or without support ribs 16, and may include such additional features as one or more curbs 23, one or more side splash walls 20, and one or more rear splash walls 22. Accessory features of shower pans are well known (such as neo-angled curbs and/or splashwalls), and it is contemplated that such features may or may not be used in connection with the embodiments disclosed herein. In addition, other known accessory features (such as barrier-free entrances) may be employed without departing from the spirit and scope of the invention. Although the linear drains disclosed in the various embodiments shown and described herein are sometimes shown as extending over the entirety of the length or width of the pan floor, it is to be understood that the principles of my invention can be carried out using any size, proportion or shape of drain and still fall within the spirit and scope of the invention.

The drains of the invention described throughout this specification can be located in any suitable location on the pan floor without departing from the spirit and scope of the invention. In embodiments, it may be desirable to space the linear drain 14 a small distance from an immediately adjacent peripheral edge of pan floor 15. By "immediately adjacent peripheral edge" means the peripheral edge closest to the linear drain. In such cases, a second, smaller, floor covering panel 50 may be used to cover the small section of floor which extends between the immediately adjacent peripheral edge of the shower pan floor 15 (such as splashwall 20L or stall side or rear wall D) and the linear drain. Floor covering panel 50 may define a cutout 44 adapted to receive all or a portion of the removable drain cover 40. Opposed edges of the large and small floor covering panels form a drainage gap "G" through which water may drain into linear drain 14.

As can be seen from FIGS. 1-4, floor 15, which in the embodiment shown has a linear drain on the left side thereof (making it a so-called "left drain" pan, which is essentially a mirror image of so-called "right drain" pan), may reside substantially in one plane and be pitched or sloped toward linear drain 14. A standard slope is ¼ inch per foot, although any pitch which will accomplish the task of causing liquid to drain from floor 15 (or, in embodiments, whatever covering material is situated thereon, such as floor tile panel 49) into linear drain 14 is deemed to be within the scope of the invention. Using a single-plane floor eliminates the multi-pitched floors which have traditionally been used, which necessitate many cuts in floor tiles, and attendant labor time and expense.

The floor covering panel 49 defines a cutout 43 to accommodate a removable drain grate such as grate 40, such that, when the floor covering panel 49 is associated with the shower pan floor 15, the cutout 43 provides an area in which the removable drain grate 40 may be removably received. Preferably, the removable drain grate is located substantially adjacent the wastewater pipe in the sub-floor (not shown) to facilitate cleaning the drain or otherwise gaining access to the linear drain 14 and wastewater pipe. Floor panel 49 may be made of any shower floor covering material including ceramic or porcelain tile, stone, marble, polymer-based material, acrylic, solid surface, metal, or any suitable floor covering material from which liquid is to drain.

Figure 11:
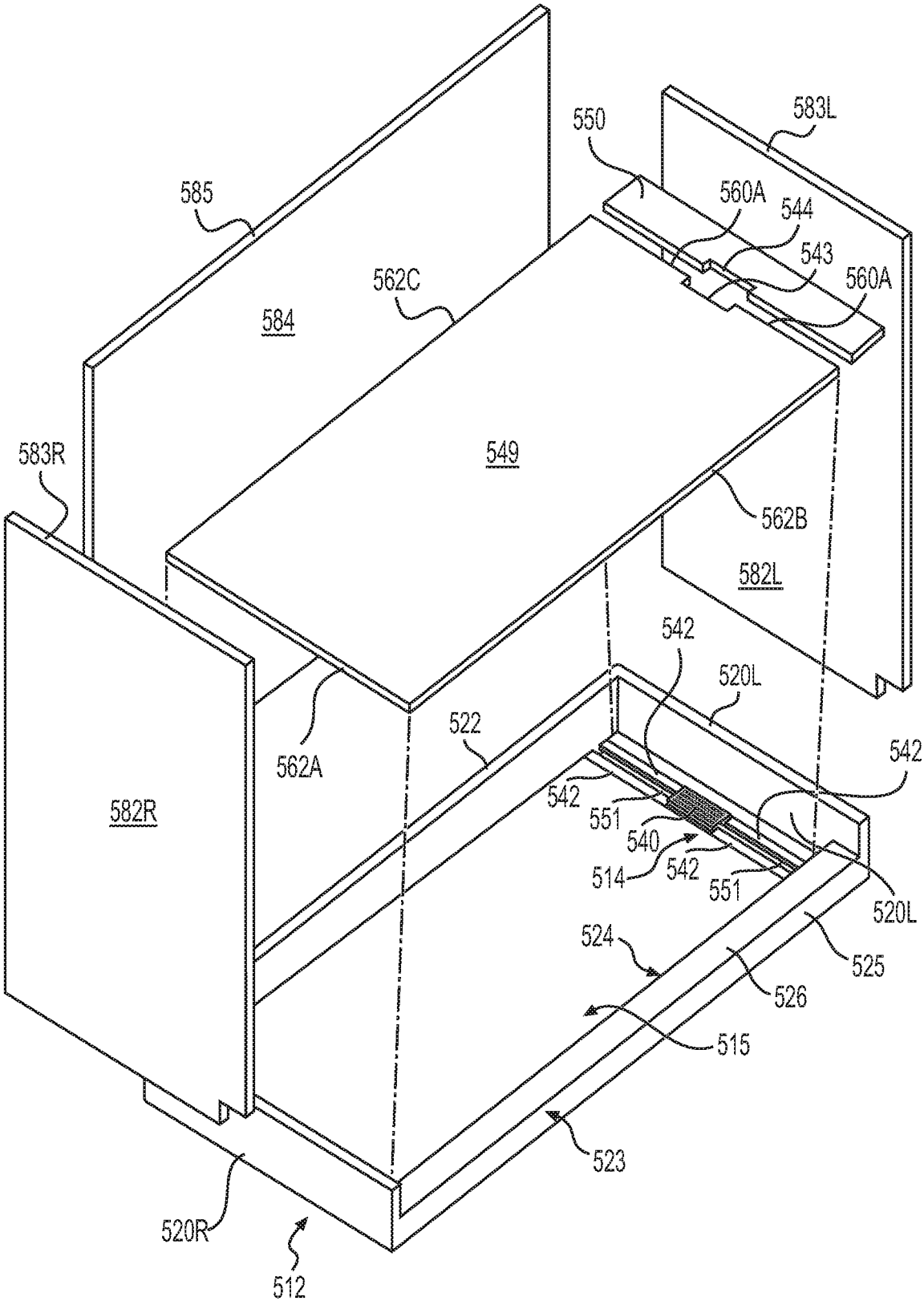
FIG. 11 is a right, front perspective exploded view of the step in a process for creating a left or right drain shower such as the one shown in FIG. 1, but with a slight structural modification.

It is to be appreciated that the partially concealed linear drain configurations disclosed in my co-pending U.S. patent application Ser. No. 16/712,421, filed Dec. 12, 2019, the contents of which are incorporated by reference herein as though fully set forth herein, may be employed with one or more of the embodiments disclosed herein. Alternatively, other linear drain configurations, and/or traditional circular drain configurations, may be employed in the shower installations disclosed in this specification. For example, in the embodiment shown in FIGS. 1-4, slotted or apertured first and second linear drain substrates 42 may be used to partially cover linear drain 14. In the case of slotted substrate 42, slots 51 are defined thereby to permit water to flow through to the linear drain. Alternatively, substrate members such as those shown in FIGS. 41-48 of my co-pending U.S. patent application Ser. No. 16/712,421, filed Dec. 12, 2019, may be employed in place of substrate members 42 herein, as shown in FIG. 11 of this application. Also, it is to be appreciated that the drain locations illustrated in the various but exemplary embodiments disclosed herein are not intending to be limiting, and that virtually any linear drain location, and location of drain fitting within a linear drain, and can be employed within scope of the invention. For example, the invention disclosed throughout this specification is intended to be used with, among other things, bathtub replacement arrangements, where a shower is constructed in place of an existing bathtub as part of a bathroom renovation. Typically, the bathtub drain is position approximately 3" to 6" from the side edge of the bathtub, meaning that the wastewater drain pipe in the subfloor is located at or near the side edge of the space allocated in the bathroom for a tub or shower. Since renovators ordinarily choose to retain the original location of the wastewater drain pipe in the subfloor due to the high cost and inconvenience of moving it, the location of the drain in a shower constructed in accordance with the teachings of my invention will sometimes be located accordingly. Rear wall panel 84 is adapted to be affixed to drywall D or wall studs S along the back or rear edge of pan 12, and is defined by an upper edge 85, left and right side edges 90 and lower edge 91. Lower edge 91 is tapered or sloped to correspond substantially to the slope of floor 15 or floor covering panel 49. Left and right side edges 190 are adapted to reside in close relationship to side wall covering panels 182L and 182R when installed and to overlap so that any irregularities or gaps are concealed.

Figure 3:
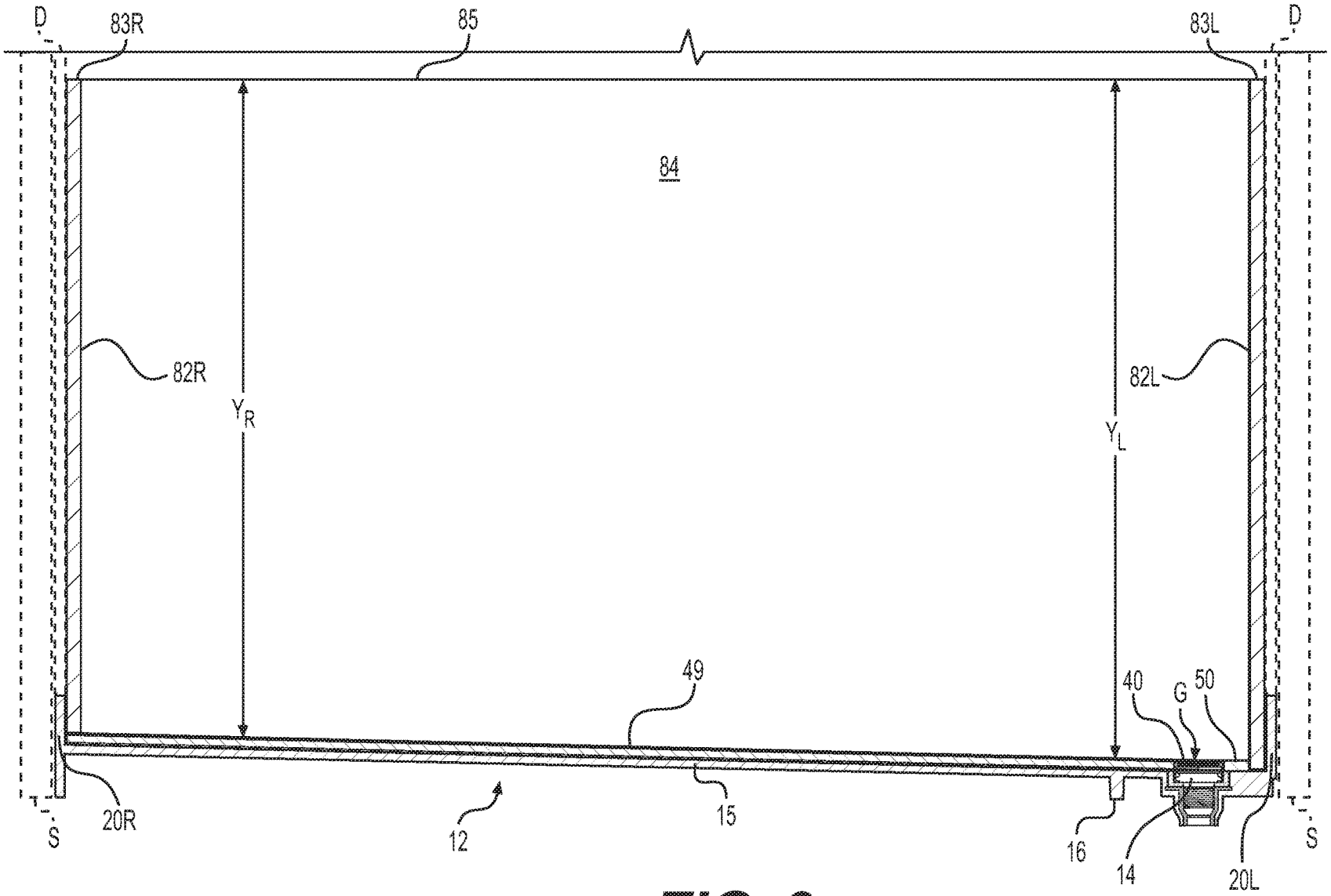
FIG. 3 is an elevational view of a portion of the shower in accordance with said process.
Figure 4:
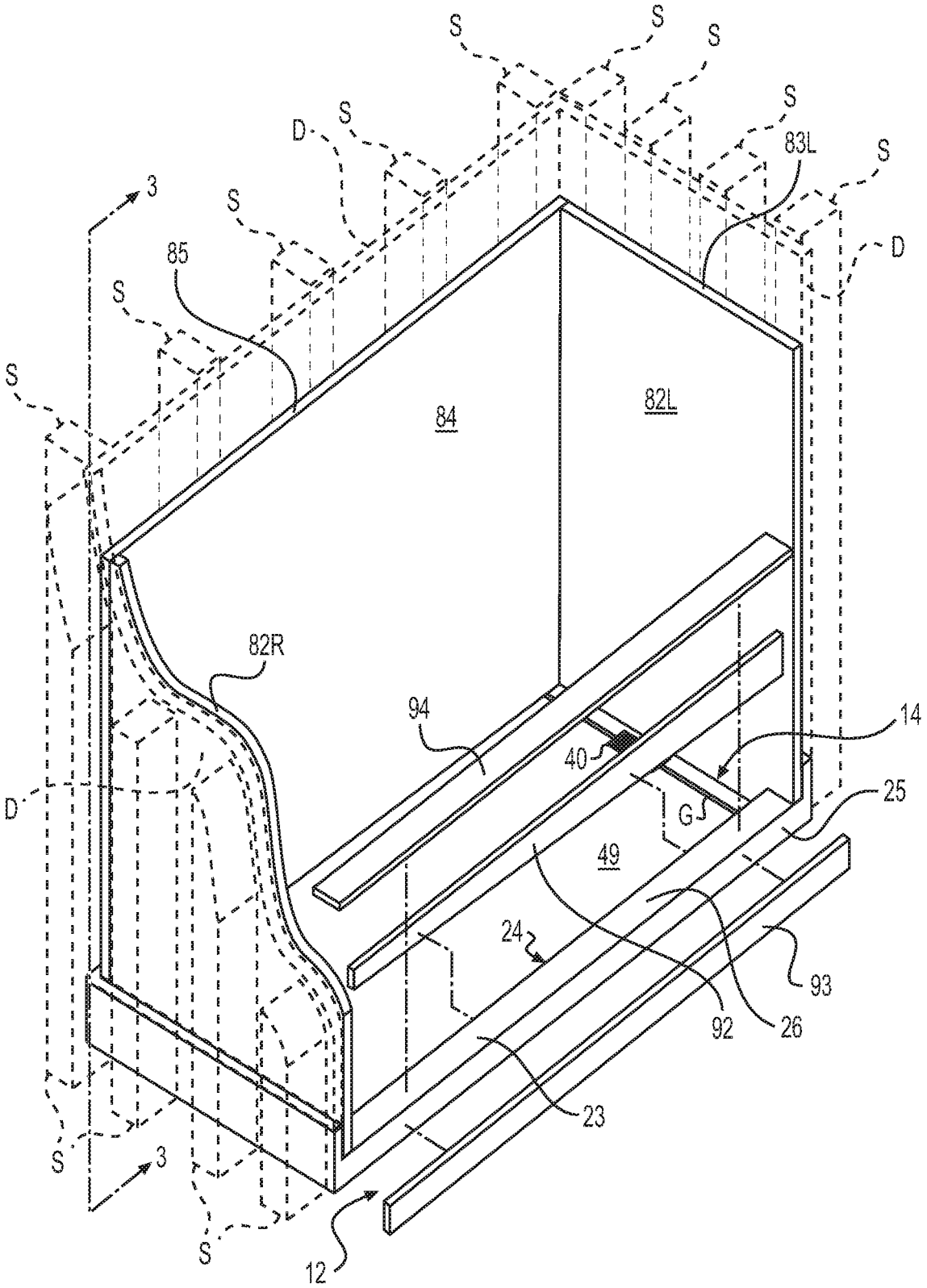
FIG. 4 is a right, front perspective partially exploded view of yet another step in said process.
Figure 5:
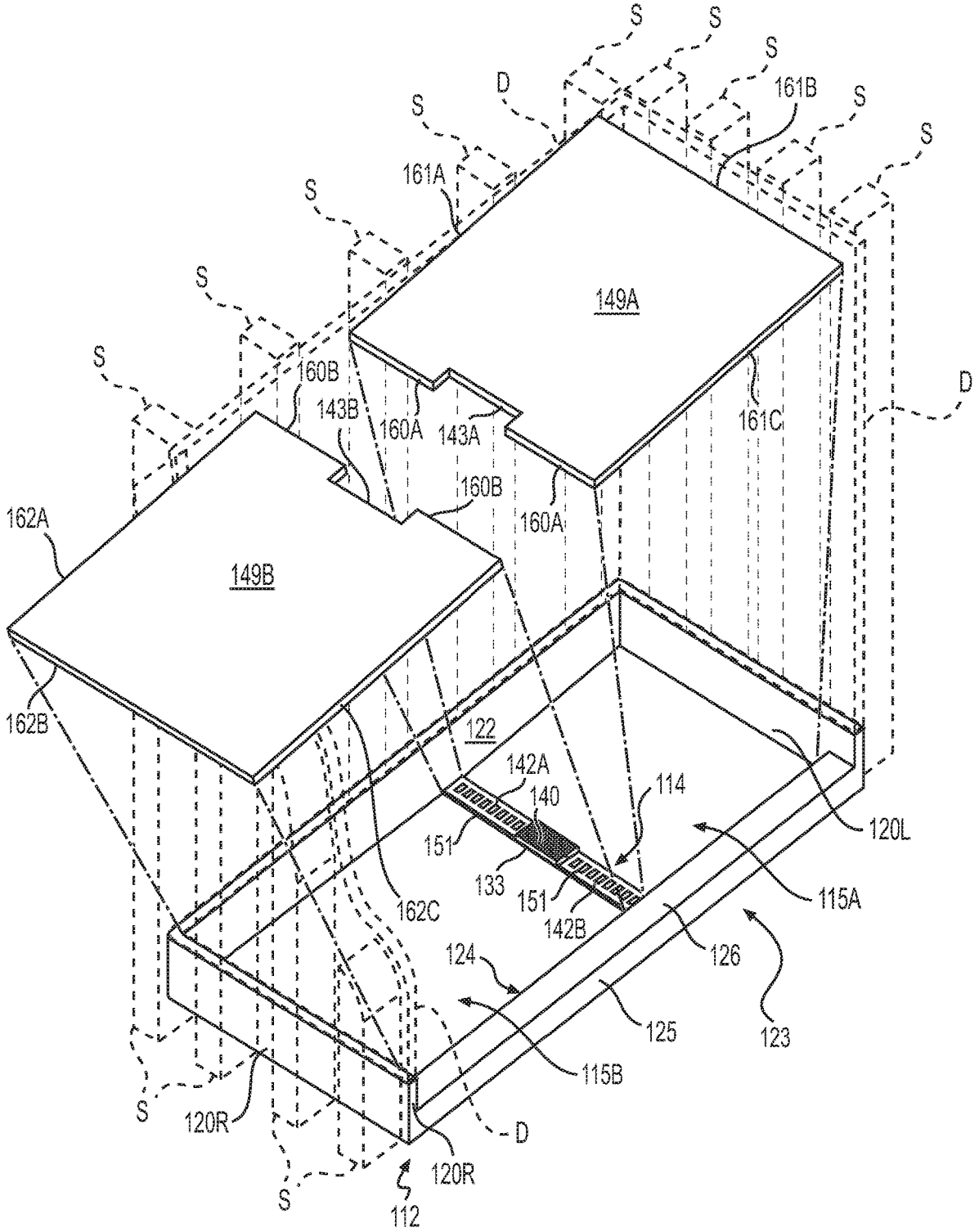
FIG. 5 is a right, front perspective exploded view of a step in a process for creating a center drain shower.

Left and right-side wall covering panels 82L and 82R, respectively, and rear wall covering panel 84, are applied to the shower board members D or wall studs S using any suitable adhesive or other mechanical fastening means. In embodiments, it is desirable to have the upper edges 83L, 83R and 85 of the wall covering panels 82L, 82R and 84, respectively, coincide in the same horizontal plane for aesthetic reasons so that the top of the panels are aligned and not at different heights relative to each other. It also permits, if desired, additional wall panels to be added above wall panels 82L, 82R and 84, to properly fit in the right orientations. In order to accomplish the orientation of having the upper edges 83L, 83R and 85 of the wall covering panels 82L, 82R and 84, respectively, coincide in the same horizontal plane, and to simultaneously have the lower edges of those wall panels meet at or near the outer peripheral edges of the floor panel 49 so as to create an attractive visual effect, the lower edge 91 of rear wall panel 84 may be provided with a tapering profile (as seen in FIG. 3) and right side wall panel 82R is made shorter than left side wall panel 82L. For example, right side wall panel 82R, while having upper and lower edges that are nonetheless substantially parallel, may have a height of $X_R$. Likewise, left side wall panel 82L, while having upper and lower edges that are nonetheless substantially parallel, may have a height of $X_L$, which is greater than $X_R$. In this way, side and rear wall panels can be pre-sized during manufacturing or any other preparation step, and supplied to the installation site without having to be further cut, eliminating the need to make multiple tile cuts and install multiple pieces of tile on the floor and wall, while resulting in a beautiful aesthetic. Shower-facing wall surfaces of drywall panels D are adapted to be substantially coplanar with the shower-facing surfaces of right, left and rear splashwalls 20R, 20L and 22 so that when wall covering material is applied over the splashwalls and drywall panels the wall covering material can contact and be affixed to both.

In the case of a left drain pan, such as that shown in FIGS. 1-4, left wall covering panel 82L will be taller in its vertical dimension $X_L$ than the vertical height $X_R$ of right wall covering panel 82R due to the pitch of pan floor 15 and the commensurate difference in height between left and right splash walls 20L and 20R.

Likewise, the vertical height $Y_L$ of the left side of rear wall covering panel 84 will be greater than the vertical height $Y_R$ of the right side of panel 84 due to the pitch of pan floor 15 and the commensurate difference in height between the left and right sides of rear splash wall 22. In doing so, rear wall covering panel 84 can be premanufactured, or otherwise sized and shaped, to have a top edge 85 that is adapted to be oriented in a substantially horizontal plane when installed, and a lower edge 91 that is oriented at an angle relative to top edge 85, an angle that is substantially parallel to an upper surface of floor covering panel 49. In this way, a single rear wall covering panel can be used without having to make numerous (or any) tile cuts. Likewise for the right and left side wall covering panels, in embodiments, they can be sized and shaped to cover the entirety of each respective stall wall and extend all the way down to the floor covering panel, dispensing with the need to cut and install separate pieces of tile.

In embodiments, inner, outer and upper curb wall covering panels 92, 93 and 94 are supplied and applied to the inner, outer and upper walls 24, 25 and 26, respectively, of curb 23 in whatever sequence is dictated by the designer or installer. In certain embodiments, the two vertical curb panels are installed first and then pressed towards each other ensure that the upper curb panel comfortably covers the upper edges of both vertically oriented panels 92, 93. Like rear wall panel 84, the lower edge of inner curb wall covering panel 92 may be tapered to follow the pitch of floor 15 and/or 49 so that only a single inner curb wall covering panel need be used while still covering the inner curb sidewall, using the least number of covering members. Outer curb wall covering panel 93 may be sized and shaped so that it covers the entirety of the outer curb wall 25, and may be coextensive with any adjacent wall covering member or material (not show).

Depending upon the selection of the designer or installer, the side wall covering panels and rear wall covering panel may be applied before or after the curb wall covering panels. Whichever sequence the wall and curb covering panels are applied in relative to each other, the second-to-be-applied panels should be sized and shaped such that their edges overlap a portion of the other in a manner that conceals any irregularities or gap(s) between the wall covering panel below and adjacent sections of pan 12, as represented in FIG. 3, where the floor panel 49 meets side wall panels 82L and 82R.

Cutouts 86 and 87 may be provided in right and left wall covering panels 82R, 82L, respectively, to fit over curb 23. In embodiments, as discussed above, the floor panel(s) should be installed first, then the wall panels 82R, 82L (as well as rear wall panel 84) may be applied before inner and outer curb wall covering panels 92 and 93 are applied, in which case cutouts 86, 87 should be sized and shaped to fit thereover. Once the inner and outer curb wall covering panels 92, 93 are applied, the upper curb wall covering panel 94 can be applied to cover any irregularities or gaps between the curb and the wall panels. Conversely, if curb wall covering panels 92, 93 and 94 are all applied before right and left wall covering panels 82R, 82L, cutouts 86, 87 should be sized accordingly. Still further in the alternative, the right and left wall covering panels 82R, 82L can be applied before any of curb wall covering panels 92, 93 or 94 are applied, and then curb wall covering panels 92, 93 and 94 can be sized and shaped to fit within the side wall covering panels 82R, 82L, and cutouts 86, 87 sized and shaped to fit over curb 23 first.

Given that the preferred finished appearance is to have a uniform (i.e., coplanar) tile line at the top of the wall panels, by cutting or otherwise forming the bottom edge 90 of rear wall covering panel 84 to substantially follow the pitch of the pan floor or pan floor covering panel, one can produce the desired uniform tile line on the top of the wall panels in a simple and cost effective manner.

It is understood, therefore, that a finished shower can be constructed in far less time than has heretofore been possible, with simple components, according to the following method: in a space adapted to receive a waterproof shower pan which defines or has associated with it a linear drain 14 near either the left or right side thereof, said pan comprising a uniformly pitched planar floor 15, and one or more splash walls 20 and 22 upstanding from said floor, said space including two or more upstanding shower stall walls D supported by wall studs S, the stall walls having shower-facing surfaces that are coplanar with corresponding shower-facing surfaces of said splashwalls of said shower pan, the process for creating a shower comprising the steps of: (1) installing a preformed shower pan floor covering panel on said pan floor to cover substantially all of said pan floor other than all or a portion of an area defined by said linear drain, said floor covering panel defining an opening through which water may flow into said linear drain; (2) installing a wall covering panel on each stall wall, each wall covering panel defining a bottom and a top edge, the bottom edge of each wall covering panel being substantially parallel to an upper surface of the floor covering panel adjacent to the floor covering panel bottom edge, the top edges of each wall covering panel lying in substantially the same plane; (3) optionally, installing an inner curb wall covering panel on an inner curb wall defined by the shower pan, installing an outer curb wall covering panel on an outer curb wall defined by the shower pan, and installing an upper curb wall covering panel on an upper curb wall of said shower pan; (4) wherein a bottom edge of said inner curb wall covering panel is substantially parallel to the upper surface of the floor covering panel.

By the term "cover substantially all of said pan floor other than all or a portion of an area defined by said linear drain" is meant that the preferred floor covering panel is adapted to cover the majority of the shower pan floor with a single panel, but that one or more areas for water drainage is to be left. As an example, single floor panel covers are disclosed in my copending U.S. patent application Ser. No. 16/712,421, filed Dec. 12, 2019. Such panels cover substantially the entirety of the pan floor but still allow for drainage into the linear drain(s).

Figure 1:
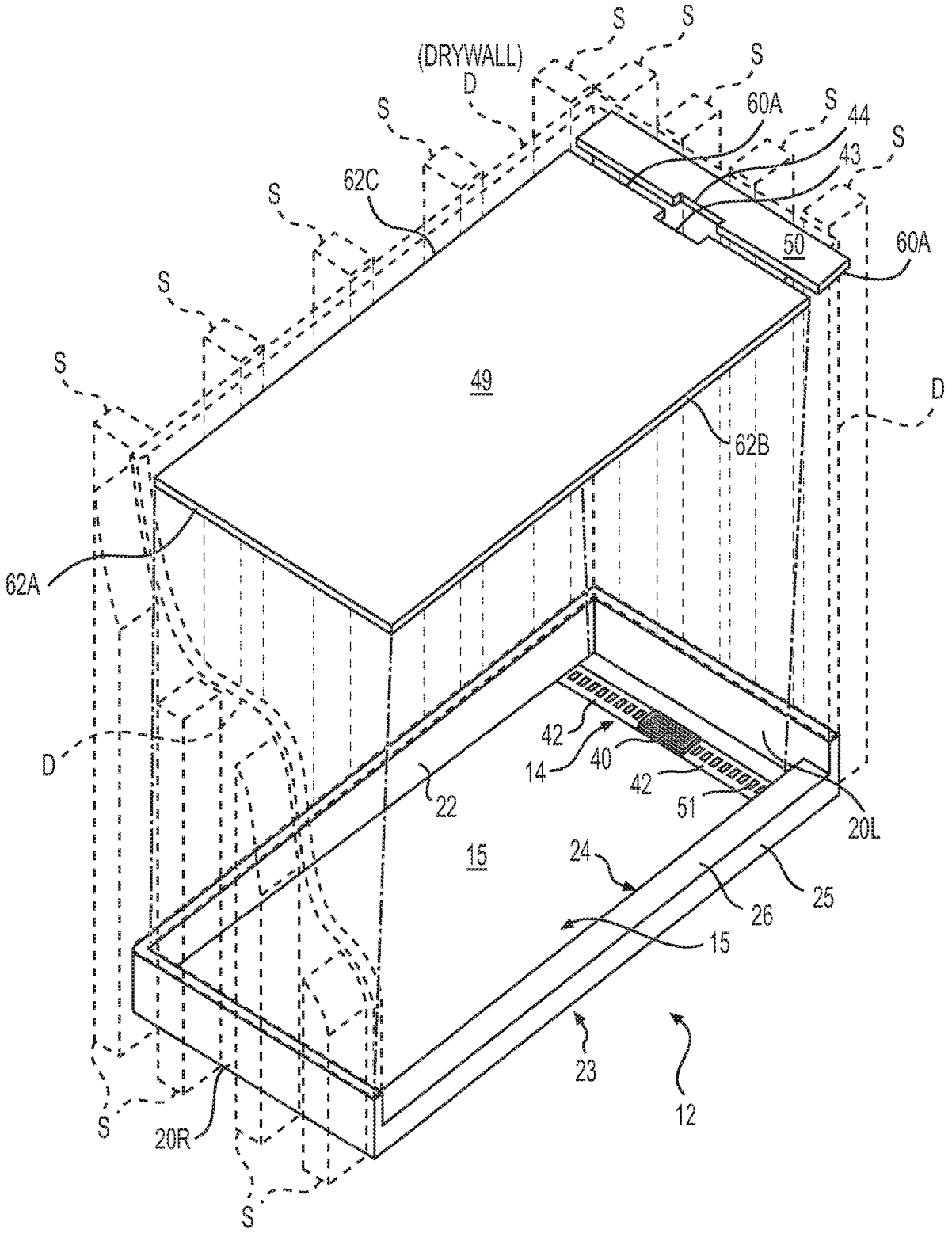
FIG. 1 is a right, front perspective exploded view of a step in a process for creating a left or right drain shower in accordance with the invention.
Figure 1A:
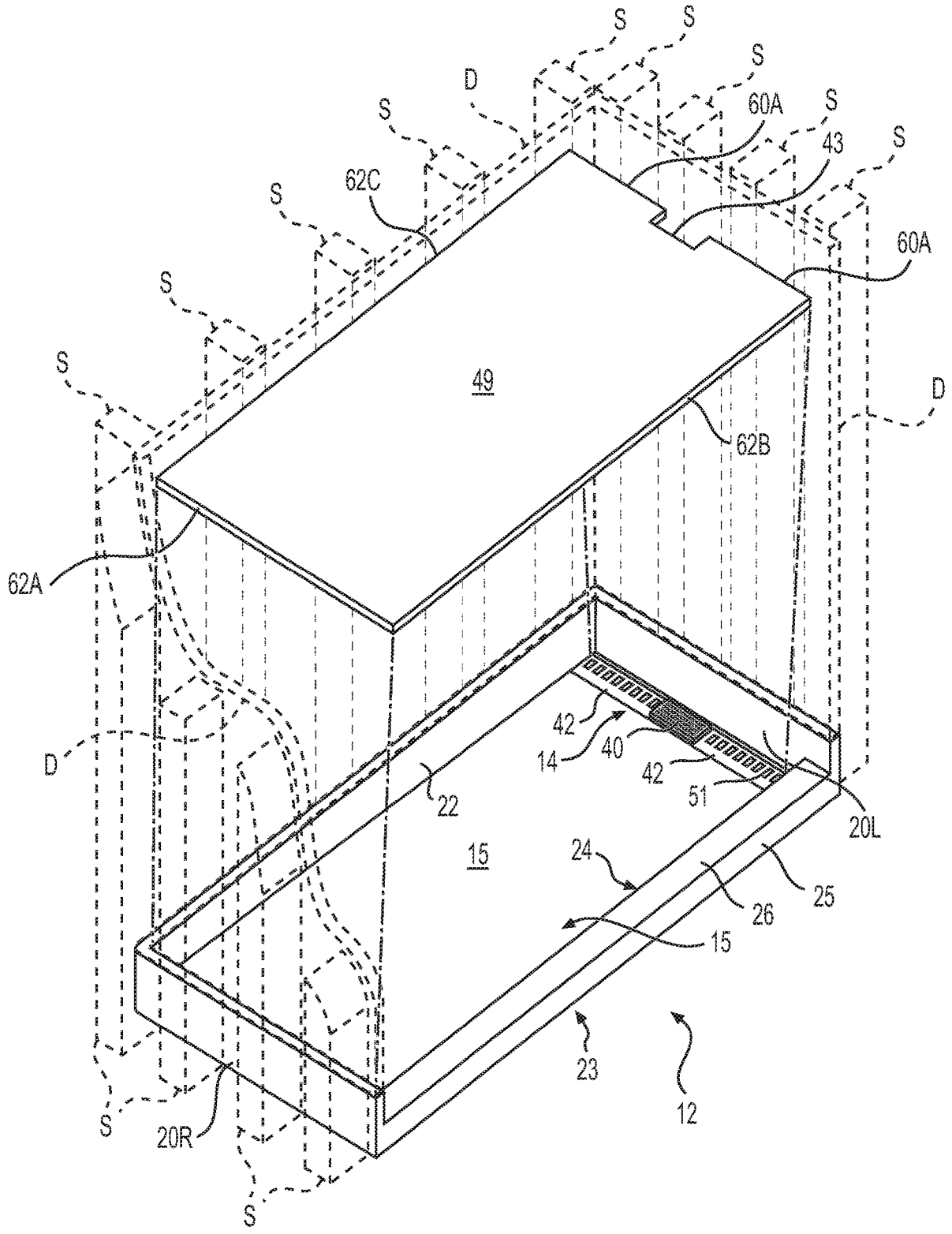
FIG. 1A is the same view as FIG. 1 but with a slight modification to the location of the linear drain.
Figure 2:
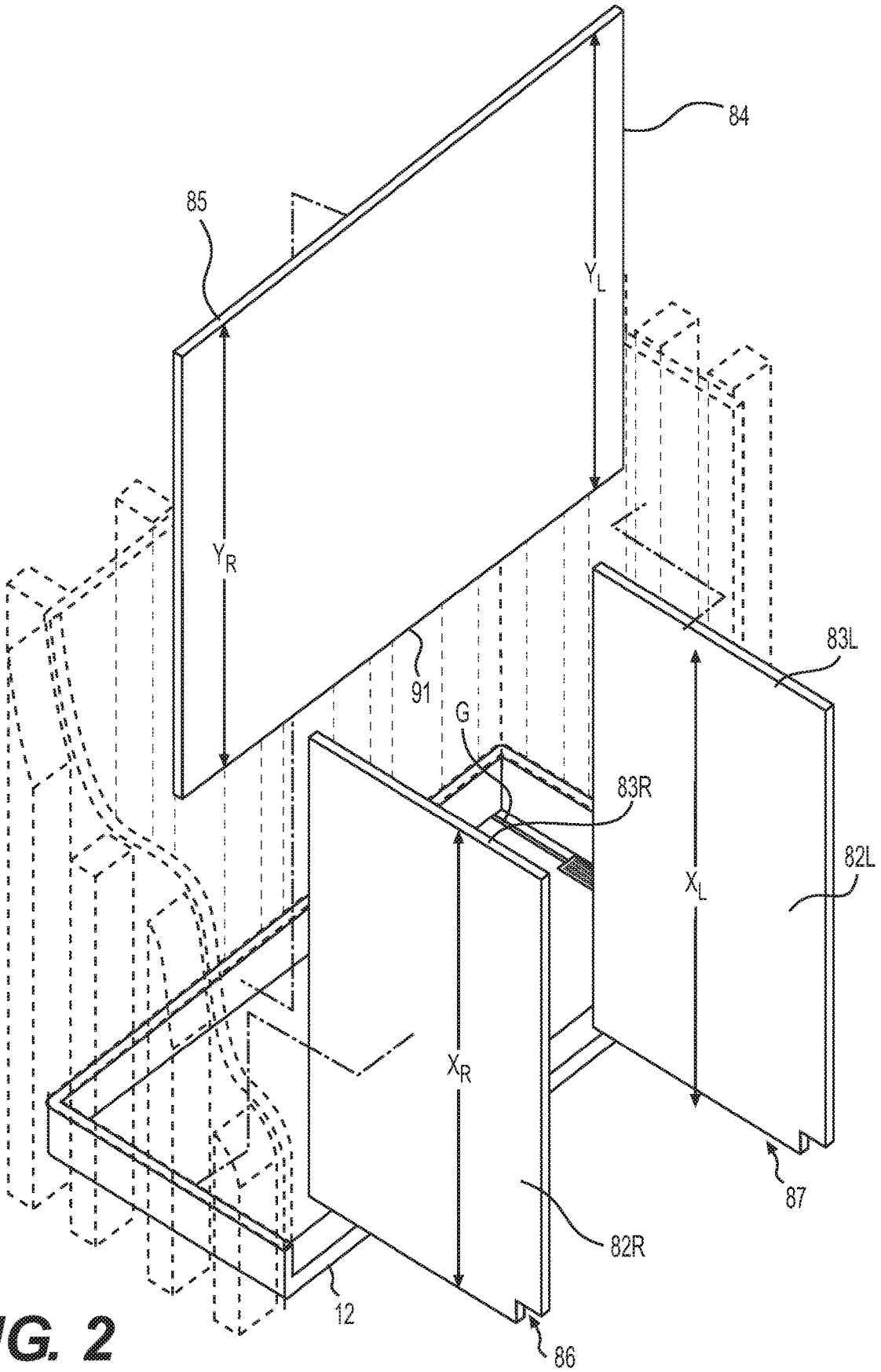
FIG. 2 is a right, front perspective exploded view of another step in said process.

FIG. 1A depicts the embodiment of FIGS. 1-4 but with the linear drain 14 moved closer to the peripheral edge of the pan floor by a small distance, eliminating the need for the smaller floor covering panel 50. Water is permitted to drain through opening "G" defined by the edges of floor covering panel 49 and splashwall 20L (or shower stall sidewall D in the case where a pan without splashwalls is used).

FIGS. 5-8 depict certain steps in another, similar, process for creating a finished center-drain shower, and components thereof. By "center-drain" linear shower is meant a linear drain that is located a distance from the side or rear walls of the shower. Locating a linear drain away from the side and/or rear walls of a shower may be necessitated by any number of reasons, such as pure design selection, location of wastewater drain pipe in the subfloor together, space limitations for the location of the shower, etc. This embodiment includes a shower pan 112 with a linear drain 114. The pan 112 is comprised of a pitched floor 115 defining a bottom surface thereof, whether with or without support ribs (not shown), and may include such additional features as one or more curbs 123, one or more side splash walls 120, and one or more rear splash walls 122. Accessory features of shower pans are well known (such as neo-angled curbs and/or splashwalls), and it is contemplated that such features may or may not be used in connection with the embodiments disclosed herein. In addition, other known accessory features (such as barrier-free entrances) may be employed without departing from the spirit and scope of the invention.

As can be seen from FIGS. 5-8, floor 115, which in the embodiment shown has a linear drain therein, may comprise two sections 115A and 115B, each of which is substantially planar and is pitched or sloped toward linear drain 114. A standard slope is ¼ inch per foot, although any pitch which will accomplish the task of causing liquid to drain from floor 115 (or, in embodiments, whatever covering material is situated thereon, such as floor tile panel 149) into linear drain 114 is deemed to be within the scope of the invention. Using single-plane floor sections 115A and 115B eliminates the multi-pitched floors which have traditionally been used too create showers, which necessitate many cuts in floor tiles, and attendant labor time and expense.

A pair of pre-shaped floor covering panels 149A, 149B are adapted to be placed on floor sections 115A, 115B, respectively. The floor covering panels 149A, 149B define cutouts 143A, 143B to accommodate a removable drain grate such as grate 140, such that, when the floor covering panels 149A, 149B are associated with the shower pan floor sections 115A, 115B, the cutouts 143A, 143B provides an area in which the removable drain grate 140 may be removably received. Preferably, the removable drain grate is located substantially adjacent the wastewater pipe in the sub-floor (not shown) to facilitate cleaning the drain or otherwise gaining access to the linear drain 114 and wastewater pipe. Floor panels 149A, 149B may be made of any shower floor covering material including ceramic or porcelain tile, stone, marble, polymer-based material, acrylic, solid surface, metal, or any suitable material for covering a floor from which liquid is to drain.

Figure 12:
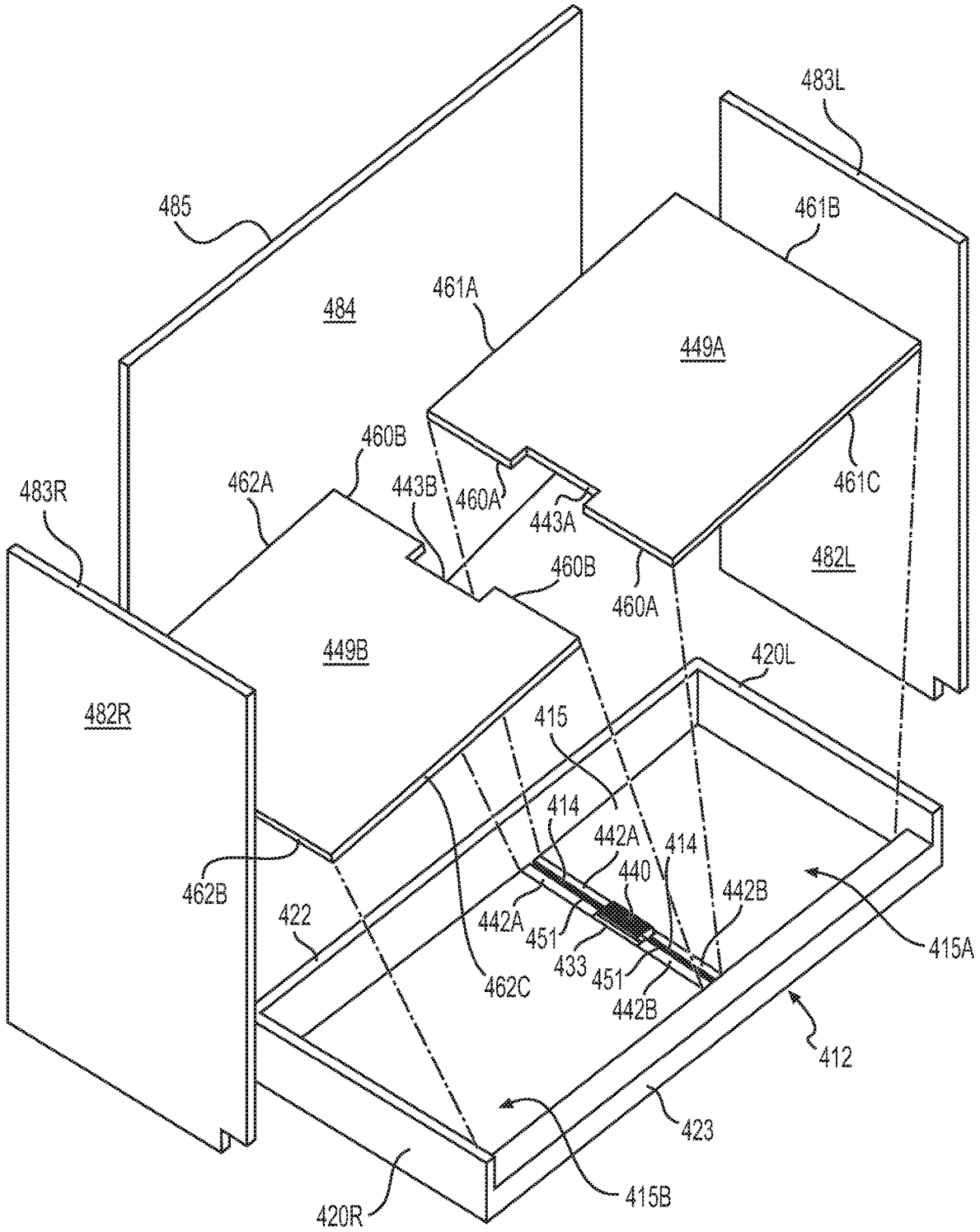
FIG. 12 is a right, front perspective exploded view of the step in a process for creating a center drain shower such as the one shown in FIG. 5, but with a slight structural modification.

It is to be appreciated that the linear drain configurations disclosed in my co-pending U.S. patent application Ser. No. 16/712,421, filed Dec. 12, 2019, the contents of which are incorporated by reference herein as though fully set forth herein, may be interchangeably employed with one or more of the embodiments disclosed herein. Alternatively, other linear drain configurations, and/or traditional circular drain configurations, may be employed in the shower installations disclosed in this specification. For example, in the embodiment shown in FIGS. 5-8, slotted or apertured first and second linear drain substrates 142A, 142B may be used to partially cover linear drain 114. In the case of slotted substrate 142A, 142B, slots 151 are defined thereby to permit water to flow through to the linear drain. Alternatively, substrate members such as those shown in FIGS. 41-48 of my co-pending U.S. patent application Ser. No. 16/712,421, filed Dec. 12, 2019, may be employed in place of substrate members 142A, 142B herein, as shown in FIG. 12 of this application. In such embodiment, separate sections of substrate support members 442A and 442B may be used to underlie floor panels 449A, 449B. The completely open drainage slots formed between the opposed pairs of substrate support members 442A, 442B allow for drainage without debris being caught in the slotted substrate members 142A, 142B.

Rear wall panel 184 is adapted to be affixed to drywall D or wall studs S along the back or rear edge of pan 112, and is defined by an upper edge 185, left and right side edges 190 and lower edges 191R and 191L. Lower edges 191R and 191L are tapered or sloped to correspond substantially to the slope of floor sections 115A, 115B and/or floor covering panel sections 149A, 149B. Left and right side edges 190 are adapted to reside in close relationship to side wall covering panels 182L and 182R when installed and to overlap so that any irregularities or gaps are concealed.

Figure 6:
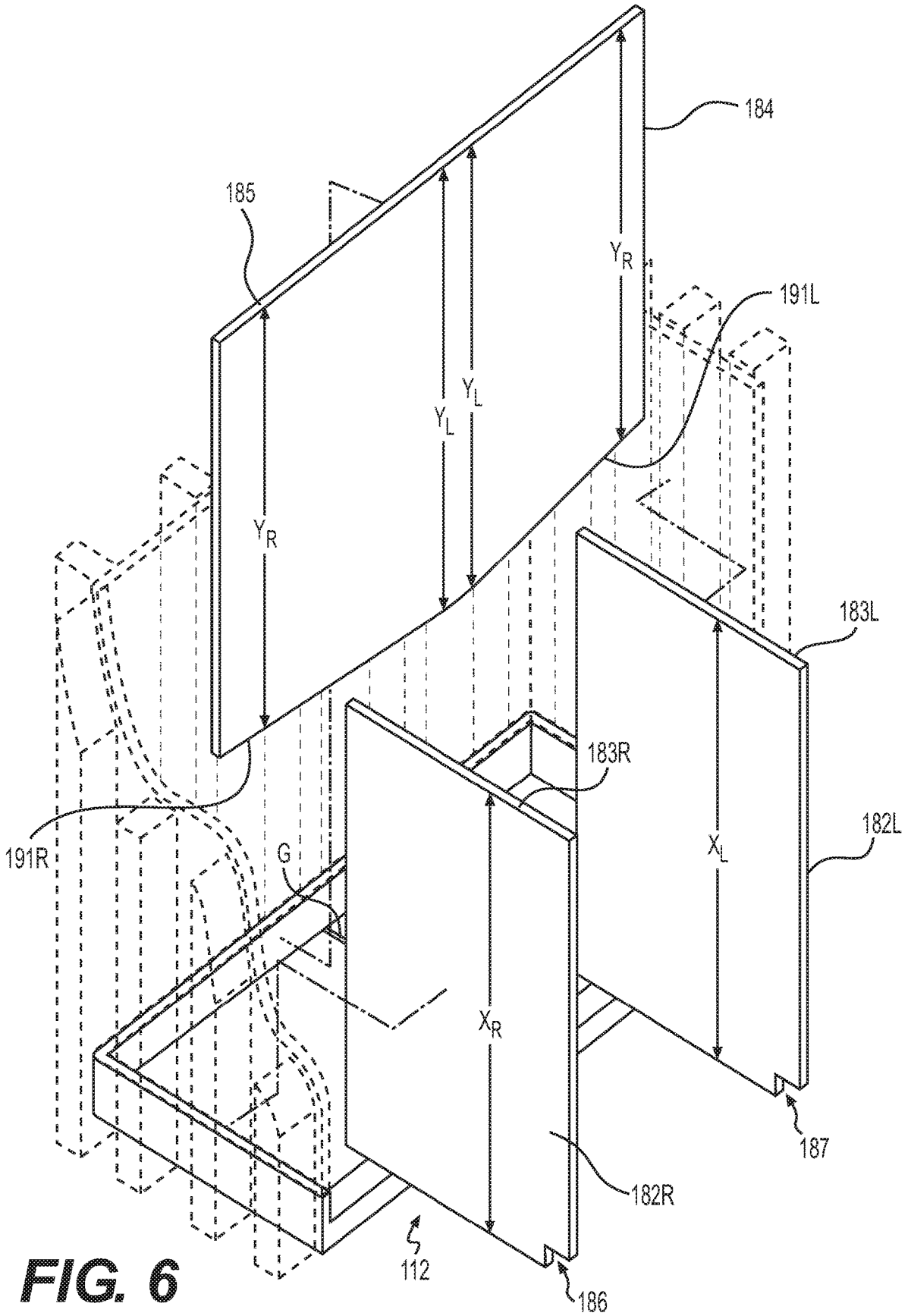
FIG. 6 is a right, front perspective exploded view of another step in said process.
Figure 7:
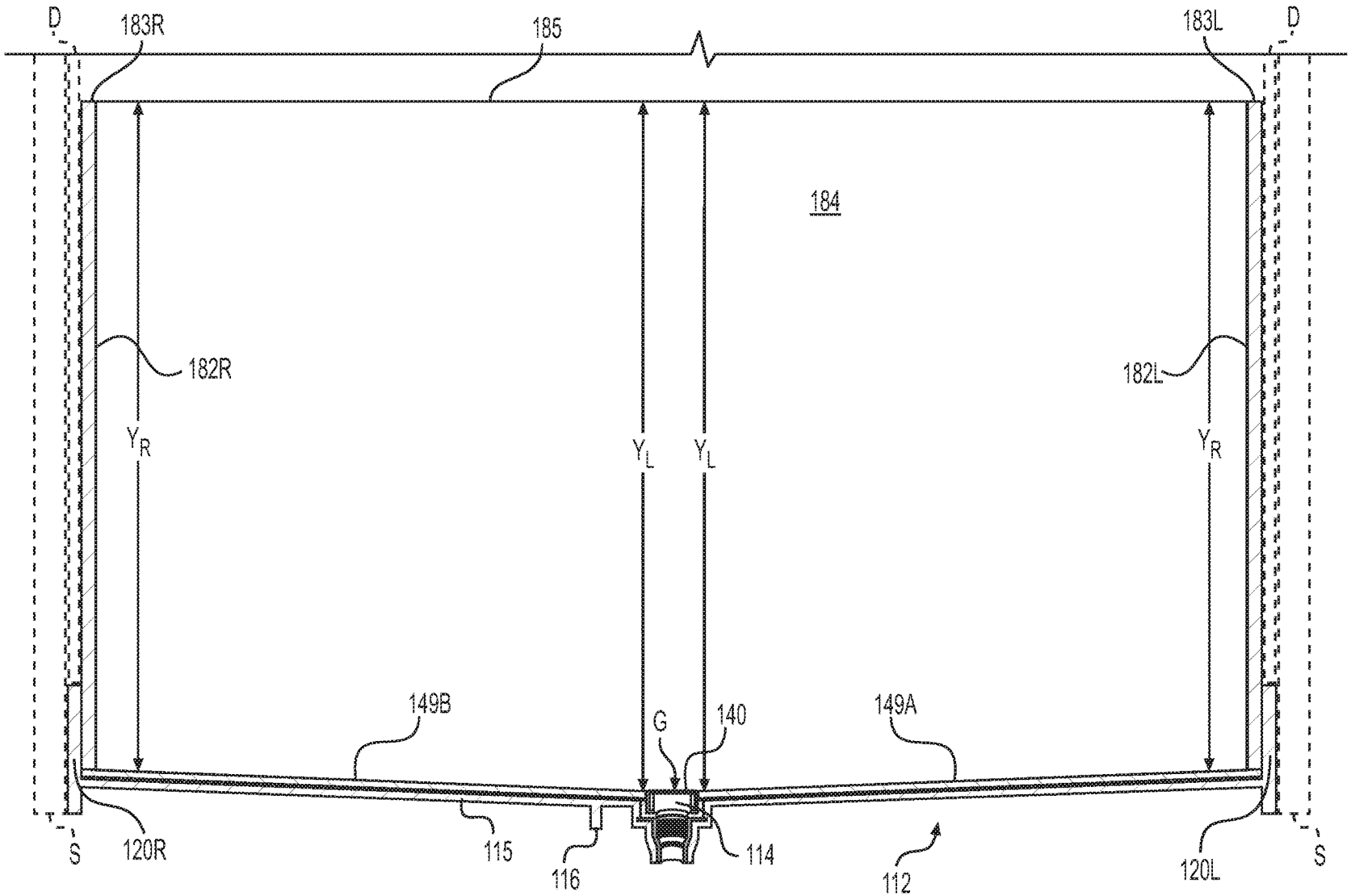
FIG. 7 is an elevational view of a portion of the shower in accordance with said process.
Figure 8:
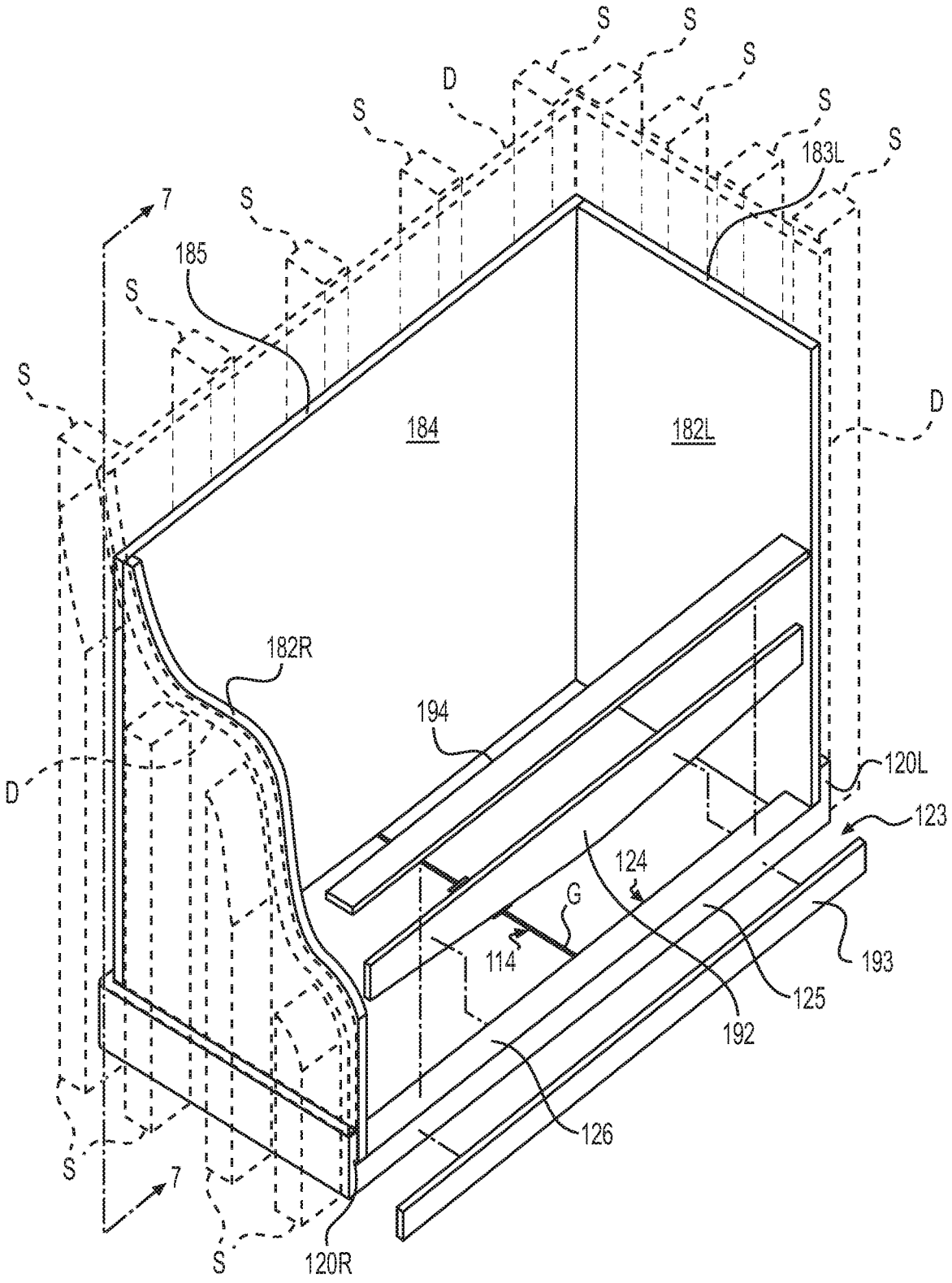
FIG. 8 is a right, front perspective partially exploded view of yet another step in said process.

Left and right-side wall covering panels 182L and 182R, respectively, and rear wall covering panel 184, are applied to the shower drywall members D or wall studs S using any suitable adhesive or other mechanical fastening means. In embodiments, it is desirable to have the upper edges 183L, 183R and 185 of the wall covering panels 182L, 182R and 184, respectively, coincide in the same horizontal plane for aesthetic reasons so that the top of the panels are aligned and not at different heights relative to each other. In this way, if additional wall panels are added above wall panels 182L, 182R and 184, those panels will fit in the right orientations. In order to accomplish the orientation of having the upper edges 183L, 183R and 185 of the wall covering panels 182L, 182R and 184, respectively, coincide in the same horizontal plane, and to simultaneously have the lower edges of those wall panels meet at or near the outer peripheral edges of the floor panels 149A, 149B so as to create an attractive visual effect, the lower edge 191L, 191R of rear wall panel 184 may be provided with a tapering profile (as seen in FIGS. 6-8), while right and left side wall panels 182R, 182L may be substantially the same height. In this way, side and rear wall panels 182L, 182R and 184 can be pre-sized during manufacturing or any other preparation step, and supplied to the installation site without having to be further cut, eliminating the need to make multiple tile cuts and install multiple pieces of tile on the floor and walls, dramatically decreasing the time it takes to install same, while resulting in a beautiful aesthetic.

In the case of a center-type drain pan, such as that shown in FIGS. 5-8, left wall covering panel 182L will be substantially the same height in its vertical dimension $X_L$ as the vertical height $X_R$ of right wall covering panel 182R, due to the pitch of pan floor 15 and the commensurate difference in height between left and right splash walls 20L and 20R.

However, the vertical height $Y_L$ of the middle portions of rear wall covering panel 184 will be greater than the vertical height $Y_R$ of the left and right sides of panel 184 due to the pitch of pan floor sections 115A, 115B and the commensurate difference in height between the outer portions and inner portions of rear splash wall 122. It can be appreciated that the use of a single rear wall covering panel 184, as well as single left and right side wall covering panels 182R and 182L, which may be pre-formed during manufacturing or some other preparation step, provides a simple solution to the construction of the walls of a shower.

In embodiments, inner, outer and upper curb wall covering panels 192, 193 and 194 are supplied and applied to the inner, outer and upper walls 124, 125 and 126, respectively, of curb 123 in whatever sequence is dictated by the designer or installer. Like rear wall panel 184, the lower edge of inner curb wall covering panel 192 may be tapered to follow the pitch of floor 115 and/or first and second floor covering panels 149A, 149B so that only a single inner curb wall covering panel need be used while still covering the inner curb sidewall, using the least number of covering members. Outer curb wall covering panel 193 may be sized and shaped so that it covers the entirety of the outer curb wall 125, and may be coextensive with or part of any adjacent wall covering member or material (not show).

Depending upon the selection of the designer or installer, the side wall covering panels and rear wall covering panel may be applied before or after the curb wall covering panels. Whichever sequence the wall and curb covering panels are applied in relative to each other, the second-to-be-applied panels should be sized and shaped such that their edges overlap a portion of the other in a manner that conceals any irregularities or gap(s).

Cutouts 186 and 187 may be provided in right and left wall covering panels 182R, 182L, respectively, to fit over curb 123. In embodiments, as discussed above, wall panels 182R, 182L may be applied before curb wall covering panels 192, 193 and 194 are applied, in which case cutouts 186, 187 should be sized and shaped to fit thereover. Conversely, if curb wall covering panels 192, 193 and 194 are applied before right and left wall covering panels 182R, 182L, cutouts 186, 187 should be sized and shaped to fit over curb 123 first, and curb wall covering panels 192, 193 an 194 sized and shaped to fit within the side wall covering panels 182R, 182L.

Given that the preferred finished appearance, in certain embodiments, is to have a uniform (i.e., coplanar) tile line at the top of the wall panels, by cutting or otherwise forming the bottom edges 191R, 191L of rear wall covering panel 184 to substantially follow the pitch of the pan floor or pan floor covering panel, one can produce the desired uniform tile line on the top of the wall panels in a simple, cost effective and design friendly manner.

It is understood, therefore, that a finished shower can be constructed in far less time than has heretofore been possible, with simple components, according to the following method: in a space adapted to receive a waterproof shower pan, said pan comprising a uniformly pitched planar floor which defines a linear drain therein, and one or more splash walls upstanding from said floor, said space including two or more upstanding shower stall walls supported by wall studs, the stall walls having shower-facing surfaces that are coplanar with corresponding shower-facing surfaces of said splashwalls of said shower pan, the process for creating a shower comprising the steps of: (1) installing two preformed shower pan floor covering panels 149A, 149B on said pan floor sections 115A, 115B to cover substantially all of said pan floor 115 other than all or a portion of one or more areas defined by said linear drain 114, said floor covering panels 115A, 115B defining an opening or gap through which water may flow into said linear drain; (2) installing first and second side wall covering panels 182R, 182L, and at least one rear wall covering panel 184, each of the first and second wall covering panels 182R, 182L and the at least one rear wall covering panel 184 defining a bottom and a top edge, the bottom edge of each side and rear wall covering panel being substantially parallel to an upper surface of the floor covering panel adjacent to the respective wall covering panel bottom edge, the top edges of each wall covering panel lying in substantially the same plane; (3) optionally installing an inner curb wall covering panel on an inner curb wall defined by the shower pan, installing an outer curb wall covering panel on an outer curb wall defined by the shower pan, and installing an upper curb wall covering panel on an upper curb wall of said shower pan; (4) wherein a bottom edge of said inner curb wall covering panel is substantially parallel to the upper surface of the floor covering panel adjacent said inner curb wall covering panel.

By the term "cover substantially all of said pan floor other than one or more areas defined by said linear drain" is meant that the preferred floor covering panels are adapted to cover the majority of the shower pan floor with two panels, but that one or more areas for water drainage is/are to be left. As an example, double floor covering panels are disclosed in my copending U.S. patent application Ser. No. 16/712,421, filed Dec. 12, 2019. Such panels cover substantially the entirety of the pan floor but still allow for drainage into the linear drain(s).

Figure 9:
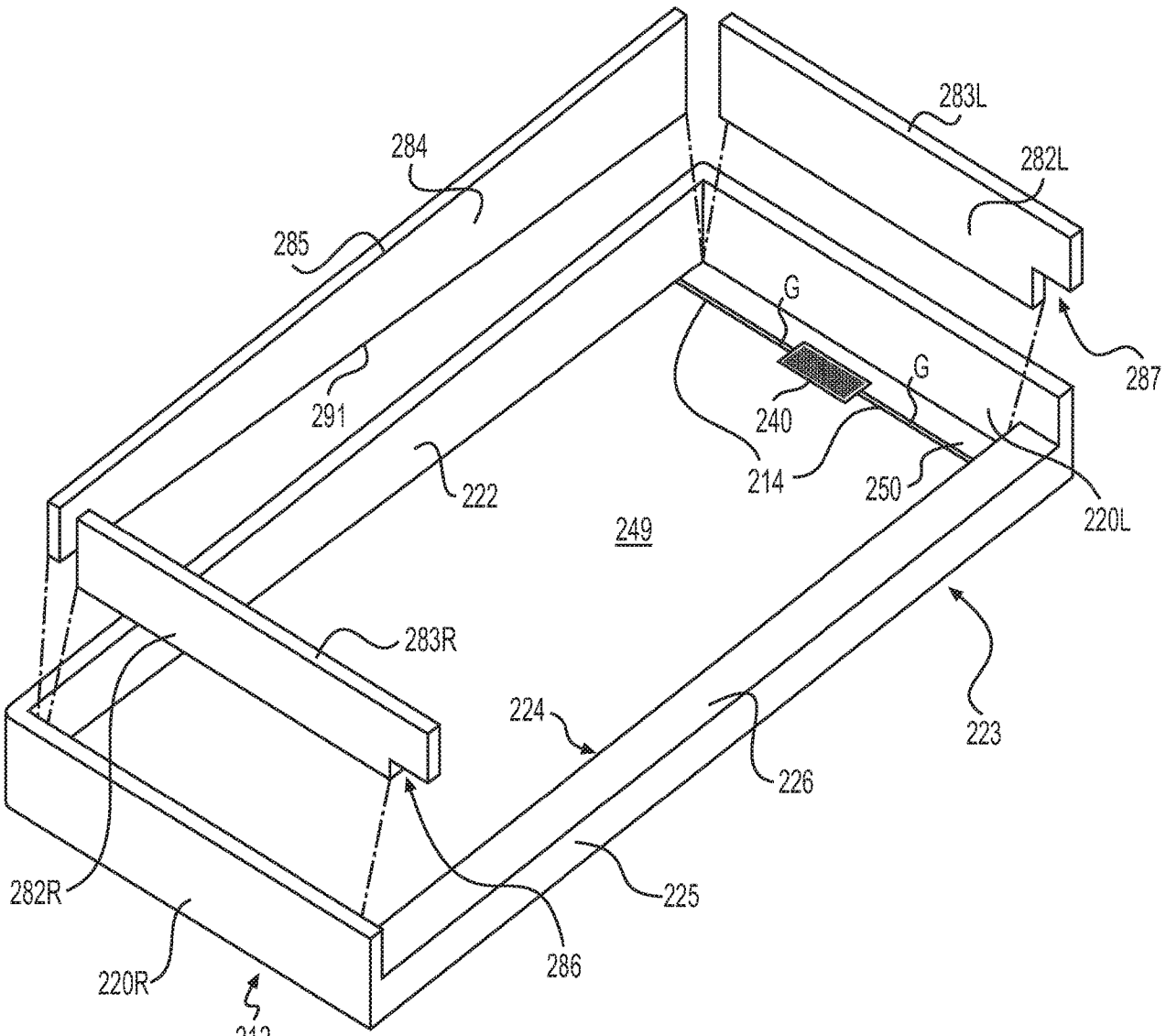
FIG. 9 is a right, front perspective exploded view of still another shower and process for constructing same.

FIG. 9 depicts an embodiment of the invention which is similar to the embodiment shown in FIGS. 1-4. In this embodiment, shorter side wall covering panels 282R and 282L are used, as well as a shorter rear wall covering panel 284. In versions of this embodiment, the side wall covering panels 282L, 282R and 284 may be sized and shaped to substantially correspond in height to the height of its side and rear splashwalls 220R, 220L and 222, or be slightly shorter, while having upper edges thereof 283R, 283L and 285 reside substantially in a single plane. The height of wall covering panels 282R, 282L and 284 may be made shorter or taller than shown in FIG. 9. The use of wall covering panels that correspond closely to the height of the shower pan splashwalls permits the use of alternative materials for the rest of the wall coverings of the shower enclosure. As noted, the drains of the invention described throughout this specification can be located in any suitable location on the pan floor without departing from the spirit and scope of the invention. In embodiments, it may be desirable to space the linear drain 214 from an immediately adjacent peripheral edge of pan floor 215. A second, smaller, floor covering panel 250 may be used to cover the small section of floor which extends between the splashwall 220L and linear drain 214. Floor covering panel 250 may define a cutout 244 adapted to receive all or a portion of the removable drain cover 240. Opposed edges of the large and small floor covering panels form a drainage gap "G" through which water may drain into linear drain 214. As in the embodiment described in connection with FIGS. 1-4, a large, substantially planar, floor covering panel 249 is placed upon shower pan floor 215, and wall covering panels 282R, 282L and 284 installed thereafter. Curb covering panels such as those shown in FIG. 4 may also be employed. It is to be appreciated that the lower edge 291 of rear wall covering panel 284 should be tapered to follow the slope of floor 215 and/or floor covering panel 249 adjacent the rear wall covering panel 284. Curb cut outs 286 and 287 may be created in right and left side wall covering panels 282R, 282L to accommodate curb 223 and/or curb covering panels such as panels 91, 92 and 93 shown in FIGS. 1-4.

Figure 9A:
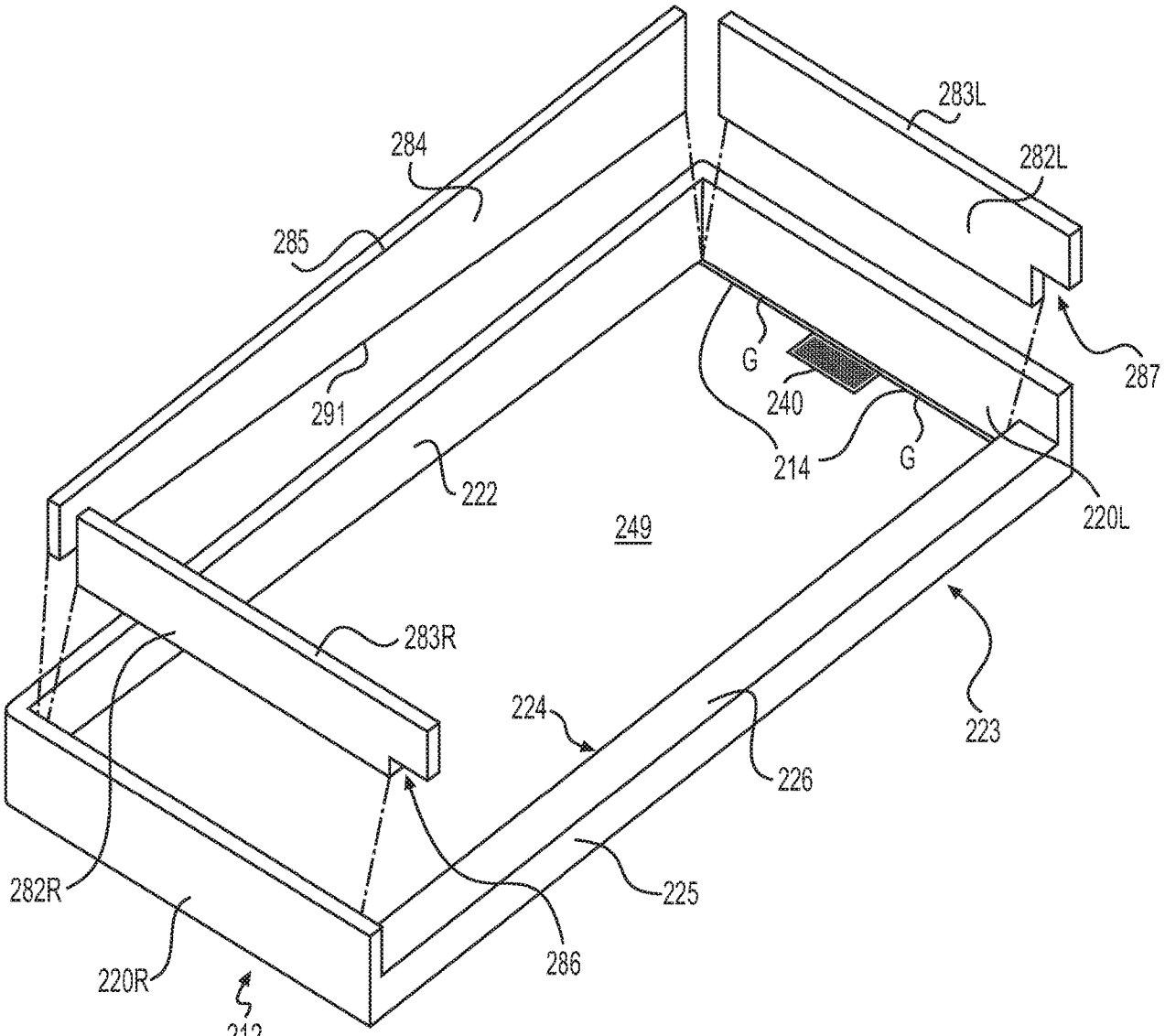
FIG. 9A is the same view as FIG. 9 but with a slight modification to the location of the linear drain.

FIG. 9A depicts the embodiment of FIG. 9 but with the linear drain 214 moved closer to the immediately adjacent peripheral edge of floor 215 (e.g., splashwall 220L or shower stall side wall D) by a small distance, eliminating the need for smaller floor covering panel 250. Water is permitted to drain through opening "G" defined by the edges of floor covering panel 249 and splashwall 220L (or shower stall sidewall D in the case where a pan without splashwalls is used).

Figure 10:
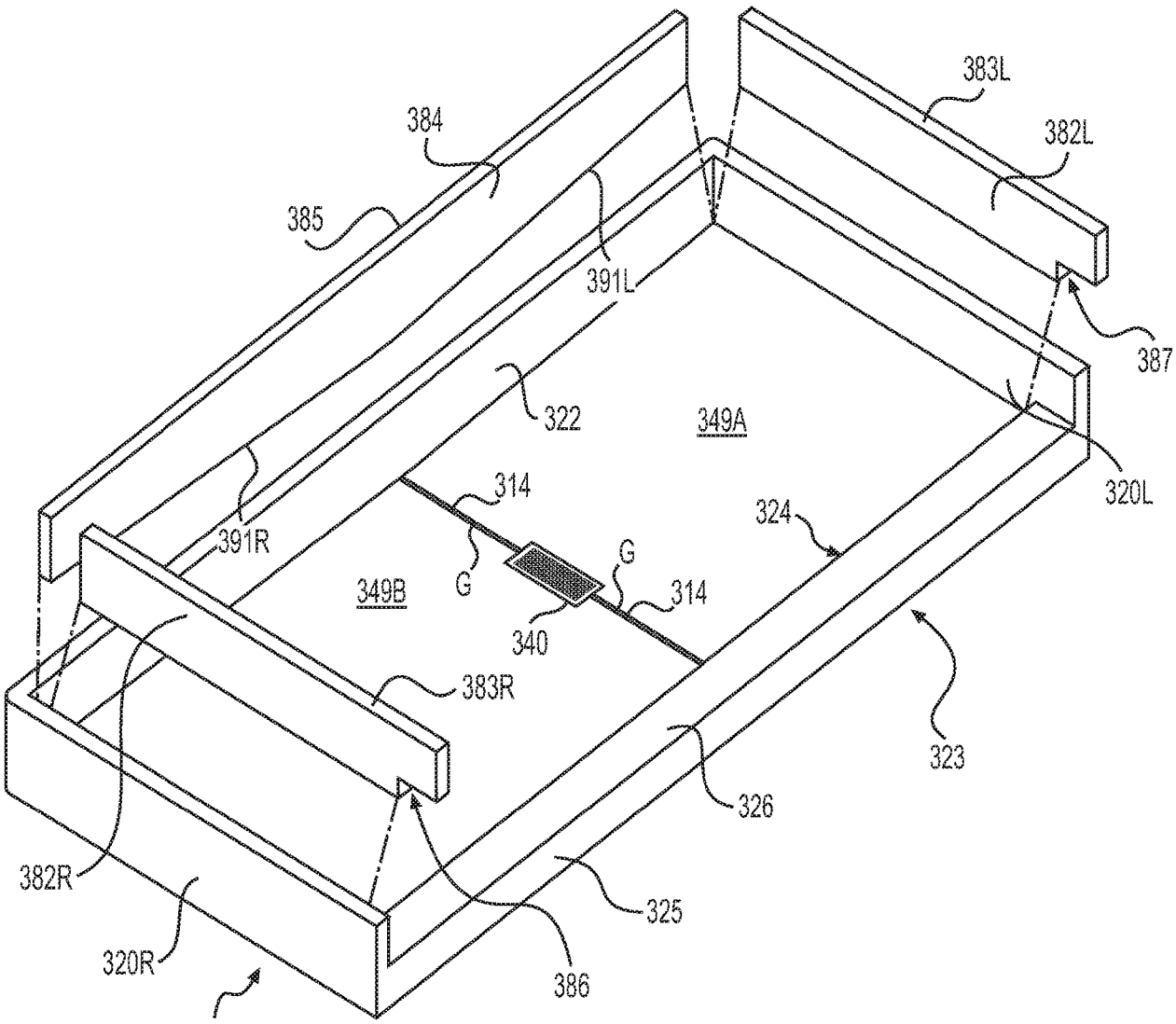
FIG. 10 is a left, front perspective exploded view of yet another shower and process for constructing same.

FIG. 10 depicts an embodiment of the invention which is similar to the embodiment shown in FIGS. 4-8. In this embodiment, shorter side wall covering panels 382R and 382L are used, as well as a shorter rear wall covering panel 384. In versions of this embodiment, the side wall covering panels 382L, 382R and 34 may be sized and shaped To substantially correspond in height to the height of its side and rear splashwalls to 320R, 320L and 322 while having upper edges there of 383R, 383L and 385 which resides substantially in a single plane. The heights of wall covering panels 382R, 382L and 384 may be made shorter or taller than shown in FIG. 10. The use of wall covering panels that correspond closely to the height of the shower pan splashwalls permits the use of alternative materials for the rest of the wall coverings of the shower enclosure.

As in the embodiment described in connection with FIGS. 4-8, a pair of substantially planar, floor covering panels 349A, 349B are placed upon shower pan floor sections 315A, 315B, and wall covering panels 382R, 382L and 384 installed thereafter. Curb covering panels, such as panels 192, 193 and 194 shown in FIG. 8, may also be employed. It is to be appreciated that the lower edge comprised of edge-sections 391R, 391L of rear wall covering panel 284 should be tapered to follow the slope of floor sections 315A, 315B and/or floor covering panels 349A, 349B adjacent the rear wall covering panel 384. Curb cut outs 386 and 387 may be created in right and left side wall covering panels 382R, 382L to accommodate curb 323 and/or curb covering panels 192, 193 and 194.

FIG. 11 shows an alternative substrate drain grate arrangement to that shown in FIGS. 1-4. The pan 512 is comprised of a pitched floor 515 (which is preferably planar leading up to the linear drain 514) defining a bottom surface thereof, whether with or without support ribs 516, and may include such additional features as one or more curbs 523, one or more side splash walls 520, and one or more rear splash walls 522. Accessory features of shower pans are well known (such as neo-angled curbs and/or splashwalls), and it is contemplated that such features may or may not be used in connection with the embodiments disclosed herein. In addition, other known accessory features (such as barrier-free entrances) may be employed without departing from the spirit and scope of the invention. Although the linear drains disclosed in the various embodiments shown and described herein are sometimes shown as extending over the entirety of the length or width of the pan floor, it is to be understood that the principles of my invention can be carried out using any size, proportion or shape of drain and still fall within the spirit and scope of the invention.

In embodiments, it may be desirable to space the linear drain 514 a small distance from an immediately adjacent peripheral edge of pan floor 515. In such cases, a second, smaller, floor covering panel 550 may be used to cover the small section of floor which extends between the peripheral edge of pan floor 515 (which may coincide with splashwall 520L if present or shower stall side wall 520L) and the linear drain. Floor covering panel 550 may define a cutout 544 adapted to receive all or a portion of the removable drain cover 540. Opposed edges of the large and small floor covering panels form a drainage gap "G" through which water may drain into linear drain 514.

The floor covering panel 549 defines a cutout 543 to accommodate a removable drain grate such as grate 540, such that, when the floor covering panel 549 is associated with the shower pan floor 515, the cutout 543 provides an area in which the removable drain grate 540 may be removably received. Preferably, the removable drain grate is located substantially adjacent the wastewater pipe in the sub-floor (not shown) to facilitate cleaning the drain or otherwise gaining access to the linear drain 514 and wastewater pipe. Floor panel 549 may be made of any shower floor covering material including ceramic or porcelain tile, stone, marble, polymer-based material, acrylic, solid surface, metal, or any suitable floor covering material from which liquid is to drain.

Left and right-side wall covering panels 582L and 582R, respectively, and rear wall covering panel 584, are applied to the shower board members D or wall studs S using any suitable adhesive or other mechanical fastening means. In embodiments, it is desirable to have the upper edges 583L, 583R and 585 of the wall covering panels 582L, 582R and 584, respectively, coincide in the same horizontal plane for aesthetic reasons so that the top of the panels are aligned and not at different heights relative to each other. It also permits, if desired, additional wall panels to be added above wall panels 582L, 582R and 584, to properly fit in the right orientations. In order to accomplish the orientation of having the upper edges 583L, 583R and 585 of the wall covering panels 582L, 582R and 584, respectively, coincide in the same horizontal plane, and to simultaneously have the lower edges of those wall panels meet at or near the outer peripheral edges of the floor panel 549 so as to create an attractive visual effect, the lower edge 591 of rear wall panel 584 may be provided with a tapering profile and right side wall panel 582R is made shorter than left side wall panel 582L. For example, right side wall panel 82R, while having upper and lower edges that are nonetheless substantially parallel, may have a height which is greater than the height of the right side panel 582R. In this way, side and rear wall panels can be pre-sized during manufacturing or any other preparation step, and supplied to the installation site without having to be further cut, eliminating the need to make multiple tile cuts and install multiple pieces of tile on the floor and wall, while resulting in a beautiful aesthetic. Shower-facing wall surfaces of drywall panels D are adapted to be substantially coplanar with the shower-facing surfaces of right, left and rear splashwalls 520R, 520L and 522 so that when wall covering material is applied over the splashwalls and drywall panels the wall covering material can contact and be affixed to both.

Curb walls 524, 525 and 526 may be provided and covered with curb wall panels as shown in connection with other curbed embodiments shown and described herein.

Figure 11A:
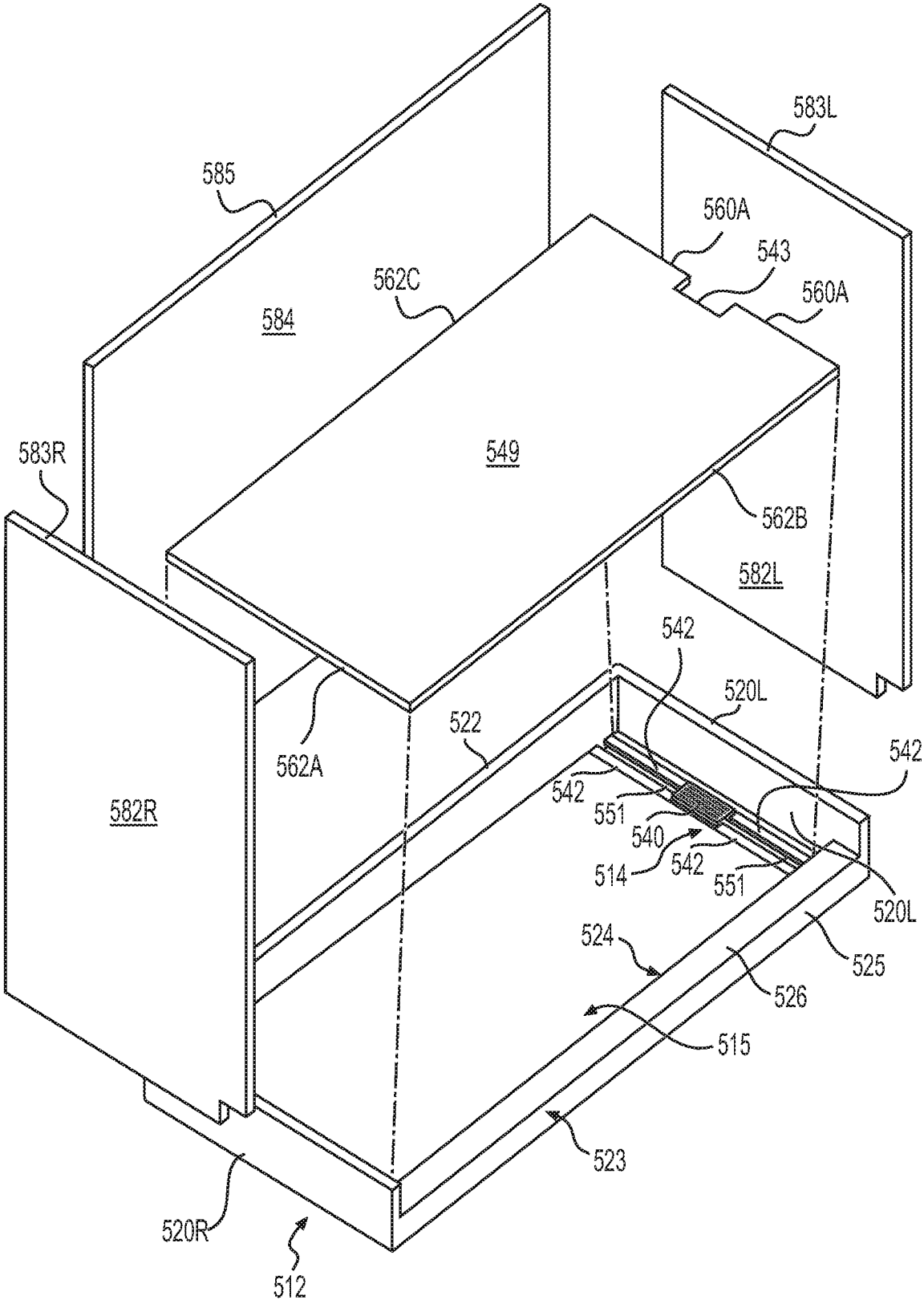
FIG. 11A is the same view as FIG. 11 but with a slight modification to the location of the linear drain.

FIG. 11A depicts the embodiment of FIG. 11 but with the linear drain 514 moved closer to the immediately adjacent peripheral edge of floor 515 (e.g., splashwall 520L or shower stall side wall D) by a small distance, eliminating the need for smaller floor covering panel 550. Water is permitted to drain through opening "G" defined by the edges of floor covering panel 549 and splashwall 520L (or shower stall sidewall D in the case where a pan without splashwalls is used). FIGS. 13-16 depict another method for carrying out the principles of this invention, and the components thereof. This embodiment includes a so-called "rear" or "back" drain shower pan 612 with a linear drain 614. The pan 612 is comprised of a pitched floor 615 (which is preferably substantially planar leading up to the linear drain 614) defining a bottom surface thereof, whether with or without support ribs (not shown), and may include such additional features as one or more curbs 623, one or more side splash walls 620, and one or more rear splash walls 622. Accessory features of shower pans are well known (such as neo-angled curbs and/or splashwalls), and it is contemplated that such features may or may not be used in connection with the embodiments disclosed herein. In addition, other known accessory features (such as barrier-free entrances) may be employed without departing from the spirit and scope of the invention.

As noted, the drains of the invention described throughout this specification can also be located in any suitable location on the pan floor without departing from the spirit and scope of the invention. In embodiments, it may be desirable to space the linear drain 614 a small distance from an immediately adjacent peripheral edge of pan floor 615. In such cases, a second, smaller, floor covering panel 650 may be used to cover the small section of floor which extends between the peripheral edge of pan floor 615 (which may coincide with splashwall 620L if present or shower stall side wall 620L) and the linear drain. Floor covering panel 650 may define a cutout 644 adapted to receive all or a portion of the removable drain cover 640. Opposed edges of the large and small floor covering panels form a drainage gap "G" through which water may drain into linear drain 614.

As can be seen from FIGS. 13-16, floor 615, which in the embodiment shown has a linear drain near the rear splashwall 622 thereof, may reside substantially in one plane and be pitched or sloped toward linear drain 614. A standard slope is ¼ inch per foot, although any pitch which will accomplish the task of causing liquid to drain from floor 615 (or, in embodiments, whatever covering material is situated thereon, such as floor tile panel 649) into linear drain 614 is deemed to be within the scope of the invention. Using a single-plane floor eliminates the multi-pitched floors which have traditionally been used, which necessitate many cuts in floor tiles, and attendant labor time and expense.

The floor covering panel 649 defines a cutout 643 to accommodate a removable drain grate such as grate 640, such that, when the floor covering panel 649 is associated with the shower pan floor 615, the cutout 643 provides an area in which the removable drain grate 640 may be removably received. Preferably, the removable drain grate is located substantially adjacent the wastewater pipe in the sub-floor (not shown) to facilitate cleaning the drain or otherwise gaining access to the linear drain 614 and wastewater pipe. Floor panel 649 may be made of any shower floor covering material including ceramic or porcelain tile, stone, marble, polymer-based material, acrylic, solid surface, metal, or any suitable material for covering a floor from which liquid is to drain.

Figure 13A:
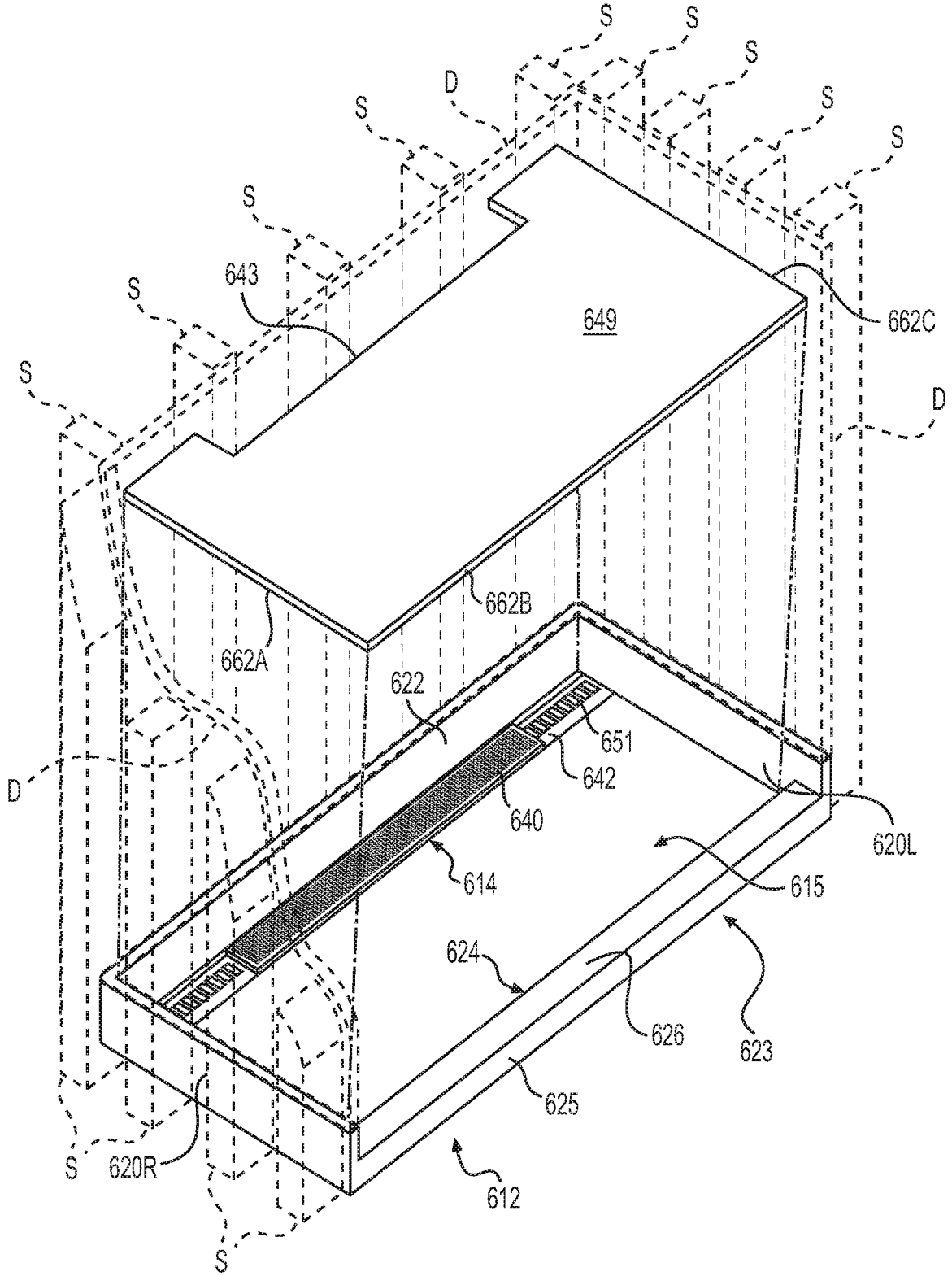

FIG. 13A depicts the embodiment of FIGS. 13-17 but with the linear drain 614 moved closer to the peripheral edge of the pan floor 615 by a small distance, eliminating the need for the smaller floor covering panel 650. Water is permitted to drain through opening "G" defined by the edges of floor covering panel 649 and splashwall 620L (or shower stall sidewall D in the case where a pan without splashwalls is used).

It is to be appreciated that the linear drain configurations disclosed in my co-pending U.S. patent application Ser. No. 16/712,421, filed Dec. 12, 2019, the contents of which are incorporated by reference herein as though fully set forth herein, may be employed with one or more of the embodiments disclosed herein. Alternatively, other linear drain configurations, and/or traditional circular drain configurations, may be employed in the shower installations disclosed in this specification. For example, in the embodiment shown in FIGS. 13-16, slotted or apertured first and second linear drain substrates 642A, 642B may be used to partially cover linear drain 614. In the case of slotted substrate 642A, 642B, slots 651 are defined thereby to permit water to flow through to the linear drain. Alternatively, substrate members such as those shown in FIGS. 41-48 of my co-pending U.S. patent application Ser. No. 16/712,421, filed Dec. 12, 2019, may be employed in place of substrate members 642A, 642B herein, in the manner as shown in FIG. 11 of this application.

Left and right-side wall covering panels 682L and 682R, respectively, and rear wall covering panel 684, are applied to the shower drywall members D or studs S using any suitable adhesive or other mechanical fastening means. In embodiments, it is desirable to have the upper edges 683L, 683R and 685 of the wall covering panels 682L, 682R and 684, respectively, coincide in the same horizontal plane for aesthetic reasons so that the top of the panels are aligned and not at different heights relative to each other. In this way, if additional wall panels are added above wall panels 682L, 682R and 684, those panels will fit in the right orientations. In order to accomplish the orientation of having the upper edges 683L, 683R and 685 of the wall covering panels 682L, 682R and 684, respectively, coincide in the same horizontal plane, and to simultaneously have the lower edges of those wall panels meet at or near the outer peripheral edges of the floor panel 649 so as to create an attractive visual effect, the lower edges 689R, 689L of side wall panels 682R and 682L, respectively, may be provided with a tapering profile (as seen in FIGS. 14-16). The height $X_{R2}$ of side wall panel 682R toward its foremost edge is less than the height $X_{R1}$ of that panel, and likewise for the heights $X_{L1}$ and $X_{L2}$ of left side wall panel 682L. In such an embodiment, the upper and lower edges 685, 691 of rear wall panel 684 are substantially parallel. In this way, the side and rear wall panels can be pre-sized during manufacturing or any other preparation step, and supplied to the installation site without having to be further cut, eliminating the need to make multiple tile cuts and install multiple pieces of tile on the floor and wall, while resulting in a beautiful aesthetic.

In embodiments, inner, outer and upper curb wall covering panels 692, 693 and 694 are supplied and applied to the inner, outer and upper walls 624, 625 and 626, respectively, of curb 623 in whatever sequence is dictated by the designer or installer. Outer curb wall covering panel 693 may be sized and shaped so that it covers the entirety of the outer curb wall 625, and may be coextensive with any adjacent wall covering member or material (not show).

Depending upon the selection of the designer or installer, the side wall covering panels and rear wall covering panel may be applied before or after the curb wall covering panels. Whichever sequence the wall and curb covering panels are applied in relative to each other, the second-to-be-applied panels should be sized and shaped such that their edges overlap a portion of the other in a manner that conceals any gap(s) between the wall covering panel below and adjacent sections of pan 612, as represented in FIG. 15, where the floor panel 649 meets side wall panels 682L and 682R.

Cutouts 686 and 687 may be provided in right and left wall covering panels 682R, 682L, respectively, to fit over curb 623. In embodiments, as discussed above, wall panels 682R, 682L may be applied before curb wall covering panels 692, 693 and 694 are applied, in which case cutouts 686, 687 should be sized and shaped to fit thereover. Conversely, if curb wall covering panels 692, 693 and 694 are applied before right and left wall covering panels 682R, 682L, cutouts 686, 687 should be sized and shaped to fit over curb 623 first, and curb wall covering panels 692, 693 and 694 sized and shaped to fit within the side wall covering panels 682R, 682L.

Given that the preferred finished appearance for the embodiment shown in FIGS. 13-16 is to have a uniform (i.e., coplanar) tile line at the top of the wall panels, by cutting or otherwise forming the bottom edges 689R and 689L of side wall covering panels 682R, 682L to substantially follow the pitch of the pan floor or pan floor covering panel, one can produce the desired uniform tile line on the top of the wall panels in a simple and cost effective manner.

It is understood, therefore, that a finished shower can be constructed in far less time than has heretofore been possible, with simple components, according to the following method: in a space adapted to receive a waterproof shower pan which defines or has associated with it a linear drain near a rear splashwall thereof, said pan comprising a substantially uniformly pitched planar floor which slopes toward the linear drain, and one or more splash walls upstanding from said floor, said space including two or more upstanding shower stall walls supported by wall studs, the stall walls having shower-facing surfaces that are coplanar with corresponding shower-facing surfaces of said splashwalls of said shower pan, the process for creating a shower comprising the steps of: (1) installing a shower pan floor covering panel on said pan floor to cover substantially all of said pan floor other than all or a portion of an area defined by said linear drain, said floor covering panel defining an opening through which water may flow into said linear drain; (2) installing a wall covering panel on each stall wall, each wall covering panel defining a bottom and a top edge, the bottom edge of each wall covering panel being substantially parallel to an upper surface of the floor covering panel adjacent to the floor covering panel bottom edge, the top edges of each wall covering panel lying in substantially the same plane; (3) optionally installing an inner curb wall covering panel on an inner curb wall defined by the shower pan, installing an outer curb wall covering panel on an outer curb wall defined by the shower pan, and installing an upper curb wall covering panel on an upper curb wall of said shower pan; (4) wherein a bottom edge of said inner curb wall covering panel faces the upper surface of the floor covering panel.

By the term "cover substantially all of said pan floor other than all or a portion of an area defined by said linear drain" is meant that the preferred floor covering panel is adapted to cover the majority of the shower pan floor with a single panel, but that one or more areas for water drainage is to be left. As an example, single floor panel covers are disclosed in my copending U.S. patent application Ser. No. 16/712,421, filed Dec. 12, 2019. Such panels cover substantially the entirety of the pan floor but still allow for drainage into the linear drain(s).

FIGS. 17-20 depict another method for carrying out the principles of this invention, and the components thereof. This embodiment also includes a so-called "rear" or "back" drain shower pan 612 with a linear drain 614, but in this embodiment the linear drain employs multiple removable grates 740 along with a commensurate number of substrate grates 742, which themselves define drainage slots 751. The pan 712 is comprised of a pitched floor 715 (which is preferably substantially planar leading up to the linear drain 714) defining a bottom surface thereof, whether with or without support ribs (not shown), and may include such additional features as one or more curbs 723, one or more side splash walls 720, and one or more rear splash walls 722. Accessory features of shower pans are well known (such as neo-angled curbs and/or splashwalls), and it is contemplated that such features may or may not be used in connection with the embodiments disclosed herein. In addition, other known accessory features (such as barrier-free entrances) may be employed without departing from the spirit and scope of the invention.

In embodiments, it may be desirable to space the linear drain 714 from either side of pan floor 715. In such cases, a second, smaller, floor covering panel 750 may be used to cover the small section of floor which extends between the immediately adjacent peripheral edge of pan floor 715 (e.g., splashwall 720L or shower stall side wall D) and the linear drain. Second floor covering panel 750 may define a cutout 744 adapted to receive all or a portion of the removable drain cover 740. Opposed edges of the large and small floor covering panels form a drainage gap "G" through which water may drain into linear drain 714.

As can be seen from FIGS. 17-20, floor 715, which in the embodiment shown has a linear drain near the rear splashwall 722 thereof, may reside substantially in one plane and be pitched or sloped toward linear drain 714. A standard slope is ¼ inch per foot, although any pitch which will accomplish the task of causing liquid to drain from floor 715 (or, in embodiments, whatever covering material is situated thereon, such as floor tile panel 749) into linear drain 74 is deemed to be within the scope of the invention. Using a single-plane floor eliminates the multi-pitched floors which have traditionally been used, which necessitate many cuts in floor tiles, and attendant labor time and expense.

The floor covering panel 749 defines a number of cutouts 743 corresponding to the number of removable drain grates 740 to accommodate a removable drain grate such as grate 740, such that, when the floor covering panel 749 is associated with the shower pan floor 715, the cutouts 743 provide an area in which the removable drain grates 740 may be removably received. Preferably, the one of the removable drain grates are located substantially adjacent the wastewater pipe in the sub-floor (not shown) to facilitate cleaning the drain or otherwise gaining access to the linear drain 714 and wastewater pipe. Floor panel 749 may be made of any shower floor covering material including ceramic or porcelain tile, stone, marble, polymer-based material, acrylic, solid surface, metal, or any suitable material for covering a floor from which liquid is to drain.

It is to be appreciated that the linear drain configurations disclosed in my co-pending U.S. patent application Ser. No. 16/712,421, filed Dec. 12, 2019, the contents of which are incorporated by reference herein as though fully set forth herein, may be employed with one or more of the embodiments disclosed herein. Alternatively, other linear drain configurations, and/or traditional circular drain configurations, may be employed in the shower installations disclosed in this specification. For example, in the embodiment shown in FIGS. 17-20, slotted or apertured first and second linear drain substrates 742A, 742B may be used to partially cover linear drain 614. In the case of slotted substrate 742A, 742B, slots 751 are defined thereby to permit water to flow through to the linear drain. Alternatively, substrate members such as those shown in FIGS. 41-48 of my co-pending U.S. patent application Ser. No. 16/712,421, filed Dec. 12, 2019, may be employed in place of the substrate linear drain members 742 herein, in the manner as shown in FIG. 11 of this application.

Left and right-side wall covering panels 782L and 782R, respectively, and rear wall covering panel 784, are applied to the shower drywall members D or studs S using any suitable adhesive or other mechanical fastening means. In embodiments, it is desirable to have the upper edges 783L, 783R and 785 of the wall covering panels 782L, 782R and 784, respectively, coincide in the same horizontal plane for aesthetic reasons so that the top of the panels are aligned and not at different heights relative to each other. In this way, if additional wall panels are added above wall panels 782L, 782R and 784, those panels will fit in the right orientations.

Figure 18:
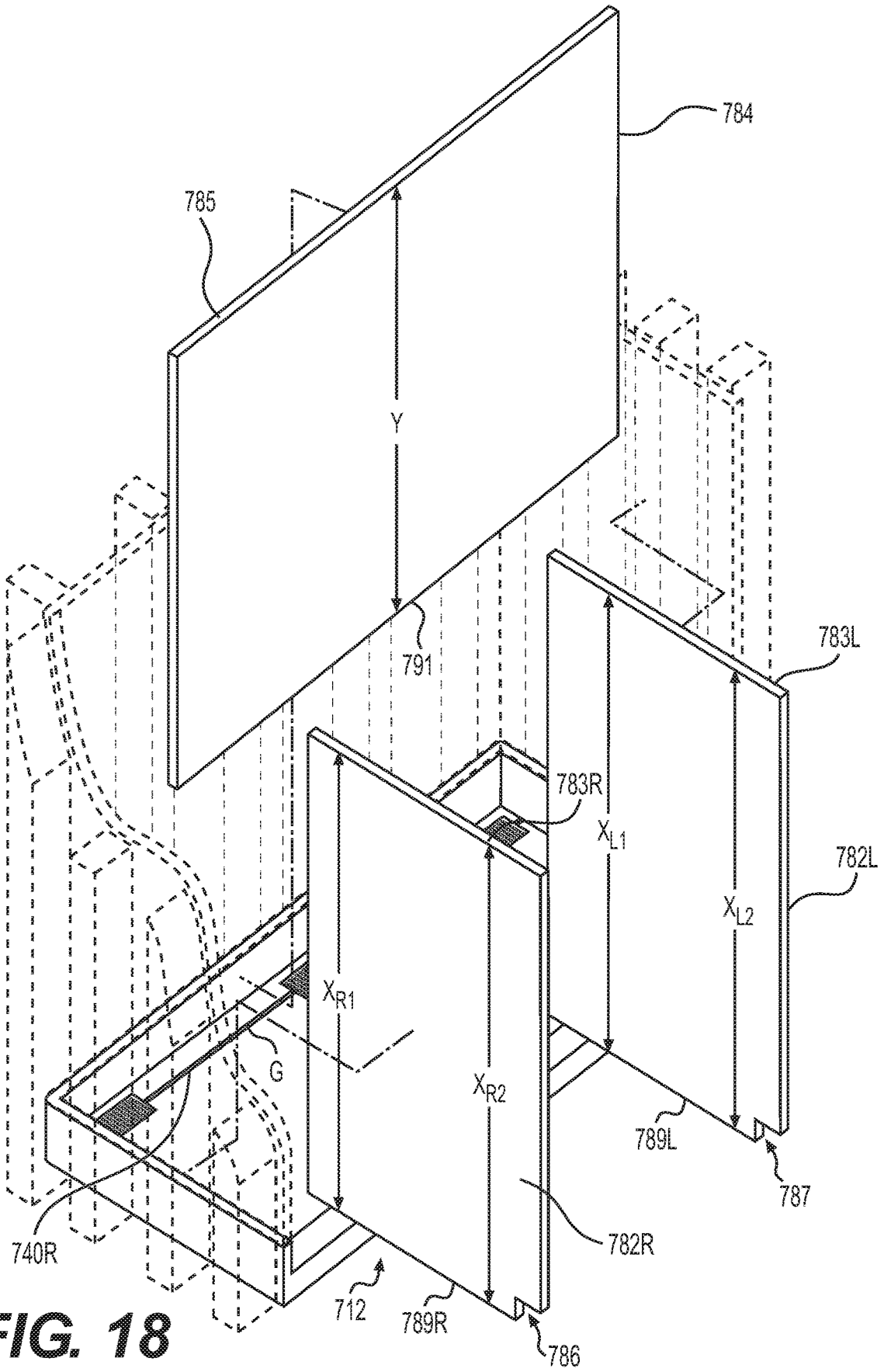
Figure 19:
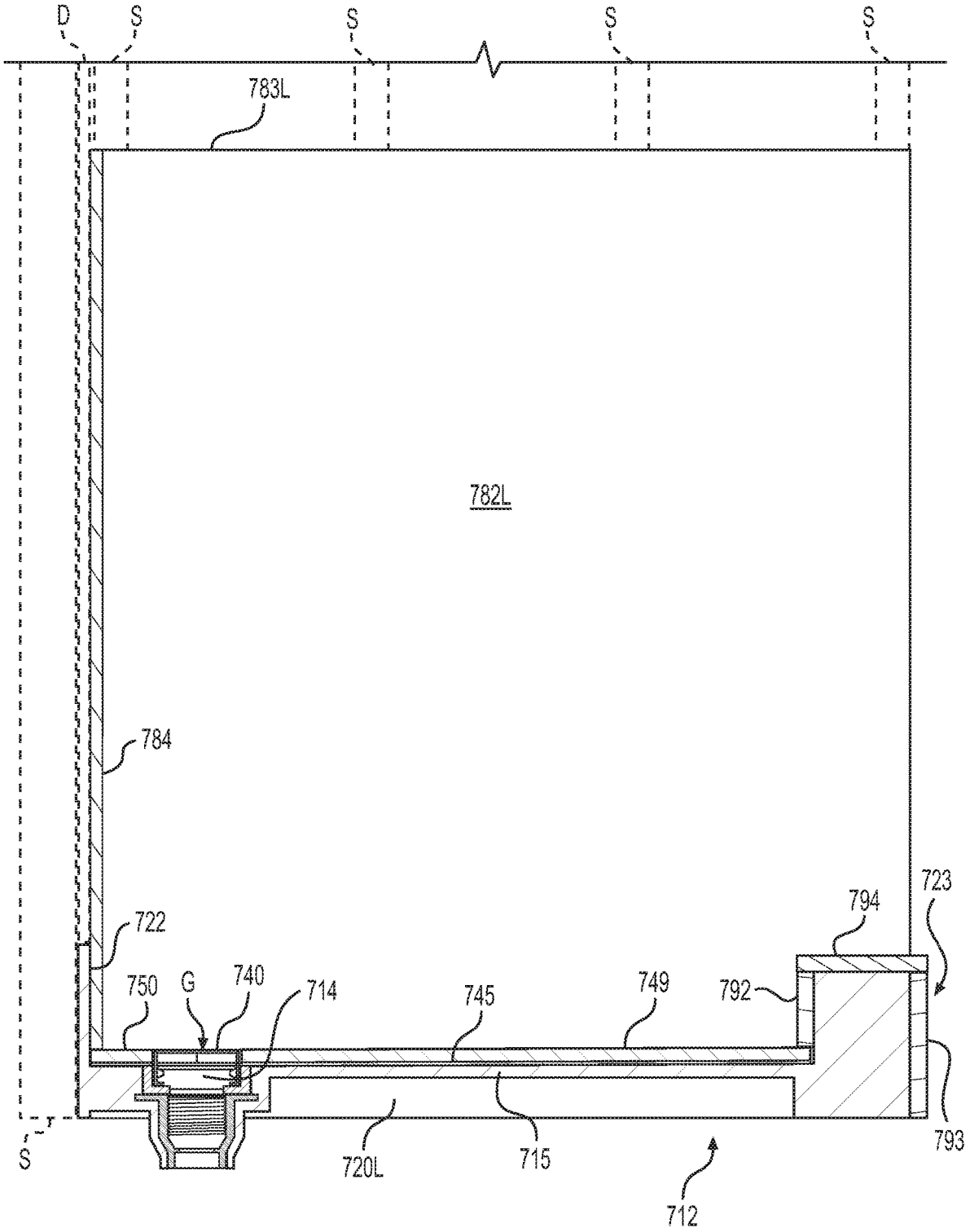
Figure 20:
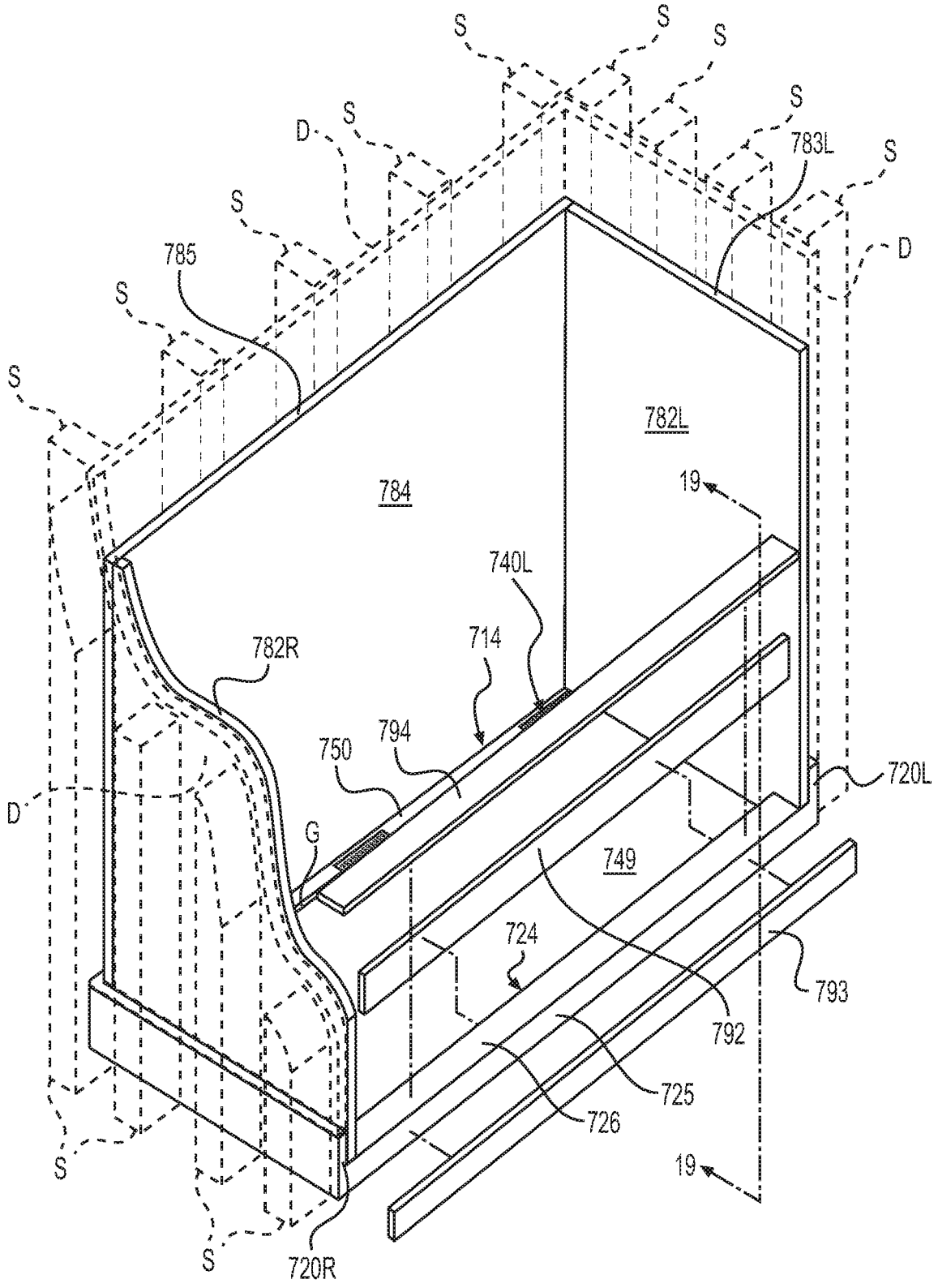

In order to accomplish the orientation of having the upper edges 783L, 783R and 785 of the wall covering panels 782L, 782R and 784, respectively, coincide in the same horizontal plane, and to simultaneously have the lower edges of those wall panels meet at or near the outer peripheral edges of the floor panel 749 so as to create an attractive visual effect, the lower edges 789R, 789L of side wall panels 782R and 782L, respectively, may be provided with a tapering profile (as seen in FIGS. 18-20). The height $X_{R2}$ of side wall panel 782R toward its foremost edge is less than the height $X_{R1}$ of that panel, and likewise for the heights $X_{L1}$ and $X_{L2}$ of left side wall panel 782L. In such an embodiment, the upper and lower edges 785, 791 of rear wall panel 784 are substantially parallel. In this way, the side and rear wall panels can be pre-sized during manufacturing or any other preparation step, and supplied to the installation site without having to be further cut, eliminating the need to make multiple tile cuts and install multiple pieces of tile on the floor and wall, while resulting in a beautiful aesthetic.

In embodiments, inner, outer and upper curb wall covering panels 792, 793 and 794 are supplied and applied to the inner, outer and upper walls 724, 725 and 726, respectively, of curb 723 in whatever sequence is dictated by the designer or installer. Outer curb wall covering panel 793 may be sized and shaped so that it covers the entirety of the outer curb wall 725, and may be coextensive with any adjacent wall covering member or material (not show).

Depending upon the selection of the designer or installer, the side wall covering panels and rear wall covering panel may be applied before or after the curb wall covering panels. Whichever sequence the wall and curb covering panels are applied in relative to each other, the second-to-be-applied panels should be sized and shaped such that their edges overlap a portion of the other in a manner that conceals any gap(s) between the wall covering panel below and adjacent sections of pan 712, as represented in FIG. 19, where the floor panel 749 meets side wall panels 782L and 782R.

Cutouts 786 and 787 may be provided in right and left wall covering panels 782R, 782L, respectively, to fit over curb 723. In embodiments, as discussed above, wall panels 782R, 782L may be applied before curb wall covering panels 792, 793 and 794 are applied, in which case cutouts 786, 787 should be sized and shaped to fit thereover. Conversely, if curb wall covering panels 792, 793 and 794 are applied before right and left wall covering panels 782R, 782L, cutouts 786, 787 should be sized and shaped to fit over curb 723 first, and curb wall covering panels 792, 793 and 794 sized and shaped to fit within the side wall covering panels 782R, 782L.

Given that the preferred finished appearance for the embodiment shown in FIGS. 17-20 is to have a uniform (i.e., coplanar) tile line at the top of the wall panels, by cutting or otherwise forming the bottom edges 789R and 789L of side wall covering panels 782R, 782L to substantially follow the pitch of the pan floor or pan floor covering panel, one can produce the desired uniform tile line on the top of the wall panels in a simple and cost effective manner.

It is understood, therefore, that a finished shower can be constructed in far less time than has heretofore been possible, with simple components, according to the following method: in a space adapted to receive a waterproof shower pan which defines or has associated with it a linear drain near a rear splashwall thereof, said pan comprising a substantially uniformly pitched planar floor which slopes toward the linear drain, and one or more splash walls upstanding from said floor, said space including two or more upstanding shower stall walls supported by wall studs, the stall walls having shower-facing surfaces that are coplanar with corresponding shower-facing surfaces of said splashwalls of said shower pan, the process for creating a shower comprising the steps of: (1) installing a shower pan floor covering panel on said pan floor to cover substantially all of said pan floor other than all or a portion of an area defined by said linear drain, said floor covering panel defining an opening through which water may flow into said linear drain; (2) installing a wall covering panel on each stall wall, each wall covering panel defining a bottom and a top edge, the bottom edge of each wall covering panel being substantially parallel to an upper surface of the floor covering panel adjacent to the floor covering panel bottom edge, the top edges of each wall covering panel lying in substantially the same plane; (3) optionally installing an inner curb wall covering panel on an inner curb wall defined by the shower pan, installing an outer curb wall covering panel on an outer curb wall defined by the shower pan, and installing an upper curb wall covering panel on an upper curb wall of said shower pan; (4) wherein a bottom edge of said inner curb wall covering panel is substantially parallel to the upper surface of the floor covering panel.

By the term "cover substantially all of said pan floor other than all or a portion of an area defined by said linear drain" is meant that the preferred floor covering panel is adapted to cover the majority of the shower pan floor with a single panel, but that one or more areas for water drainage is to be left. As an example, single floor panel covers are disclosed in my copending U.S. patent application Ser. No. 16/712,421, filed Dec. 12, 2019. Such panels cover substantially the entirety of the pan floor but still allow for drainage into the linear drain(s).

It is also to be understood that the left and right side removable drain grates 740R, 740L shown in FIGS. 17-20 may be located anywhere relative the pan floor and splashwalls. For example, those left and right removable grates 740 may be positioned adjacent, or closer to, side splashwalls 720R, 720L. Doing so would simply necessitate relocating the left and right side cutouts 743R, 743L in floor covering panel 749. The locations and number of removable drain grates throughout this disclosure may similarly be positioned in different locations.

Figure 17A:
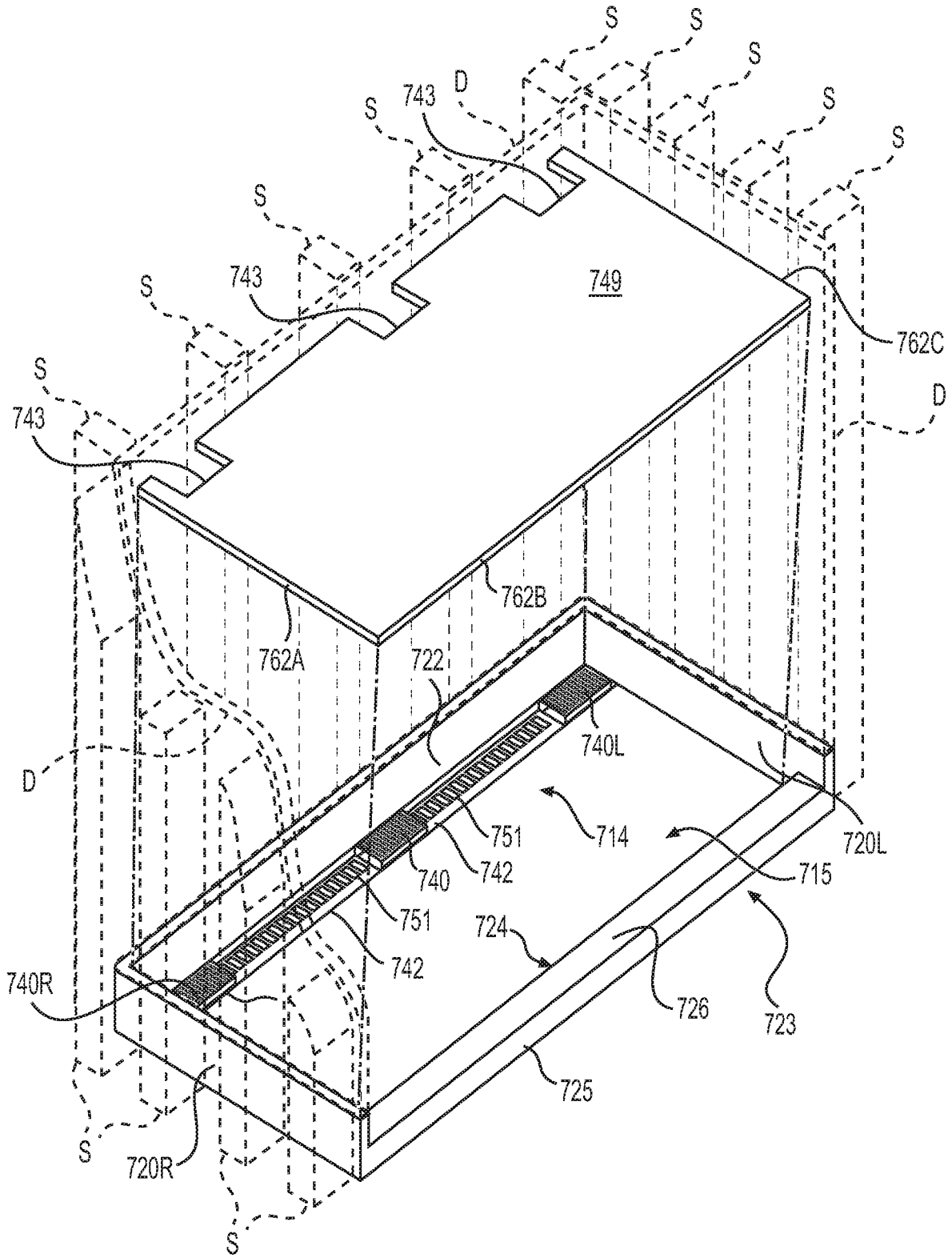

FIG. 17A depicts the embodiment of FIGS. 17-20 but with the linear drain 714 moved closer to the immediately adjacent peripheral edge of floor 715 (e.g., splashwall 720L or shower stall side wall D) by a small distance, eliminating the need for the smaller floor covering panel 750.

FIGS. 21-24 depict certain steps in a process for creating a finished left or right-drain shower, and components thereof. This embodiment includes a shower pan 812 with an integrally molded linear drain 814. The pan 812 is comprised of a pitched floor 815 (which is preferably planar leading up to the linear drain 814) defining a bottom surface thereof, whether with or without support ribs 816, and may include such additional features as one or more curbs 823, one or more side splash walls 820, and one or more rear splash walls 822. Accessory features of shower pans are well known (such as neo-angled curbs and/or splashwalls), and it is contemplated that such features may or may not be used in connection with the embodiments disclosed herein. In addition, other known accessory features (such as barrier-free entrances) may be employed without departing from the spirit and scope of the invention. Although the linear drains disclosed in the various embodiments shown and described herein are sometimes shown as extending over the entirety of the length or width of the pan floor, it is to be understood that the principles of my invention can be carried out using any size, proportion or shape of drain and still fall within the spirit and scope of the invention.

In embodiments, it may be desirable to space the linear drain 814 from either side of pan floor 815. In such cases, a second, smaller, floor covering panel 850 may be used to cover the small section of floor which extends between the immediately adjacent peripheral edge of pan floor 815 (e.g., splashwall 820L or shower stall side wall D) and the linear drain. Second floor covering panel 850 may define a cutout 844 adapted to receive all or a portion of the removable drain cover 840. Alternatively, the entirety of the cutout 844 may be defined by either the large floor covering panel 849 or the small one 850. Opposed edges of the large and small floor covering panels form a drainage gap "G" through which water may drain into linear drain 814.

As can be seen from FIGS. 21-24, floor 815, which in the embodiment shown has a linear drain on the left side thereof (making it a so-called "left drain" pan, which is essentially a mirror image of so-called "right drain" pan), may reside substantially in one plane and be pitched or sloped toward linear drain 814. A standard slope is ¼ inch per foot, although any pitch which will accomplish the task of causing liquid to drain from floor 815 (or, in embodiments, whatever covering material is situated thereon, such as floor tile panel 849) into linear drain 814 is deemed to be within the scope of the invention. Using a single-plane floor eliminates the multi-pitched floors which have traditionally been used, which necessitate many cuts in floor tiles, and attendant labor time and expense.

The floor covering panel 849 defines a cutout 843 to accommodate a removable drain grate such as grate 840, such that, when the floor covering panel 849 is associated with the shower pan floor 815, the cutout 843 provides an area in which the removable drain grate 840 may be removably received. Preferably, the removable drain grate is located substantially adjacent the wastewater pipe in the sub-floor (not shown) to facilitate cleaning the drain or otherwise gaining access to the linear drain 814 and wastewater pipe. Floor panel 849 may be made of any shower floor covering material including ceramic or porcelain tile, stone, marble, polymer-based material, acrylic, solid surface, metal, or any suitable material for covering a floor from which liquid is to drain.

It is to be appreciated that the partially concealed linear drain configurations disclosed in my co-pending U.S. patent application Ser. No. 16/712,421, filed Dec. 12, 2019, the contents of which are incorporated by reference herein as though fully set forth herein, may be employed with one or more of the embodiments disclosed herein. Alternatively, other linear drain configurations, and/or traditional circular drain configurations, may be employed in the shower installations disclosed in this specification. For example, in the embodiment shown in FIGS. 21-24, slotted or apertured first and second linear drain substrates 842A, 842B may be used to partially cover linear drain 814. In the case of slotted substrate 842A, 842B, slots 851 are defined thereby to permit water to flow through to the linear drain. Alternatively, substrate members such as those shown in FIGS. 41-48 of my co-pending U.S. patent application Ser. No. 16/712,421, filed Dec. 12, 2019, may be employed in place of substrate members 842A, 842B herein, as shown in FIG. 11 of this application. Also, it is to be appreciated that the drain locations illustrated in the various but exemplary embodiments disclosed herein are not intending to be limiting, and that virtually any drain location can be employed within scope of the invention. For example, the invention disclosed throughout this specification is intended to be used with, among other things, bathtub replacement arrangements, where a shower is constructed in place of an existing bathtub as part of a bathroom renovation. Typically, the bathtub drain is position approximately 3" to 6" from the side edge of the bathtub, meaning that the wastewater drain pipe in the subfloor is located at or near the side edge of the space allocated in the bathroom for a tub or shower. Since renovators ordinarily choose to retain the original location of the wastewater drain pipe in the subfloor due to the high cost and inconvenience of moving it, the location of the drain in a shower constructed in accordance with the teachings of my invention will sometimes be located accordingly.

Rear wall panel 884 is adapted to be affixed to drywall D or wall studs S along the back or rear edge of pan 812, and is defined by an upper edge 885, left and right side edges 890 and lower edge 891. Lower edge 891 is tapered or sloped to correspond substantially to the slope of floor 815 or floor covering panel 849. Left and right side edges 890 are adapted to reside in close relationship to side wall covering panels 882L and 882R when installed and to overlap so that any irregularities or gaps are concealed.

Figure 23:
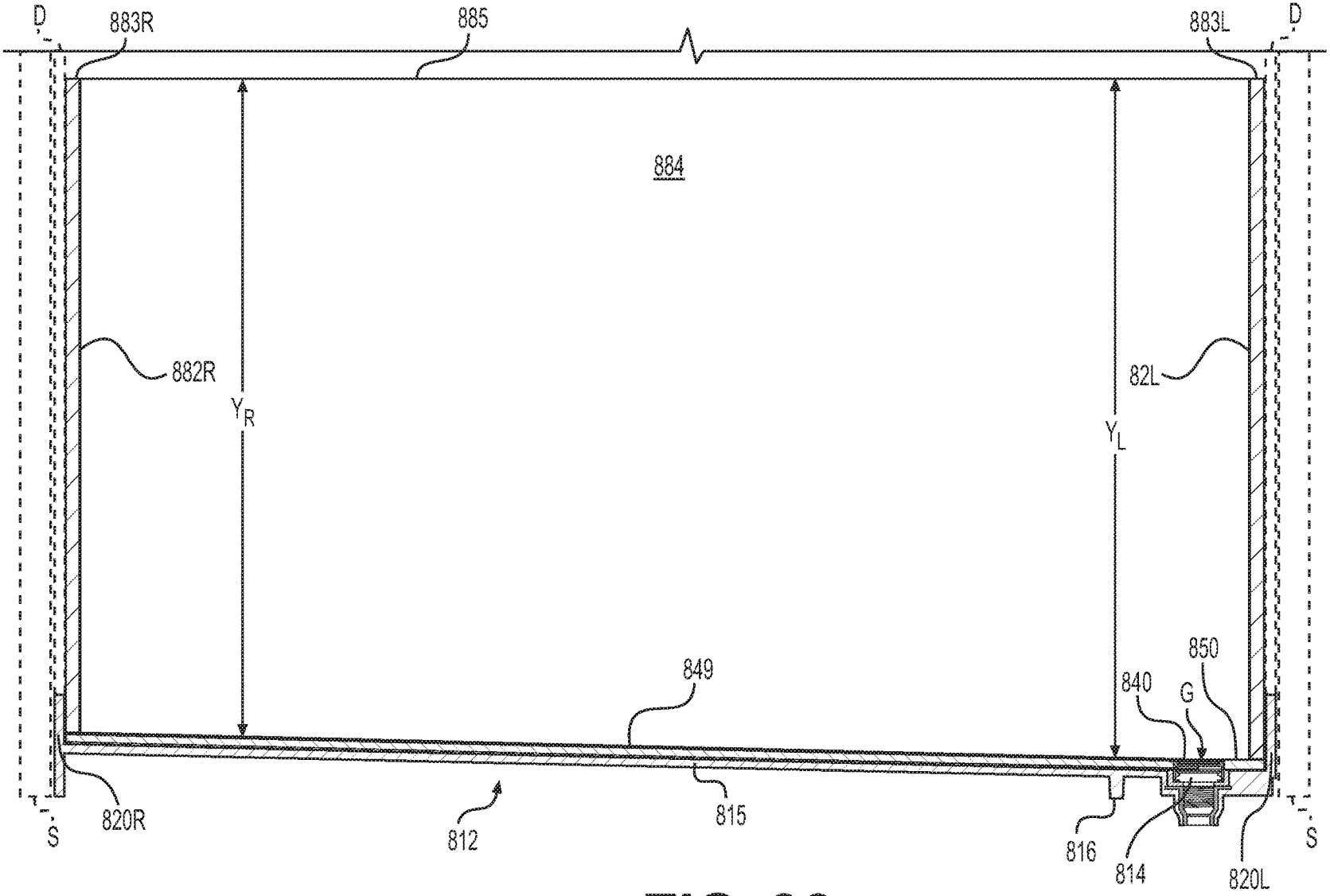

Left and right-side wall covering panels 882L and 882R, respectively, and rear wall covering panel 884, are applied to the shower board members D or studs S using any suitable adhesive or other mechanical fastening means. In embodiments, it is desirable to have the upper edges 883L, 883R and 885 of the wall covering panels 882L, 882R and 884, respectively, coincide in the same horizontal plane for aesthetic reasons so that the top of the panels are aligned and not at different heights relative to each other. It also permits if additional wall panels to be added above wall panels 882L, 882R and 884, to properly fit in the right orientations. In order to accomplish the orientation of having the upper edges 883L, 883R and 885 of the wall covering panels 882L, 882R and 884, respectively, coincide in the same horizontal plane, and to simultaneously have the lower edges of those wall panels meet at or near the outer peripheral edges of the floor panel 849 so as to create an attractive visual effect, the lower edge 891 of rear wall panel 884 may be provided with a tapering profile (as seen in FIG. 23) and right side wall panel 882R is made shorter than left side wall panel 882L. For example, right side wall panel 882R, while having upper and lower edges that are nonetheless substantially parallel, may have a height of $X_R$. Likewise, left side wall panel 882L, while having upper and lower edges that are nonetheless substantially parallel, may have a height of $X_L$, which is greater than $X_R$. In this way, side and rear wall panels can be pre-sized during manufacturing or any other preparation step, and supplied to the installation site without having to be further cut, eliminating the need to make multiple tile cuts and install multiple pieces of tile on the floor and wall, while resulting in a beautiful aesthetic.

In the case of a left drain pan, such as that shown in FIGS. 21-24, left wall covering panel 882L will be taller in its vertical dimension $X_L$ than the vertical height $X_R$ of right wall covering panel 882R due to the pitch of pan floor 815 and the commensurate difference in height between left and right splash walls 820L and 820R.

Likewise, the vertical height $Y_L$ of the left side of rear wall covering panel 884 will be greater than the vertical height $Y_R$ of the right side of panel 884 due to the pitch of pan floor 815 and the commensurate difference in height between the left and right sides of rear splash wall 822.

In embodiments, inner, outer and upper curb wall covering panels 892, 893 and 894 are supplied and applied to the inner, outer and upper walls 824, 825 and 826, respectively, of curb 823 in whatever sequence is dictated by the designer or installer. In certain embodiments, the two vertical curb panels are installed first and then pressed towards each other ensure that the upper curb panel comfortably covers the upper edges of both vertically oriented panels 892, 893. Like rear wall panel 884, the lower edge of inner curb wall covering panel 892 may be tapered to follow the pitch of floor 815 and/or 849 so that only a single inner curb wall covering panel need be used while still covering the inner curb sidewall, using the least number of covering members. Outer curb wall covering panel 893 may be sized and shaped so that it covers the entirety of the outer curb wall 825, and may be coextensive with any adjacent wall covering member or material (not show).

Depending upon the selection of the designer or installer, the side wall covering panels and rear wall covering panel may be applied before or after the curb wall covering panels. Whichever sequence the wall and curb covering panels are applied in relative to each other, the second-to-be-applied panels should be sized and shaped such that their edges overlap a portion of the other in a manner that conceals any irregularities or gap(s) between the wall covering panel below and adjacent sections of pan 812, as represented in FIG. 23, where the floor panel 849 meets side wall panels 882L and 882R.

Cutouts 886 and 887 may be provided in right and left wall covering panels 882R, 882L, respectively, to fit over curb 823. In embodiments, as discussed above, the floor panel(s) should be installed first, then the wall panels 882R, 882L (as well as rear wall panel 884) may be applied before inner and outer curb wall covering panels 892 and 893 are applied, in which case cutouts 886, 887 should be sized and shaped to fit thereover. Once the inner and outer curb wall covering panels 892, 893 are applied, the upper curb wall covering panel 894 can be applied to cover any irregularities or gaps between the curb and the wall panels. Conversely, if curb wall covering panels 892, 893 and 894 are all applied before right and left wall covering panels 882R, 882L, cutouts 886, 887 should be sized accordingly. Still further in the alternative, the right and left wall covering panels 82R, 82L can be applied before any of curb wall covering panels 892, 893 or 894 are applied, and then curb wall covering panels 892, 893 and 894 can be sized and shaped to fit within the side wall covering panels 882R, 882L, and cutouts 886, 887 sized and shaped to fit over curb 823 first.

Given that the preferred finished appearance is to have a uniform (i.e., coplanar) tile line at the top of the wall panels, by cutting or otherwise forming the bottom edge 890 of rear wall covering panel 884 to substantially follow the pitch of the pan floor or pan floor covering panel, one can produce the desired uniform tile line on the top of the wall panels in a simple and cost effective manner.

It is understood, therefore, that a finished shower can be constructed in far less time than has heretofore been possible, with simple components, according to the following method: in a space adapted to receive a waterproof shower pan which defines or has associated with it a linear drain 814 near either the left or right side thereof, said pan comprising a uniformly pitched planar floor 815, and one or more splash walls 820 and 822 upstanding from said floor, said space including two or more upstanding shower stall walls D supported by wall studs S, the stall walls having shower-facing surfaces that are coplanar with corresponding shower-facing surfaces of said splashwalls of said shower pan, the process for creating a shower comprising the steps of: (1) installing a preformed shower pan floor covering panel 849 on said pan floor to cover substantially all of said pan floor other than all or a portion of an area defined by said linear drain, said floor covering panel 849 defining an opening through which water may flow into said linear drain; (2) installing a wall covering panel 882R, 882L and 884 on each stall wall, each wall covering panel defining a bottom and a top edge, the bottom edge of each wall covering panel being substantially parallel to an upper surface of the floor covering panel adjacent to the floor covering panel bottom edge, the top edges of each wall covering panel lying in substantially the same plane; (3) optionally, installing an inner curb wall covering panel 892 on an inner curb wall defined by the shower pan, installing an outer curb wall covering panel 893 on an outer curb wall defined by the shower pan, and installing an upper curb wall covering panel 894 on an upper curb wall of said shower pan; (4) wherein a bottom edge of said inner curb wall covering panel is substantially parallel to the upper surface of the floor covering panel.

By the term "cover substantially all of said pan floor other than all or a portion of an area defined by said linear drain" is meant that the preferred floor covering panel is adapted to cover the majority of the shower pan floor with a single panel, but that one or more areas for water drainage is to be left. As an example, single floor panel covers are disclosed in my copending U.S. patent application Ser. No. 16/712,421, filed Dec. 12, 2019. Such panels cover substantially the entirety of the pan floor but still allow for drainage into the linear drain(s).

Figure 21A:
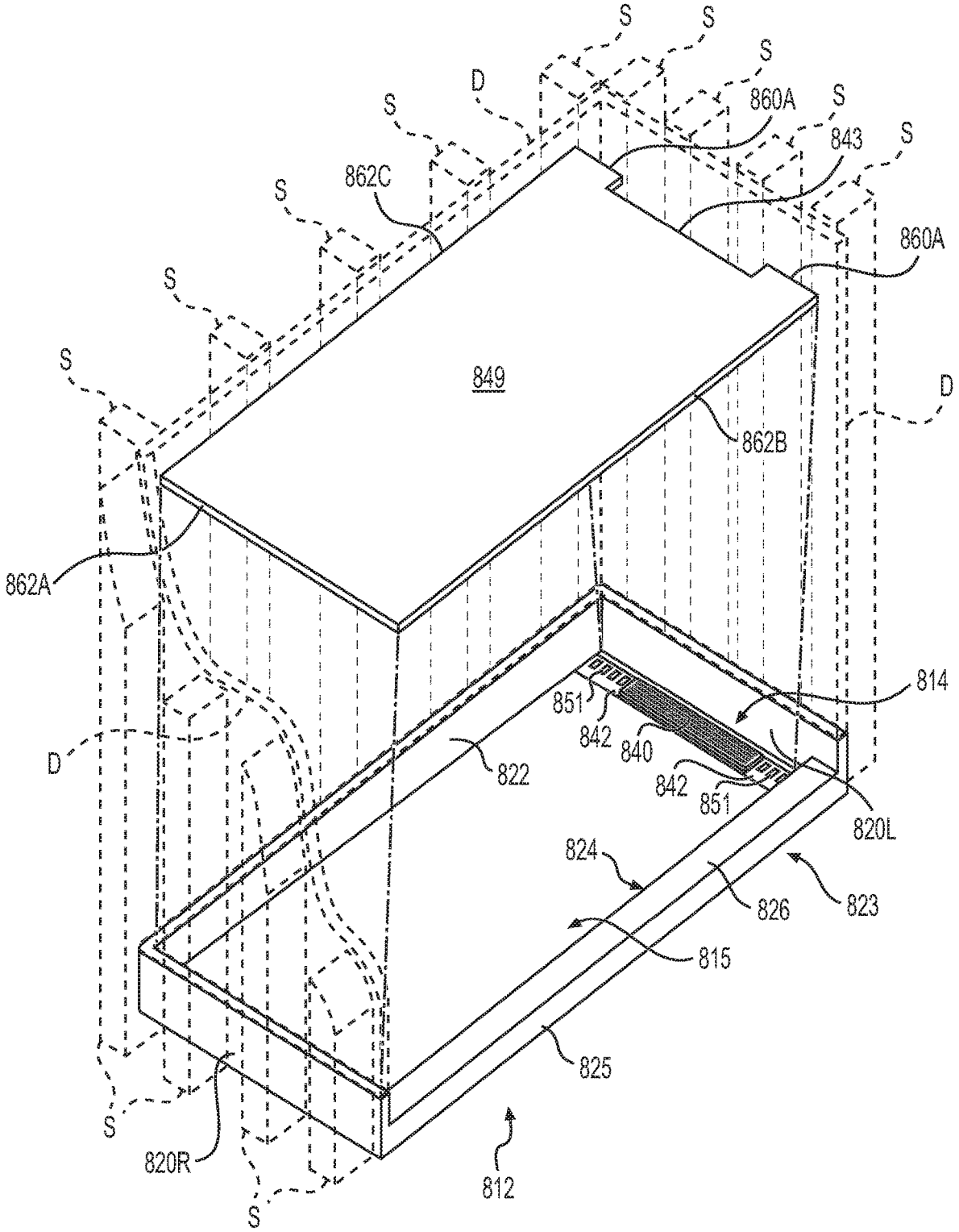
Figure 22:
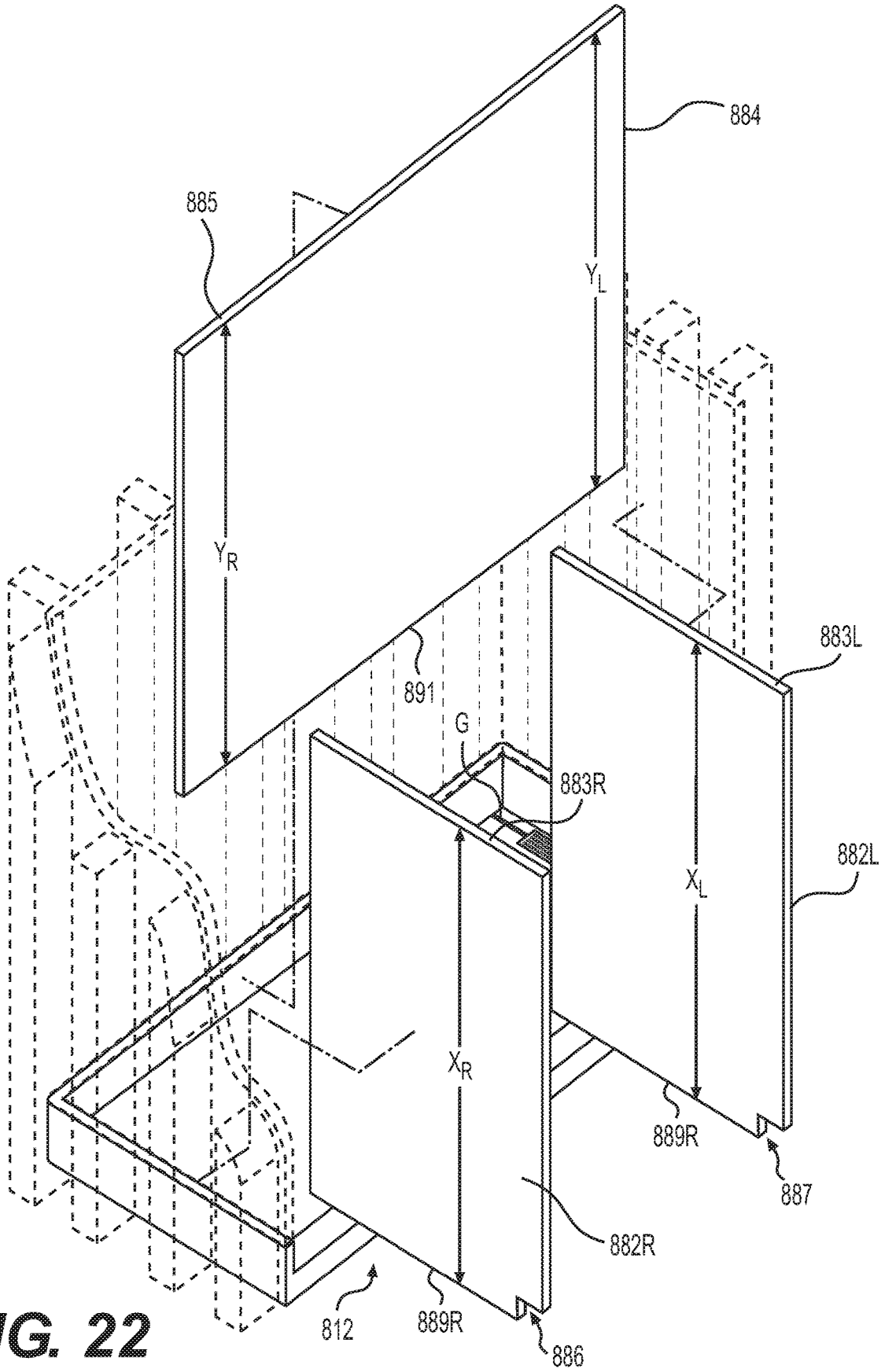

FIG. 21A depicts the embodiment of FIGS. 21-24 but with the linear drain 814 moved closer to the immediately adjacent peripheral edge of pan floor 915 (e.g., splashwall 920L or side shower stall wall D) by a small distance, thereby eliminating the need for smaller floor covering panel 850.

FIGS. 25-29 depict another method for carrying out the principles of this invention, and the components thereof. This embodiment also includes a so-called "rear" or "back" drain shower pan 912 with a linear drain 914, but instead of having a curb feature, it is a "barrier-free" pan, meaning that it provides handicapped access to the shower. The pan 912 is comprised of a pitched floor 915 (which is preferably substantially planar leading up to the linear drain 914) defining a bottom surface thereof, whether with or without support ribs (not shown), and a barrier-free (i.e., non-curbed) entrance 923, one or more side splash walls 920, and one or more rear splash walls 922. Accessory features of shower pans are well known (such as neo-angled curbs and/or splashwalls), and it is contemplated that such features may or may not be used in connection with the embodiments disclosed herein.

In embodiments, it may be desirable to space the linear drain 914 from either side of pan floor 915, such as that shown in FIGS. 25-28. In such cases, a second, smaller, floor covering panel 950 may be used to cover the small section of floor which extends between the immediately adjacent peripheral edge of pan floor 915 (e.g., splashwall 920L or shower stall side wall D) and the linear drain. Floor covering panel 950 may define a cutout 944 adapted to receive all or a portion of the removable drain cover 940. Alternatively, the entirety of the cutout 944 may be defined by either the large floor covering panel 949 or the small one 950. Opposed edges of the large and small floor covering panels form a drainage gap "G" through which water may drain into linear drain 914.

As can be seen from FIGS. 25-29, floor 1015, which in the embodiment shown has a linear drain near the rear splash-wall 1022 thereof, may reside substantially in one plane and be pitched or sloped toward linear drain 1014. A standard slope is ¼ inch per foot, although any pitch which will accomplish the task of causing liquid to drain from floor 1015 (or, in embodiments, whatever covering material is situated thereon, such as floor tile panel 1049) into linear drain 1014 is deemed to be within the scope of the invention. Using a single-plane floor eliminates the multi-pitched floors which have traditionally been used, which necessitate many cuts in floor tiles, and attendant labor time and expense.

The floor covering panel 1049 defines a cutout 1043 to accommodate a removable drain grate such as grate 1040, such that, when the floor covering panel 649 is associated with the shower pan floor 1015, the cutout 1043 provides an area in which the removable drain grate 1040 may be removably received. Preferably, the removable drain grate is located substantially adjacent the wastewater pipe in the sub-floor (not shown) to facilitate cleaning the drain or otherwise gaining access to the linear drain 1014 and wastewater pipe. Floor panel 1049 may be made of any shower floor covering material including ceramic or porcelain tile, stone, marble, polymer-based material, acrylic, solid surface, metal, or any suitable material for covering a floor from which liquid is to drain.

It is to be appreciated that the linear drain configurations disclosed in my co-pending U.S. patent application Ser. No. 16/712,421, filed Dec. 12, 2019, the contents of which are incorporated by reference herein as though fully set forth herein, may be employed with one or more of the embodiments disclosed herein. Alternatively, other linear drain configurations, and/or traditional circular drain configurations, may be employed in the shower installations disclosed in this specification. For example, in the embodiment shown in FIGS. 25-28, slotted or apertured first and second linear drain substrates 1042A, 1042B may be used to partially cover linear drain 614. In the case of slotted substrate 1042A, 1042B, slots 1051 are defined thereby to permit water to flow through to the linear drain. Alternatively, substrate members such as those shown in FIGS. 41-48 of my co-pending U.S. patent application Ser. No. 16/712,421, filed Dec. 12, 2019, may be employed in place of substrate members 1042A, 1042B herein, in the manner as shown in FIG. 29.

Left and right-side wall covering panels 1082L and 1082R, respectively, and rear wall covering panel 1084, are applied to the shower drywall members D using any suitable adhesive or other mechanical fastening means. In embodiments, it is desirable to have the upper edges 1083L, 1083R and 1085 of the wall covering panels 1082L, 1082R and 1084, respectively, coincide in the same horizontal plane for aesthetic reasons. In this way, if additional wall panels are added above wall panels 1082L, 1082R and 1084, those panels will fit in the right orientations. In order to accomplish the orientation of having the upper edges 1083L, 1083R and 1085 of the wall covering panels 1082L, 1082R and 1084, respectively, coincide in the same horizontal plane, and to simultaneously have the lower edges of those wall panels meet at or near the outer peripheral edges of the floor panel 1049 so as to create an attractive visual effect, the lower edges 1089R, 1089L of side wall panels 1082R and 1082L, respectively, may be provided with a tapering profile (as seen in FIGS. 25-28). The height $X_{R2}$ of side wall panel 1082R toward its foremost edge is less than the height $X_{R1}$ of that panel, and likewise for the heights $X_{L1}$ and $X_{L2}$ of left side wall panel 1082L. In such an embodiment, the upper and lower edges 1085, 1091 of rear wall panel 1084 are substantially parallel. In this way, the side and rear wall panels can be pre-sized during manufacturing or any other preparation step, and supplied to the installation site without having to be further cut, eliminating the need to make multiple tile cuts and install multiple pieces of tile on the floor and wall, while resulting in a beautiful aesthetic.

In embodiments, inner, outer and upper curb wall covering panels 1092, 1093 and 1094 are supplied and applied to the inner, outer and upper walls 1024, 1025 and 1026, respectively, of curb 1023 in whatever sequence is dictated by the designer or installer. Outer curb wall covering panel 1093 may be sized and shaped so that it covers the entirety of the outer curb wall 1025, and may be coextensive with any adjacent wall covering member or material (not show).

Depending upon the selection of the designer or installer, the side wall covering panels and rear wall covering panel may be applied before or after the curb wall covering panels. Whichever sequence the wall and curb covering panels are applied in relative to each other, the second-to-be-applied panels should be sized and shaped such that their edges overlap a portion of the other in a manner that conceals any gap(s) between the wall covering panel below and adjacent sections of pan 1012, as represented in FIG. 27, where the floor panel 1049 meets side wall panels 1082L and 1082R.

Given that the preferred finished appearance for the embodiment shown in FIGS. 25-29 is to have a uniform (i.e., coplanar) tile line at the top of the wall panels, by cutting or otherwise forming the bottom edges 1089R and 1089L of side wall covering panels 1082R, 1082L to substantially follow the pitch of the pan floor or pan floor covering panel, one can produce the desired uniform tile line on the top of the wall panels in a simple and cost effective manner.

It is understood, therefore, that a finished shower can be constructed in far less time than has heretofore been possible, with simple components, according to the following method: in a space adapted to receive a waterproof shower pan which defines or has associated with it a linear drain near a rear splashwall thereof, said pan comprising a substantially uniformly pitched planar floor which slopes toward the linear drain, and one or more splash walls upstanding from said floor, said space including two or more upstanding shower stall walls supported by wall studs, the stall walls having shower-facing surfaces that are coplanar with corresponding shower-facing surfaces of said splashwalls of said shower pan, the process for creating a shower comprising the steps of: (1) installing a shower pan floor covering panel on said pan floor to cover substantially all of said pan floor other than all or a portion of an area defined by said linear drain, said floor covering panel defining an opening through which water may flow into said linear drain; and (2) installing a wall covering panel on each stall wall, each wall covering panel defining a bottom and a top edge, the bottom edge of each wall covering panel being substantially parallel to an upper surface of the floor covering panel adjacent to the floor covering panel bottom edge, the top edges of each wall covering panel lying in substantially the same plane.

By the term "cover substantially all of said pan floor other than all or a portion of an area defined by said linear drain" is meant that the preferred floor covering panel is adapted to cover the majority of the shower pan floor with a single panel, but that one or more areas for water drainage is to be left. As an example, single floor panel covers are disclosed in my copending U.S. patent application Ser. No. 16/712,421, filed Dec. 12, 2019. Such panels cover substantially the entirety of the pan floor but still allow for drainage into the linear drain(s).

As noted, the drains of the invention described throughout this specification can be located in any suitable location on the pan floor without departing from the spirit and scope of the invention. In embodiments, such as shown in FIG. 29, it may be desirable to space the linear drain 1014 from either side of pan floor 1015. A second, smaller, floor covering panel 1044 may be used to cover the small section of floor which extends between the immediately adjacent peripheral edge of pan floor 1015 (e.g., splashwall 1020L or shower stall side wall D) and the linear drain 1014. Floor covering panel 1050 may define a cutout 1044 adapted to receive all or a portion of the removable drain cover 1040. Opposed edges of the large and small floor covering panels form a drainage gap "G" through which water may drain into linear drain 1014.

Figure 29A:
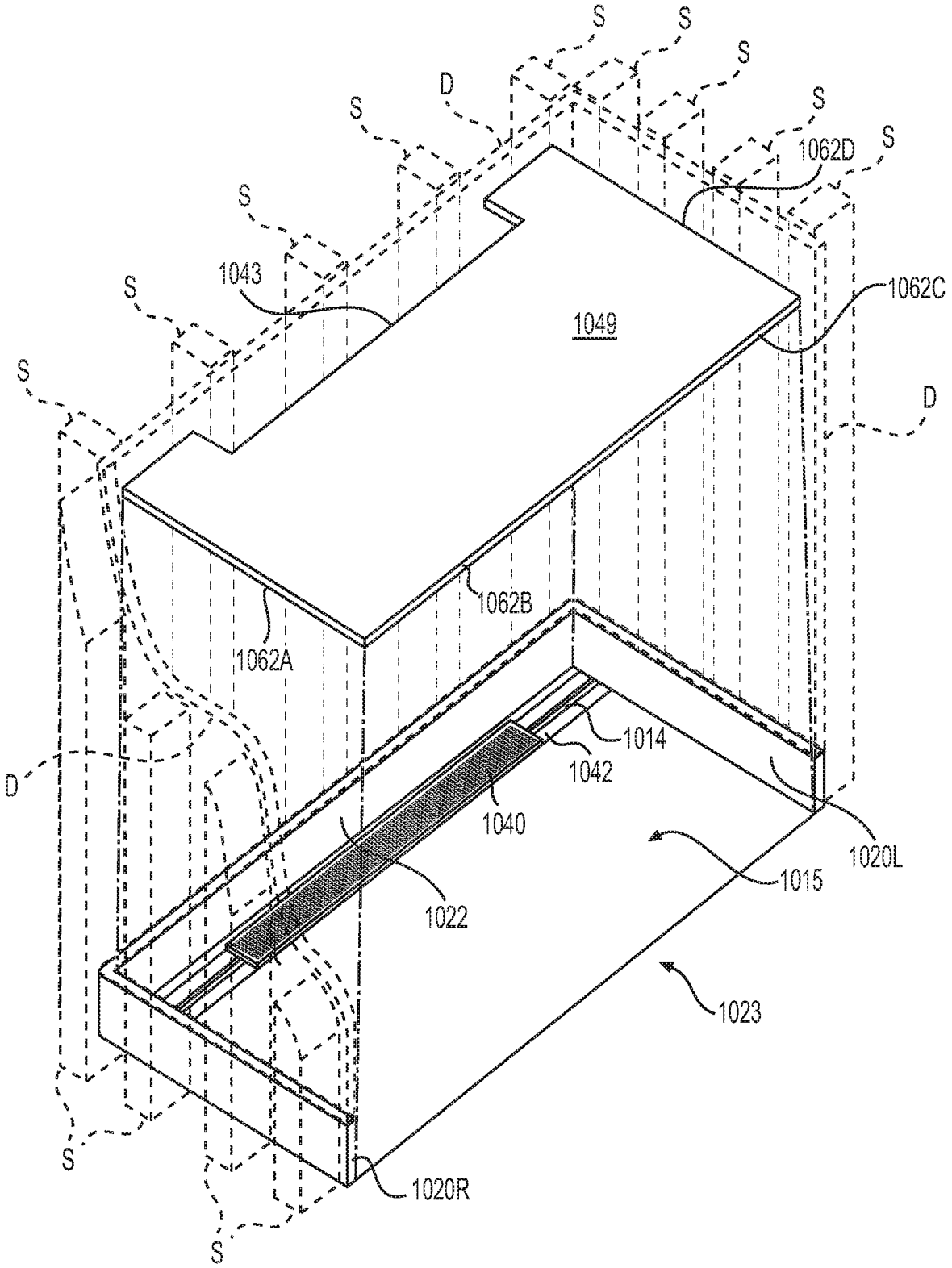

FIG. 29A depicts the embodiment of FIG. 29 but with the linear drain 1014 moved closer to the immediately adjacent peripheral edge of floor 1015 (e.g., splashwall 1020L or sidewall D) by a small distance, eliminating the need for smaller floor covering panel 1050. Water is permitted to drain through opening "G" defined by the edges of floor covering panel 1049 and splashwall 1020L (or shower stall sidewall D in the case where a pan without splashwalls is used).

Some shower pan arrangements do not employ splashwalls. In such cases, the stall walls D of the shower enclosure are used to function to support the wall covering panels all the way to the floor, e.g., the subfloor of the bathroom and/or the shower pan floor. The stall walls, typically made from sheetrock and the like, are waterproofed with the pan floor, and the floor and walls covered with wall covering material. FIGS. 30-33 depict a shower arrangement and method of constructing same similar to that shown in FIGS. 1-4 but without splashwalls. FIGS. 34-37 depict a shower arrangement and method of constructing same similar to that shown in FIGS. 5-8 but without splashwalls. FIGS. 38-41 depict a shower arrangement and method of constructing same similar to that shown in FIGS. 13-17 but without splashwalls.

The constructions shown in FIGS. 30-41 can utilize the curbs shown in FIGS. 1-4, 5-8 and/or 13-17 or not, and any other accessories.

The embodiments shown in FIGS. 1-41 are examples of structural arrangements for showers in which large, preformed or pre-cut monolithic wall and/or floor covering panels are used in lieu of traditional smaller tiles that require laborious measuring, cutting and meticulous placement. As a result, large quantities of time and expense are saved in the construction of showers.

It should be noted that the removable and nonremovable drain grates 40, 42, 140, 142, 240, 242, 340, 342, 440, 442, 540, 542, 640, 642, 740, 742, 840, 842, 940, 942, 1040 and 1042 shown and described throughout this disclosure may be sized and shaped differently, and located in different locations, than shown without departing from the spirit and scope of the invention.

It is also contemplated that the shower pans used with the inventions disclosed herein may be any one or more of prefabricated shower pans, partially prefabricated shower pans, mud-base shower pans and/or hot mopped shower pans, with or without the use of the splashwalls shown in connection with certain embodiments.

It is also important to note that:

A. one or more removable drain grates may be employed which may optionally:
   - i. have the same size or different sizes;
   - ii. have the same shape or different shapes;
   - iii. have the same design or different designs;
   - iv. have the same lengths or different lengths;
   - v. have the same widths or different widths;
   - vi. be sequenced with one or more nonremovable substrate grates partially or wholly covered with the shower floor panels
   - vii. have grate cutouts that accommodate the size of each removable grate;
   - viii. be sequenced with one or more nonremovable substrate grates partially or wholly covered with the shower floor panels.

B. there may be one or more nonremovable substrate drain grates which are adapted to be partially or wholly covered by one or more shower floor covering panels, which nonremovable substrate grates may optionally:
   - ix. have the same size or different sizes;
   - x. have the same shape or different shapes;
   - xi. have the same design or different designs;
   - xii. have the same lengths or different lengths;
   - xiii. have the same widths or different widths;
   - xiv. form the same length drainage gap;
   - xv. form the same shape drainage gap;
   - xvi. form the same width drainage gap;
   - xvii. have a drainage gap with no obstructions;
   - xviii. have a drainage gap with different shaped or sized drainage holes located within the drainage gap;
   - xix. have a one-piece substrate grate forming and spanning the drainage with drainage holes formed within such grate which may be located on one or more locations within the linear drain;
   - xx. have two nonremovable grates installed on each side of the linear drain so they are supported from the bottom of the linear drain but place no obstructions within the drainage gap within the floor of the shower floor;
   - xxi. be sequenced with one or more removable substrate grates.

In embodiments, a process or method for constructing a shower may be carried out as follows: in a space intended to receive a constructed a shower, the space adapted to receive a waterproof shower pan, said pan having associated therewith a linear drain near either a left or right side of said pan, said pan comprising a substantially uniformly pitched planar floor, the floor defining a peripheral floor edge, said space including at least left and right upstanding shower stall side walls and at least one upstanding shower stall rear wall, said stall walls supported by wall studs, a process for constructing a shower, comprising the steps of: (1) installing a shower pan floor covering panel on said pan floor to cover substantially all of said pan floor other than (i) all or a portion of an area defined by said linear drain, and (ii) an area between the linear drain and an immediately adjacent peripheral edge of the floor; (2) installing a right shower wall covering panel on the shower stall right side wall, installing a left shower wall covering panel on the shower stall left side wall, and installing a rear shower wall covering panel on the shower stall rear wall, each left, right and rear wall covering panel defining a bottom and a top edge, the bottom edge of each of the left, right and rear wall covering panels being substantially parallel to an upper surface of the floor covering panel adjacent to the respective left, right and rear wall covering panel bottom edge, the top edge of each of the left, right and rear wall covering panels lying in substantially the same plane, the bottom edge of the rear wall covering panel being non-parallel to the top edge of the rear wall covering panel.

An alternative process or method for constructing a shower may be carried out as follows: in a space in which is adapted to be constructed a shower, the space adapted to receive a waterproof shower pan, said pan having associated therewith a linear drain which is located away from a left or right side of said pan, said pan comprising first and second uniformly pitched planar floor sections each of which slope toward said linear drain, said space including at least one left and at least one right upstanding shower stall side wall and at least one upstanding shower stall rear wall, said side and rear stall walls supported by wall studs, a process for constructing a shower, comprising the steps of: (1) installing first and second preformed shower pan floor covering panels on said first and second pan floor sections, respectively, to cover substantially all of said first and second floor sections other than all or a portion of one or more areas defined by said linear drain; and (2) installing at least one right side wall covering panel and at least one left side wall covering panel, and at least one rear wall covering panel, each of the first and second side wall covering panels and the at least one rear wall covering panel defining a bottom edge and a top edge, the bottom edge of each side and rear wall covering panel being substantially parallel to an upper surface of the floor covering panel adjacent to the respective wall covering panel bottom edge, the top edge of each of the at least one left, right and rear wall covering panels lying in substantially the same plane, the bottom edge of the rear wall covering panel being non-parallel to the top edge of the rear wall covering panel.

It can be seen that the invention, through the various exemplary, non-limiting embodiments disclosed herein, provides customized kits from which can be assembled any size shower with any drain location and size, methods for assembling the components of the kits, and resulting showers. Also, two or more wall covering panels may be used to cover any rear or side shower wall, although it is preferred to use one panel per wall because of the simplicity of the installation and aesthetics involved.

What is claimed is:

1. A combination shower floor and linear drain apparatus for a shower enclosure, the enclosure defined by a sub-floor adapted to receive a shower pan, at least one rear wall, and at least one right and at least one left side wall, comprising:

a planar shower pan floor adapted to be placed on the sub-floor, the floor defining a peripheral pan floor edge, the pan floor residing in a pan floor plane;

a linear drain adapted to be associated with the shower pan floor in such a manner that water draining off of the pan floor will drain toward the linear drain;

a shower floor covering panel adapted to be placed in registry with the shower pan floor and cover substantially all of said pan floor other than (i) all or a portion of an area defined by said linear drain, and (ii) an area between the linear drain and an immediately adjacent peripheral edge of the shower pan floor nearest the right side wall, the floor covering panel defining a peripheral edge;

a rear wall covering panel adapted to cover substantially all of the rear wall, the rear wall covering panel defining an upper edge and a lower edge, the upper edge of the rear wall covering panel adapted to reside in a substantially horizontal plane when the rear wall covering panel is installed in association with the rear wall, the lower edge of the rear wall covering panel residing in a plane that is not parallel to the horizontal plane in which the upper edge of the rear wall covering panel is adapted to reside, the lower edge of the rear wall covering panel being substantially parallel to the pan floor plane and in registry with a portion of the shower floor covering panel;

a right side wall covering panel adapted to cover substantially all of the right side wall and having a first height;

a left side wall covering panel adapted to cover substantially all of the left side wall and having a second height, wherein the first height is less than the second height;

the right side wall covering panel defining an upper edge and a lower edge, the upper edge of the right side wall covering panel adapted to reside in substantially the same plane as the upper edge of the rear wall covering panel when the right side wall covering panel is installed in association with the right side wall;

the left side wall covering panel defining an upper edge and a lower edge, the upper edge of the left side wall covering panel adapted to reside in substantially the same plane as the upper edge of the rear wall covering panel when the left side wall covering panel is installed in association with the left side wall;

the lower edges of the right and left side wall covering panels residing in different substantially horizontal planes.

2. The shower floor and linear drain apparatus of claim 1, wherein the floor covering panel defines at least one cutout adapted to receive a removable linear drain cover.

3. The shower floor and linear drain apparatus of claim 1, wherein the floor covering panel defines at least two cutouts, each adapted to receive a removable linear drain cover.

4. The shower floor and linear drain apparatus of claim 1, wherein the floor covering panel defines more than two cutouts, each adapted to receive a removable linear drain cover.

5. The shower floor and linear drain apparatus of claim 1, wherein a portion of the peripheral edge of the shower floor covering panel is spaced from a corresponding portion of the peripheral edge of the shower pan floor so as to define a water drainage gap therebetween.

6. The shower floor and linear drain apparatus of claim 2, wherein a portion of the peripheral edge of the shower floor covering panel is spaced from a corresponding portion of the peripheral edge of the shower pan floor so as to define a water drainage gap therebetween.

7. The shower floor and linear drain apparatus of claim 1, wherein the shower pan includes a shower pan curb defined by an inner curb wall, an outer curb wall and an upper curb wall, further comprising an inner curb wall covering panel adapted to cover substantially all of the inner curb wall, the inner curb wall covering panel defining an inner curb wall lower edge which is adapted to be substantially parallel to the lower edge of the rear wall covering panel.

8. The shower floor and linear drain apparatus of claim 7, further comprising an outer curb wall covering panel adapted to cover substantially all of the outer curb wall.

9. The shower floor and linear drain apparatus of claim 8, further comprising an upper curb wall covering panel adapted to cover substantially all of the upper curb wall.

10. The shower floor and linear drain apparatus of claim 1, further comprising at least one splashwall attached to said shower pan floor adjacent the linear drain.

* * * * *